US006652343B2

(12) United States Patent
Hasegawa et al.

(10) Patent No.: US 6,652,343 B2
(45) Date of Patent: Nov. 25, 2003

(54) METHOD FOR GETTERING AN IMAGE DISPLAY APPARATUS

(75) Inventors: Mitsutoshi Hasegawa, Kanagawa (JP); Ihachiro Gofuku, Kanagawa (JP); Yasuhiro Hamamoto, Kanagawa (JP); Kazuya Shigeoka, Kanagawa (JP); Yutaka Arai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/116,133

(22) Filed: Apr. 5, 2002

(65) Prior Publication Data

US 2002/0109460 A1 Aug. 15, 2002

Related U.S. Application Data

(62) Division of application No. 09/419,799, filed on Oct. 18, 1999, now Pat. No. 6,396,207.

(30) Foreign Application Priority Data

Oct. 20, 1998 (JP) ..... 10-297782
Oct. 20, 1998 (JP) ..... 10-297783
Oct. 29, 1998 (JP) ..... 10-308328

(51) Int. Cl.[7] ..... H01J 9/39
(52) U.S. Cl. ..... 445/25; 445/41
(58) Field of Search ..... 445/25, 41

(56) References Cited

U.S. PATENT DOCUMENTS 2,714,785 A * 8/1955 Roovers ..... 445/43
5,453,659 A 9/1995 Wallace et al. ..... 313/495
5,508,586 A 4/1996 Martelli et al. ..... 313/560
5,688,708 A * 11/1997 Kato et al. ..... 445/25
5,689,151 A 11/1997 Wallace et al. ..... 313/495
5,693,438 A 12/1997 Liu et al. ..... 430/28
5,697,825 A * 12/1997 Dynka et al. ..... 445/25
5,866,978 A 2/1999 Jones et al. ..... 313/495
5,936,342 A 8/1999 Ono et al. ..... 313/495
6,054,808 A 4/2000 Watkins et al. ..... 313/495
6,137,218 A 10/2000 Kaneko et al. ..... 313/495
6,184,610 B1 2/2001 Shibata et al. ..... 313/309
6,191,529 B1 2/2001 Park ..... 313/553
6,210,245 B1 4/2001 Sando et al. ..... 445/6
6,220,912 B1 4/2001 Shigeoka et al. ..... 445/24
6,259,422 B1 7/2001 Hamamoto ..... 345/74.1
6,309,691 B1 10/2001 Hasegawa ..... 427/8
2002/0015800 A1 2/2002 Miyamoto et al. ..... 427/553

FOREIGN PATENT DOCUMENTS

EP 0 467 572 A2 1/1992
EP 0 708 471 A1 4/1996
EP 0 780 875 A1 6/1997
JP 63-181248 7/1988
JP 3-254042 11/1991
JP 4-12436 1/1992
JP 8-167392 6/1996
JP 9-82245 3/1997
JP 9-320493 12/1997

OTHER PUBLICATIONS

European Search Report for Application No. 99308242.9 (Jun. 16, 2003).

* cited by examiner

*Primary Examiner*—Kenneth J. Ramsey
(74) *Attorney, Agent, or Firm*—Fitzpatrick, Cella, Harper & Scinto

(57) ABSTRACT

An image display apparatus is provided with an external housing constituted by members including first and second substrates positioned with a gap therebetween, an electron source positioned on the first substrate in the external housing, and a fluorescent film and an accelerating electrode provided on the second substrate. A first getter is positioned in the image display area in the external housing. A second getter is provided, so that it is insulated from the electron source and the accelerating electrode, which surrounds the first getter.

7 Claims, 41 Drawing Sheets

ARRANGEMENT OF GETTERS

SECTIONAL VIEW ALONG 23C—23C

IMAGE FORMING APPARATUS

IMAGE FORMING APPARATUS

ARRANGEMENT OF GETTERS

SECTIONAL VIEW

IMAGE FORMING APPARATUS

TOP OF IMAGE FORMING APPARATUS

SECTIONAL VIEW ALONG 11A—11A

SECTIONAL VIEW ALONG 11B—11B

PLAN VIEW

SECTIONAL VIEW ALONG 17B—17B

IMAGE FORMING APPARATUS

IMAGE FORMING APPARATUS

IMAGE FORMING APPARATUS

TOP OF IMAGE FORMING APPARATUS

SECTIONAL VIEW ALONG 22A—22A

SECTIONAL VIEW ALONG 22B—22B

IMAGE FORMING APPARATUS

ARRANGEMENT OF GETTERS

SECTIONAL VIEW ALONG 23C—23C

IMAGE FORMING APPARATUS

ARRANGEMENT OF GETTERS

SECTIONAL VIEW ALONG 24C—24C

IMAGE FORMING APPARATUS

ARRANGEMENT OF GETTERS

SECTIONAL VIEW ALONG 25C—25C

IMAGE FORMING APPARATUS

ARRANGEMENT OF GETTERS

SECTIONAL VIEW ALONG 26C—26C

IMAGE FORMING APPARATUS

TOP OF IMAGE FORMING APPARATUS

IMAGE FORMING APPARATUS

TOP OF IMAGE FORMING APPARATUS

METHOD FOR GETTERING AN IMAGE DISPLAY APPARATUS

This application is a division of application Ser. No. 09/419,799, filed Oct. 18, 1999, now U.S. Pat. No. 6,396, 207.

BACKGROUND OF THE INVENTION

1. Field of the Invention

The present invention relates to an image display apparatus provided with an electron source, and a method for producing the same.

2. Related Background Art

In an apparatus for displaying an image by irradiating a fluorescent member, which is an image displaying member, with an electron beam from an electron source to cause the fluorescent member to emit light, it is necessary to maintain the interior of a vacuum chamber, containing the electron beam and the image displaying member, at a high vacuum. If the pressure in the vacuum chamber is elevated by gas generated therein, such gas detrimentally influences the electron source to lower the amount of electron emission, thereby disabling the display of a bright image, though the level of such influence depends on the kind of the gas. Also, such generated gas is ionized by the electron beam, and the generated ions are accelerated by the electric field and may collide with the electron source, causing damage thereto. A discharge may also be generated in the vacuum chamber, eventually leading to the destruction of the apparatus.

The vacuum chamber of the image display apparatus is usually formed by combining glass members and adhering the joints thereof with, for example, flit glass, and, once the adhesion is completed, the pressure in the vacuum chamber is maintained by a getter provided in the vacuum chamber. In the ordinary cathode ray tube, an alloy principally composed of barium is heated by an electric current or a high frequency radio wave in the vacuum chamber to form an evaporation film therein, and the high vacuum in the vacuum chamber is maintained by absorbing the gas generated therein by such evaporation film.

However, in the recently developed flat panel display utilizing the electron source consisting of a plurality of electron emitting elements provided on a flat substrate, a specific drawback is that the gas generated from the image displaying member reaches the electron source before reaching the getter, thereby inducing a local increase of the pressure and deterioration of the electron source resulting therefrom.

In order to resolve this drawback, in the flat panel image display of a certain structure, there is proposed a configuration of providing a getter in the image display area to immediately absorb the generated gas.

For example, Japanese Patent Application Laid-open No. 4-12436 discloses, in an electron source having a gate electrode for extracting the electron beam, a method of forming such a gate electrode with a getter material, and shows, as an example, an electron source of an electric field emission type utilizing a conical projection as the cathode and a semiconductor electron source having a pn junction. Also, Japanese Patent Application Laid-open No. 63-181248 discloses, in a flat panel display having an electrode (such as a grid) for controlling the electron beam between a group of cathodes and a face plate of the vacuum chamber, a method of forming a film of a getter material of such a controlling electrode.

Also, U.S. Pat. No. 5,453,659 "Anode plate for flat panel display having integrated getter", issued on Sep. 26, 1995 to Wallace et al., discloses a getter member formed in the gap between the striped fluorescent material on the image display member (anode plate). In this example, the getter is electrically isolated from the fluorescent member and the conductive member electrically connected thereto, and is activated by irradiation with the electron from the electron source while applying a suitable potential to the getter.

Also, Japanese Patent Application Laid-open No. 9-82245 discloses formation of the getter member at the side of the metal back or the electron source substrate. It also discloses activating the getter by providing an exclusive heater wiring and activating such heater, or irradiating the getter with the electron beam.

However, in the above-described image display apparatus, although the deterioration of the electron source caused by the gas generated in the vacuum chamber can be prevented to a certain extent by positioning a larger number of getter members in the vacuum chamber, it is difficult to efficiently absorb such generated gas. This difficulty results in the deterioration of the electron source over time or unevenness in the luminance of the displayed image, unless certain particular consideration is given to the positioning of such getter members.

SUMMARY OF THE INVENTION

An object of the present invention is to provide an image display apparatus with little deterioration of the electron emitting characteristics of the electron source over time, and a method for producing the same.

Another object of the present invention is to provide an image display apparatus with little change of the luminance over time, and a method for producing the same.

Still another object of the present invention is to provide an image display apparatus with little generation of unevenness in the image display area over time, and a method for producing the same.

The above-mentioned objects can be attained, according to the present invention, by an image display apparatus provided with an external housing composed of members including, in the external housing, a first substrate and a second substrate positioned with a gap therebetween, an electron source provided on the first substrate, and a fluorescent film and an accelerating electrode provided on the second substrate, the apparatus comprising:

- a first getter positioned in the image display area in the external housing; and
- a second getter insulated from the electron source and the accelerating electrode and so positioned as to surround the first getter.

DETAILED DESCRIPTION OF THE PREFERRED EMBODIMENTS

Figure 1A:
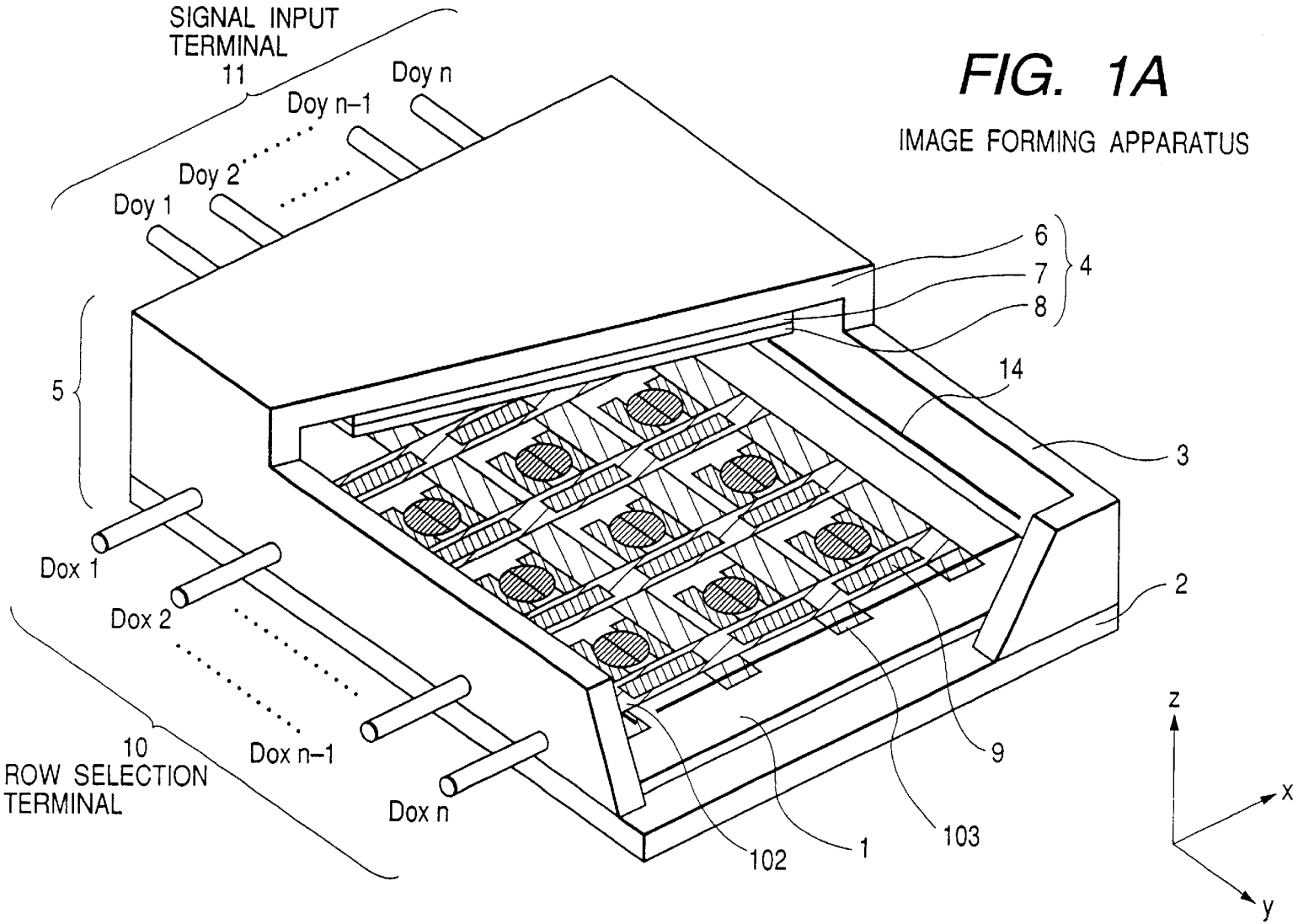
FIGS. 1A, 1B and 1C are schematic views showing the configuration of an image display apparatus constituting a first embodiment of the present invention.

In the present invention, the image display area in which the first getter is provided represents any area of the second substrate where the fluorescent film is formed, an area of the first substrate opposed to the above-mentioned area of the fluorescent film, and a spatial area sandwiched between these areas.

Also, in the present invention, the second getter is positioned to surround the first getter around the area where the first getter is provided on both sides of such area, or to surround the area where the first getter is provided, or around the above-mentioned image display area so as to be on both sides of such area, or around the above-mentioned image display area so as to surround such area, and, in any case, the second getter is electrically insulated from the electron source on the first substrate and the accelerating electrode on the second substrate.

In the present invention, the above-mentioned arrangement of the first and second getters allows the gas, generated from members constituting the external housing itself or members positioned outside the above-mentioned image display area among those provided therein, to be promptly absorbed by the second getter positioned to surround the first getter before reaching the first getter provided in the image display area, whereby the load on of the first getter positioned in the image display area can be reduced. Consequently, when the electron source is activated, more of the gas generated in the image display area can be efficiently absorbed by the first getter, whereby the vacuum in the external housing can be maintained in a satisfactory state and the electron emission amount from the electron emitting elements can be stabilized over time.

Also, in the present invention, the first getter provided in the above-mentioned image display area is preferably provided on the wiring for the electron source. The wiring is preferably a printed wiring formed by a printing method in order to increase the absorption rate and the total absorption amount of the getter and to prevent discharge while the electron emitting elements are driven.

Also, in the present invention, the getters are provided on the first or second substrate prior to an adhesion step for adhering plural member constituting the external housing and such getters are activated prior to the completion of the above-mentioned adhesion step, whereby the gas generated from the adhesive during the sealing step can be absorbed by the getters to minimize the deterioration of the electron emitting characteristics of the electron source by the above-mentioned generated gas. Also, until the end of the sealing step, among the getters, the second getter provided so as to surround the first getter is particularly activated to minimize the deterioration of the absorbing ability of the first getter by the above-mentioned generated gas, whereby, when the electron source is driven, more of the gas generated in the image display area can be efficiently absorbed by the first getter, to maintain the vacuum in the external housing in a satisfactory state and to stabilize the electron emission amount from the electron emitting elements over time. In the present invention, it is preferable to activate the getters again after the sealing step so that the getters provided in the external housing have a sufficient absorbing ability for the gas generated when the electron source is driven.

The basic configuration in which the present invention is applicable will be explained in the following by certain preferred embodiments.

Figure 1B:
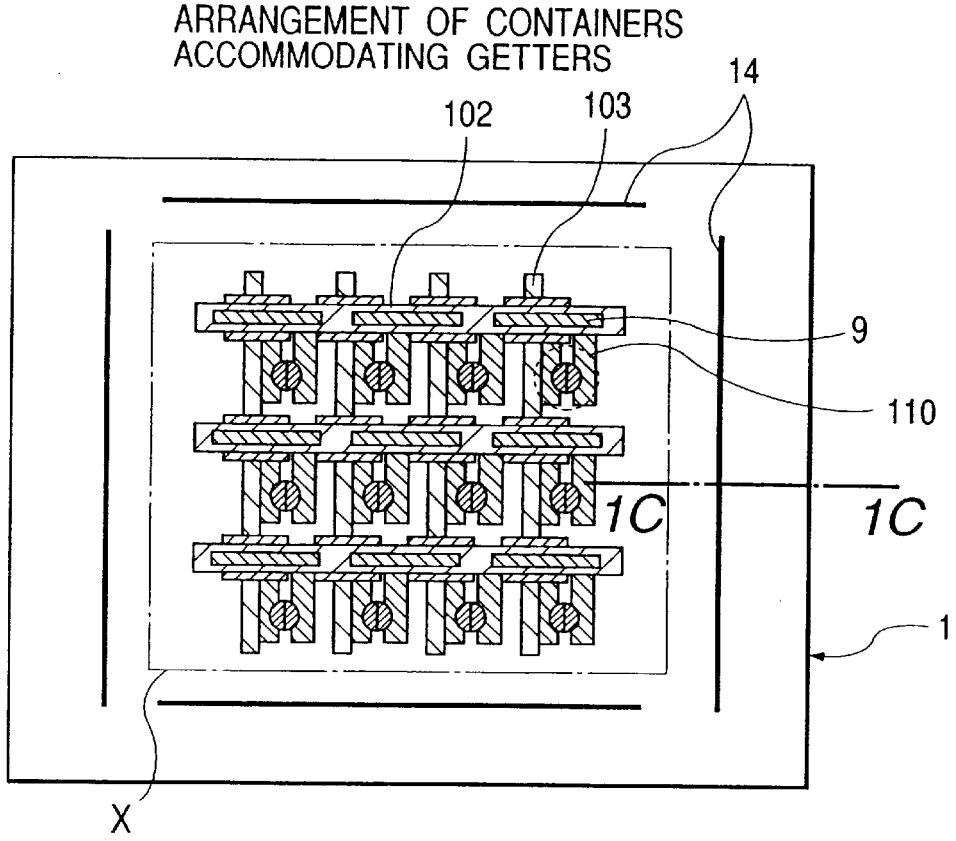
Figure 1C:
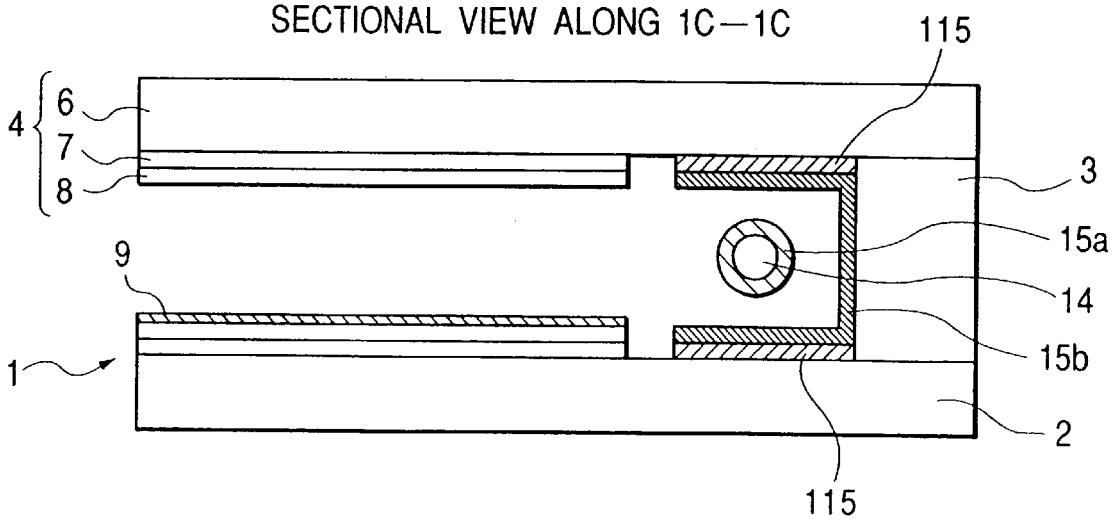
Figure 2A:
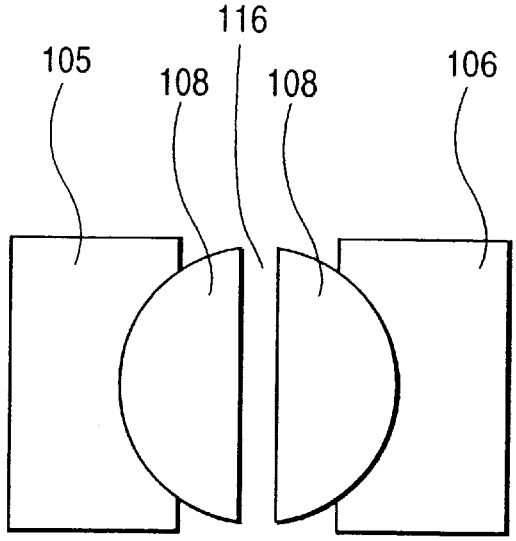
FIGS. 2A and 2B are schematic views showing a surface conduction type electron emitting element.
Figure 2B:
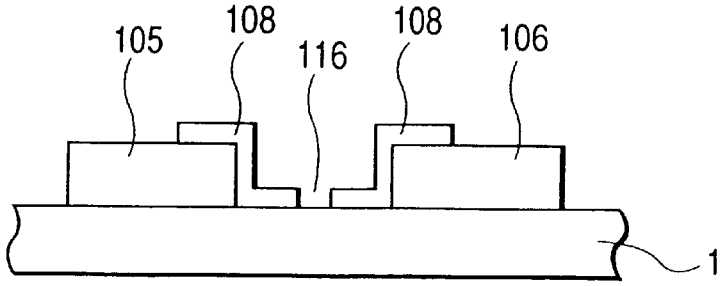

FIGS. 1A to 1C are schematic views of a first embodiment of the image display apparatus of the present invention, wherein an electron source substrate 1 bears an electron source consisting of plural electron emitting elements 110, wired in a matrix by plural row wirings (upper wirings) 102 and plural column wirings (lower wirings) 103. The electron emitting element 110 is provided with a pair of electrodes and a conductive film positioned between the paired electrodes and having an electron emitting portion. In the present embodiment, there is employed, as shown in FIGS. 2A and 2B, a surface conduction type electron emitting element provided with a pair of conductive films 108 formed with a gap 116 therebetween and a pair of electrodes 105, 106 electrically connected, respectively, to the paired conductive films 108. FIG. 2A is a plan view of this configuration, while FIG. 2B is a cross-sectional view of this configuration. The surface conductive electron emitting element shown in FIGS. 2A and 2B preferably has a configuration having a carbon film on the conductive films 108.

In FIGS. 1A to 1C, there are also shown a rear plate 2, on which the electron source substrate 1 is fixed, a supporting frame 3, and a face plate 4, which are mutually adhered with, for example, frit glass to constitute an external housing 5.

In the external housing 5, there are provided a non-evaporating getter (NEG) 9 as the first getter, and a container 14 supporting a second getter.

The fact plate 4 is provided, on a transparent substrate 6 made of, for example, glass, with a fluorescent film 7 and a metal back 8. In case of a black-and-white image, the fluorescent film 7 is composed solely of a fluorescent substance, but, in case of displaying a color image, each pixel has fluorescent substances of three primary colors: red, green and blue, which are mutually separated by a black conductive material. The black conductive material is called, depending on the shape thereof, a black stripe or a black matrix, as will be explained in more details below.

The metal back 8 is composed of a thin conductive film such as aluminum. It serves to reflect a light component proceeding toward the electron source substrate 1, among the light generated by the fluorescent member, toward the transparent substrate 6 of the face plate 4, thereby increasing the luminance. It also serves to protect the fluorescent member from the damage caused by ions generated by ionization with the electron beam of the gas remaining in the external housing. In addition, it serves to provide the image display area of the face plate 4 with electroconductivity, thereby functioning as an anode for the electron source.

Figure 3A:
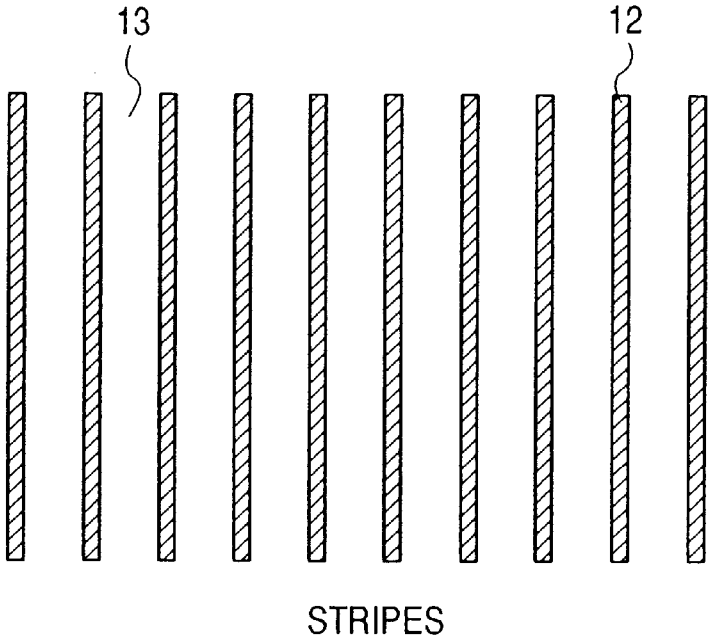
FIGS. 3A and 3B are views showing the pattern of arrangement of fluorescent members and a black conductive material.
Figure 3B:
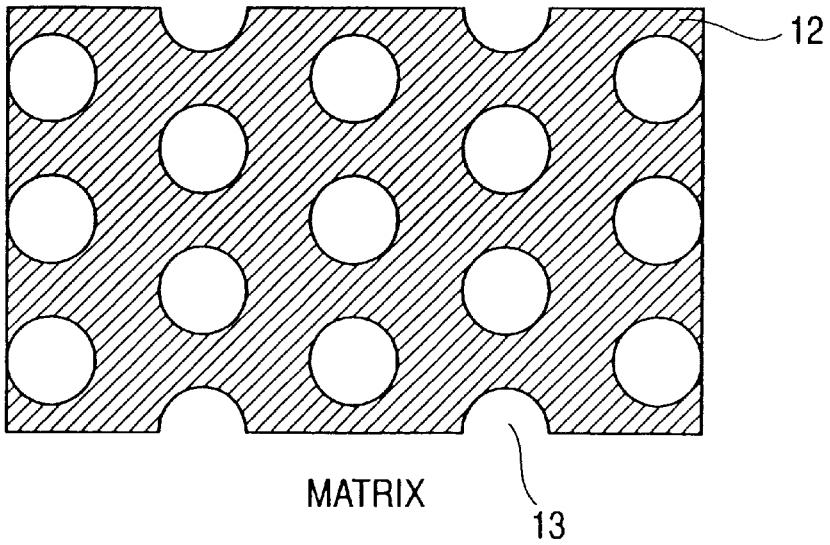

In the following, there will be given an explanation of the fluorescent film 7. FIG. 3A shows a case where the fluorescent material 13 is formed in stripes in succession of three primary colors (red (R), green (G) and blue (B)), which are mutually separated by a black conductive material 12 constituting a black member. In such a configuration, a portion of the black conductive material 12 is called a black stripe. FIG. 3B shows a configuration in which dots of the fluorescent material are arranged in a lattice pattern, and are mutually separated by the black conductive material 12. In this case, the portion of the black conductive material 12 is called a black matrix. The arrangement of the fluorescent materials 13 of different colors can vary. The arrangement of the dots can be, for example, a square lattice, in addition to the triangular lattice shown in FIG. 3B.

The black conductive material 12 and the fluorescent member 13 can be patterned on the transparent substrate 6 by, for example, the slurry method or the printing method. After the fluorescent film 7 is formed, a metal film such as an aluminum film is formed to constitute the metal back 8.

Figure 4A:
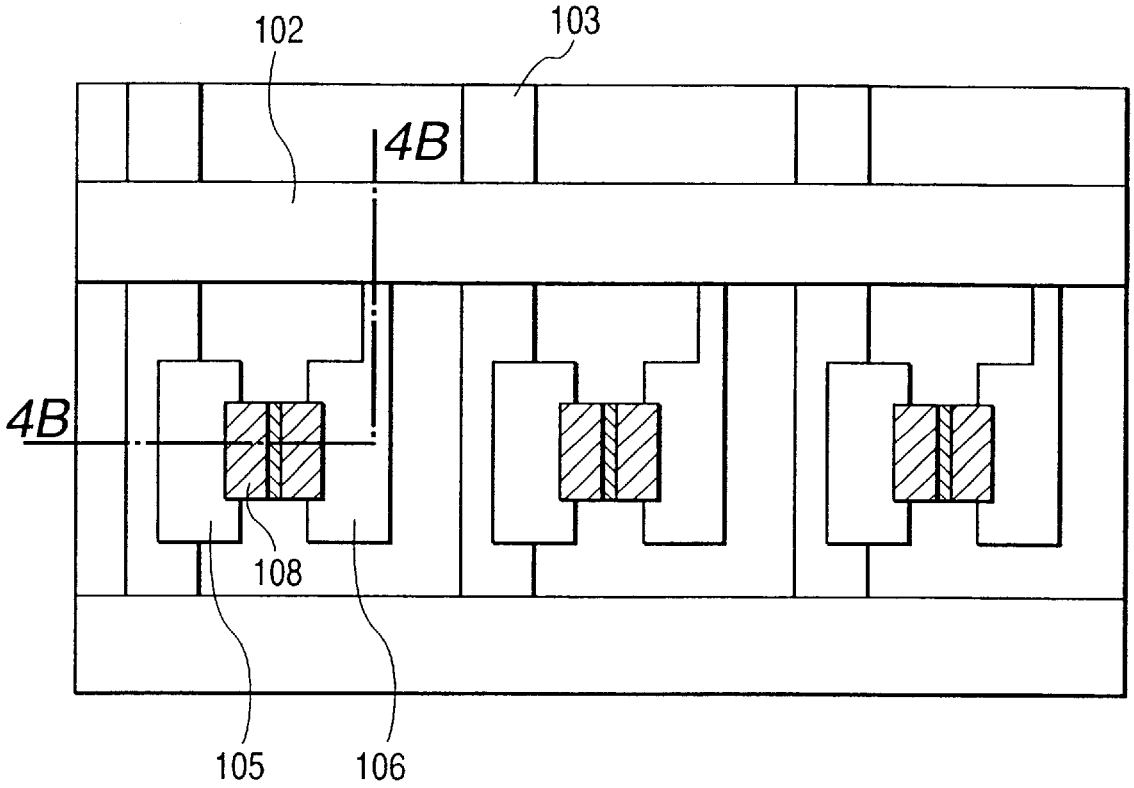
FIGS. 4A and 4B are schematic views showing an example of the electron source formed by arranging the surface conduction type electron emitting elements of the present invention in a simple matrix.
Figure 4B:
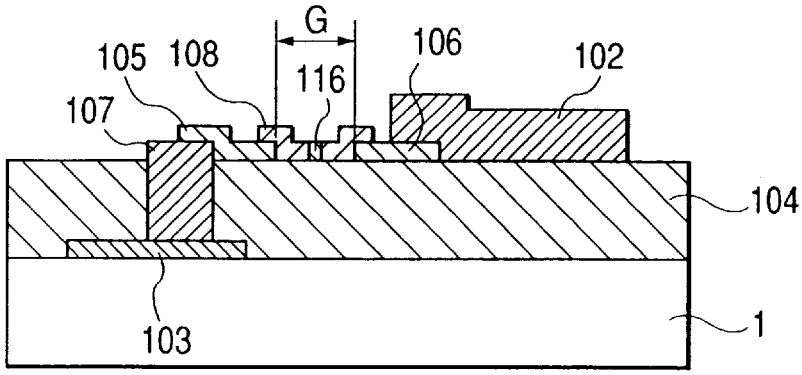

FIGS. 4A and 4B are schematic views showing a part of the electron source comprised of the surface conduction electron emitting elements arranged two-dimensionally and connected by the matrix wirings. FIG. 4A is a plan view, while FIG. 4B is a cross-sectional view along a line 4B—4B in FIG. 4A.

There are shown an insulating substrate 1 such as the one made of glass, row wirings (upper wirings) 102, and column wirings (lower wirings) 103. The row wirings 102 and the column wirings 103 are respectively connected to the electrodes 106, 105 of each surface conduction electron emitting element.

The column wirings 103 are formed on the substrate 1, and an insulation layer 104 is formed thereon. Then, the row wirings 102, the element electrodes 105, 106 and the conductive films 108 are formed thereon, and the column wiring 103 and the element electrode 105 are connected through a contact hole 107.

The wirings mentioned above can be formed by the combination of the thin film deposition method such as sputtering, vacuum evaporation or plating and the photolithographic technology, or by the printing method.

In the present embodiment, a non-evaporating getter 9 constituting the first getter is provided on the row wiring 102 within an area (image display area x) of the substrate 1, opposite the area of the above-mentioned fluorescent film 7.

In the present embodiment, the non-evaporating getter 9 may be provided, instead of the row wiring 102, on the column wiring 103 in the image display area x, or in the area of the metal back 8 corresponding to the area of the fluorescent film 7 on the face plate 4, or in the area corresponding to the area of the black conductive material 12 on the metal back 8. The non-evaporating getter 9 may be provided in one or many of the locations mentioned above. The non-evaporating getter 9 is preferably provided in uniform distribution over the entire image display area.

The non-evaporating getter can be composed of at least one of the metals Ti, Zr, Cr, Al, V, Nb, Ta, W, Mo, Th, Ni, Fe and Mn or an alloy thereof and can be produced by vacuum evaporation or sputtering with a suitable mask.

Also, in the present embodiment, a container 14 supporting a getter 15*a* as the second getter is supported in a hollow state in a position outside the image display area and around the non-evaporating getter 9, which is the first getter, so as to surround the same. The container 14 can have a linear form or an annular form, and the getter 15*a* supported therein can be composed of the non-evaporating getter material mentioned above or of an evaporating getter material principally composed of Ba. The effects of the present embodiment, which are explained below, can also be attained in case the second getter mentioned above is positioned outside and on both sides of the image display area. However, the second getter is preferably provided outside the image display area so as to surround the first getter as shown in FIGS. 1A and 1B, because the effect of the second getter is greater in such a configuration.

A rear plate 2 supporting the substrate 1, a supporting frame 3 and the face plate 4 are mutually adhered by attaching frit glass on the jointing portions and heating the members to a temperature of 400° C. to 450° C. In practice, in order to eliminate a component contained as the binder in the frit glass, there is executed a sintering step at a low temperature (called pre-firing) in an oxygen-containing atmosphere. In this step, it is desirable to lower the oxygen concentration and the temperature as far as possible. The actual conditions are dependent on the type of the frit, but preferably, the temperature does not exceed 250° C. Thereafter, heating is conducted at 400° C. to 450° C. in inert gas such as Ar, thereby jointing the members by fusion (sealing step).

Subsequently, the interior of the external housing 5 is evacuated (vacuum formation step), and necessary processes such as the activation of the electron source on the substrate 1 (electron source activation step) are performed. Then, the evacuation and thermal degassing of the interior of the external housing 5 (backing step) are performed to secure a sufficient vacuum in the interior of the external housing 5, and an unrepresented evacuation tube, provided on the external housing, is sealed off with a burner (sealing step). The above-mentioned backing step results in the activation of the non-evaporating first getter 9.

Then, the activation of the second getter is carried out. In case the getter 15*a* (represented as a wire in FIGS. 1A and 1B) supported in the container 14 provided in the external housing 5 is a non-evaporating getter, it is activated together with the first getter in the foregoing baking step. In case it is an evaporating getter such as the one made of Ba, the getter 15*a* is heated after the sealing step to form a film of the getter material by evaporating onto the internal wall of the external housing 5 (called getter flushing). The getter film 15*b* formed in this operation (cf. FIG. 1C) is formed across the insulation layer 101 outside the image display area of the external housing 5 and is insulated from the electron source on the substrate 1 and from the metal back 8, which is the electron accelerating electrode.

Finally, if necessary, the non-evaporating getter 9 and the getter 15*a*, if it is of the non-evaporating type, are subjected to a heat treatment at 250° C. to 450° C. for reactivation.

In thus prepared image display apparatus, the gas generated from the members constituting the external housing itself and those provided therein but positioned outside the image display area can be promptly absorbed by the line-shaped second getter positioned outside the image display area and around the first getter before reaching and being absorbed by the first getter. Thus, the load on the first getter provided in the image display area can be reduced. Consequently, more of the gas generated in the image display area when the electron source is driven can be efficiently and promptly absorbed by the first getter, whereby the internal vacuum of the external housing can be maintained at a satisfactory level and the electron emission amount from the electron emitting elements is stabilized over time.

Figure 5A:
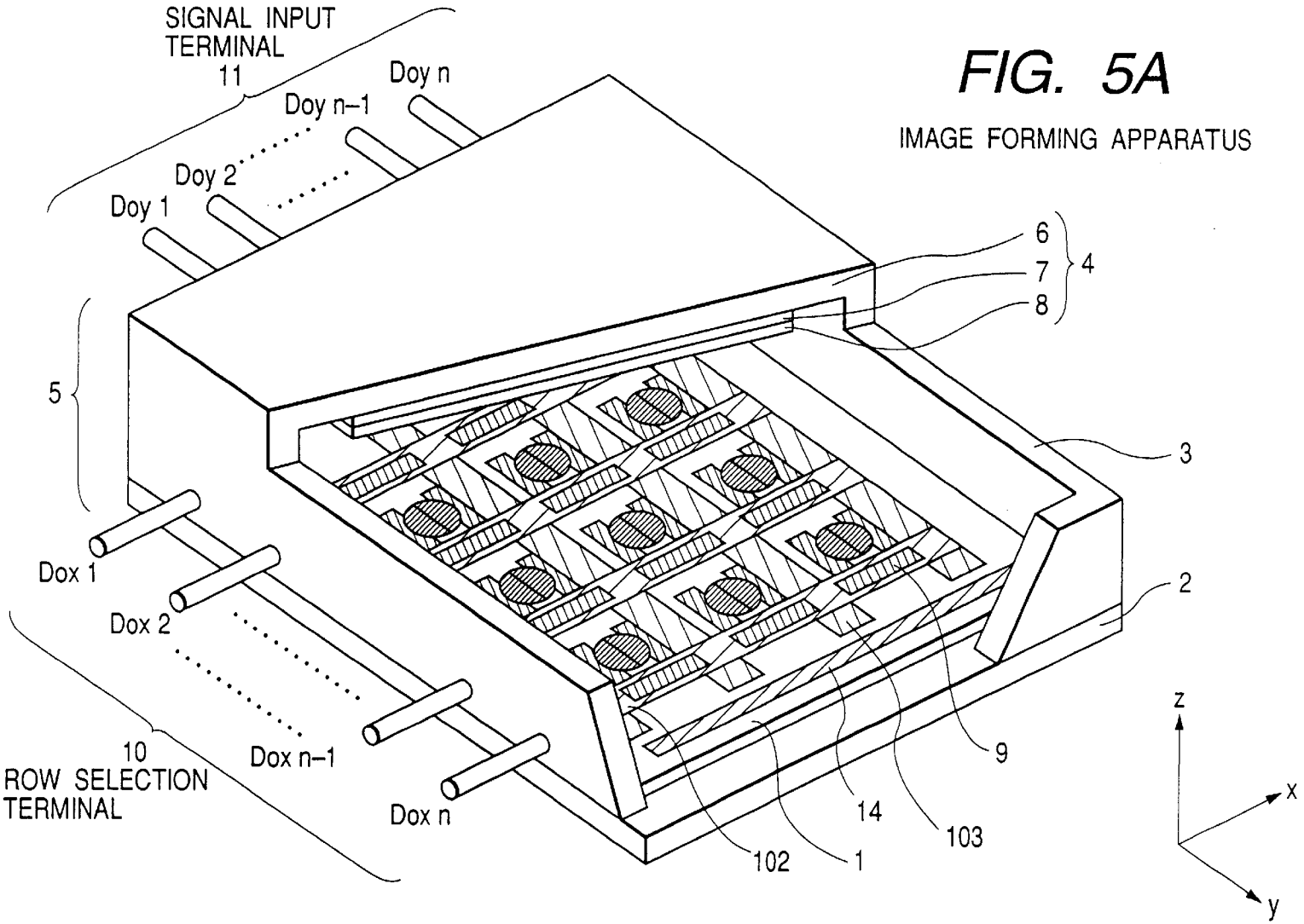
FIGS. 5A, 5B and 5C are schematic views showing the configuration of an image display apparatus constituting a second embodiment of the present invention.
Figure 5B:
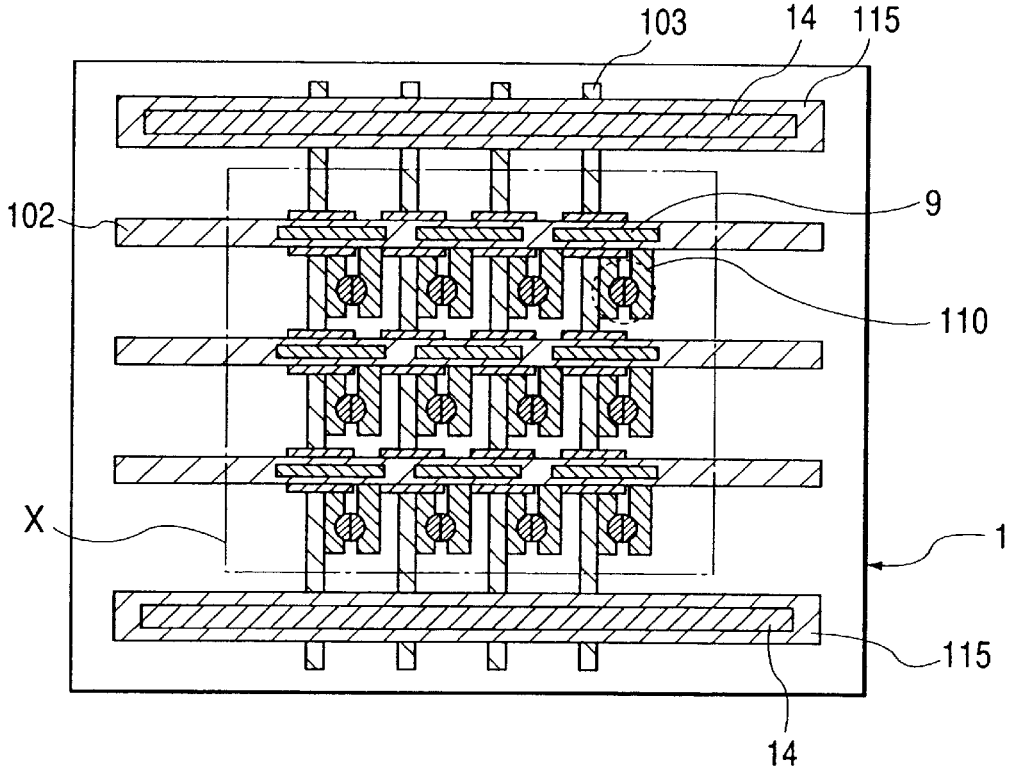
Figure 5C:
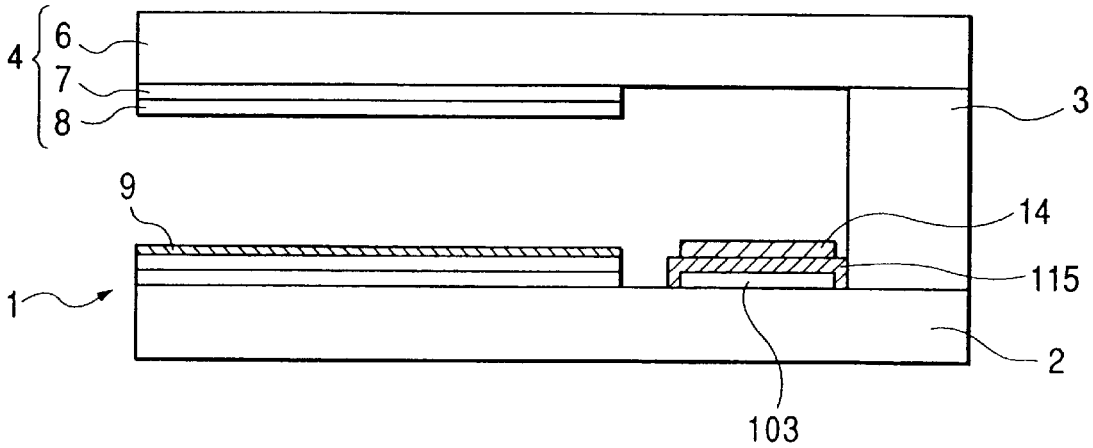

FIGS. 5A to 5C schematically show a second embodiment of the image display apparatus of the present invention. An electron source substrate 1 is provided with an electron source, consisting of plural electron emitting elements 110, which are matrix wired with plural row wirings (upper wirings) 102 and plural column wirings (lower wirings) 103. The electron emitting element 110 is of the surface conduction type described in the first embodiment.

Referring to FIGS. 5A to 5C, a rear plate 2, a supporting frame 3, and a face plate 4 are mutually adhered with, for example, frit glass to constitute an external housing 5.

In the external housing 5, there are provided a non-evaporating first getter (NEG) 9, and a second getter 14, which is also of the non-evaporating type.

The face plate 4 is provided, on a transparent substrate 6 made of, for example, glass, with a fluorescent film 7 and a metal back 8, and can be same as that in the first embodiment.

Also, in the present embodiment, the electron source consisting of the surface conduction electron emitting elements arranged two-dimensionally and connected in a matrix is similar to that in the first embodiment schematically illustrated in FIGS. 4A and 4B.

Also, in the present embodiment, a non-evaporating getter 9, which is the first getter, is provided on the row wiring 102 within an area (image display area x) of the substrate 1, opposite the area of the above-mentioned fluorescent film 7.

Also, in the present embodiment, the non-evaporating getter 9 may be provided, instead of the row wiring 102, on the column wiring 103 in the image display area x, or in the area of the metal back 8 corresponding to the area of the fluorescent film 7 on the face plate 4, or in the area corresponding to the area of the black conductive material 12 on the metal back 8, and may be provided in one or many of the locations mentioned above. The non-evaporating getter 9 is preferably provided in a uniform distribution over the entire image display area.

Also, in the present embodiment, a second getter is provided outside the image display area.

In the present embodiment, the second getter is a non-evaporating getter 14, and is positioned on the substrate 1 across an insulating member 115, outside the image display area to be on both sides of the non-evaporating first getter 9. The non-evaporating second getter 14 may also be provided on the electron source substrate 1, or on the rear plate 2 fixing the electron source substrate 1, or around the first getter to be on both sides thereof or to surround the same, as long as it is insulated from the metal back 8, which is the electron accelerating electrode, or from the electron source on the substrate 1. As explained in the first embodiment, the second getter is preferably positioned outside the image display area surrounding the first getter, because the effects of the present embodiment, which are explained below, become more conspicuous.

The first and second getters explained above can be similar to those described in the first embodiment and are prepared by similar methods to those in the first embodiment.

A rear plate 2 supporting the substrate 1, a supporting frame 3 and the face plate 4 are mutually adhered by attaching frit glass on the jointing portions and heating the members to a temperature of 400° C. to 450° C. In practice, in order to eliminate a component contained as the binder in the frit glass, there is executed a sintering step at a low temperature (called pre-firing) in an oxygen-containing atmosphere. In this step, it is desirable to lower the oxygen concentration and the temperature as far as possible. The actual conditions depend on the frit type but, preferably, the temperature does not exceed 250° C. Thereafter heating is conducted at 400° C. to 450° C. in an inert gas such as Ar, thereby jointing the members by fusion (sealing step). Before the sealing step is completed, an activation step for the non-evaporating getter 14 outside the image display area is performed. This activation step is to cause the non-evaporating getter 14 outside the image display area to absorb the gas generated from the frit in the above-mentioned sealing step, thereby preventing the deterioration in the electron emitting characteristics of the electron source in the image display area and the deterioration of the non-evaporating getter. In the present embodiment, the non-evaporating getter is activated by irradiation with a laser beam.

Subsequently, the interior of the external housing 5 is evacuated (vacuum formation step), and necessary processes such as the activation of the electron source on the substrate 1 (electron source activation step) are performed. Then, the evacuation and thermal degassing of the interior of the external housing 5 (backing step) is performed to secure sufficient vacuum in the interior of the external housing 5, and an unrepresented evacuation tube, provided on the external housing, is sealed off with a burner (sealing step).

Finally, if necessary, the getters are activated. The non-evaporating getters 9, 14 are subjected to a heat treatment preferably at 250° C. to 450° C., more preferably at 300° C. to 400° C. Since the getters are composed solely of the non-evaporating getters, the activation can be achieved by a thermal treatment with a satisfactory yield, without requiring the step of incorporating the evaporating getter and the getter flushing step.

In thus prepared image display apparatus, the gas generated from the members constituting the external housing itself and those provided therein but positioned outside the image display area can be promptly absorbed, before reaching and being absorbed by the first getter in the image display area, by the line-shaped second getter positioned outside the image display area and on at least two sides of the first getter, easing the load on the first getter provided in the image display area. Consequently, more of the gas generated in the image display area when the electron source is driven can be efficiently and promptly absorbed by the first getter, whereby the internal vacuum of the external housing can be maintained at a satisfactory level and the electron emission amount from the electron emitting elements is stabilized over time. The second getter in the present embodiment is preferably a line-shaped getter surrounding four sides of the first getter as explained in the foregoing first embodiment, in consideration of the aforementioned effects.

Figure 6A:
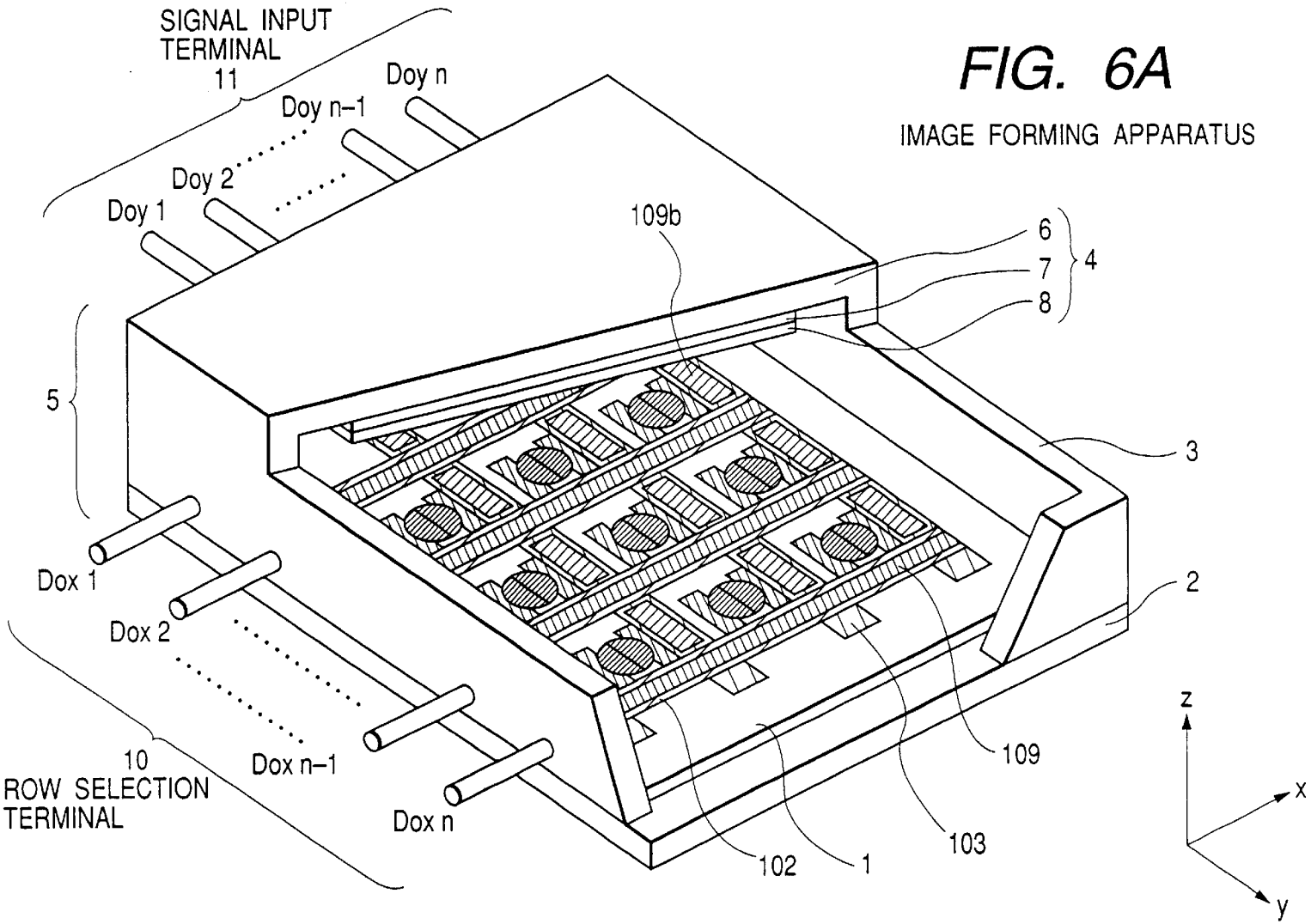
FIGS. 6A and 6B are schematic views showing the configuration of an image display apparatus constituting a third embodiment of the present invention.
Figure 6B:
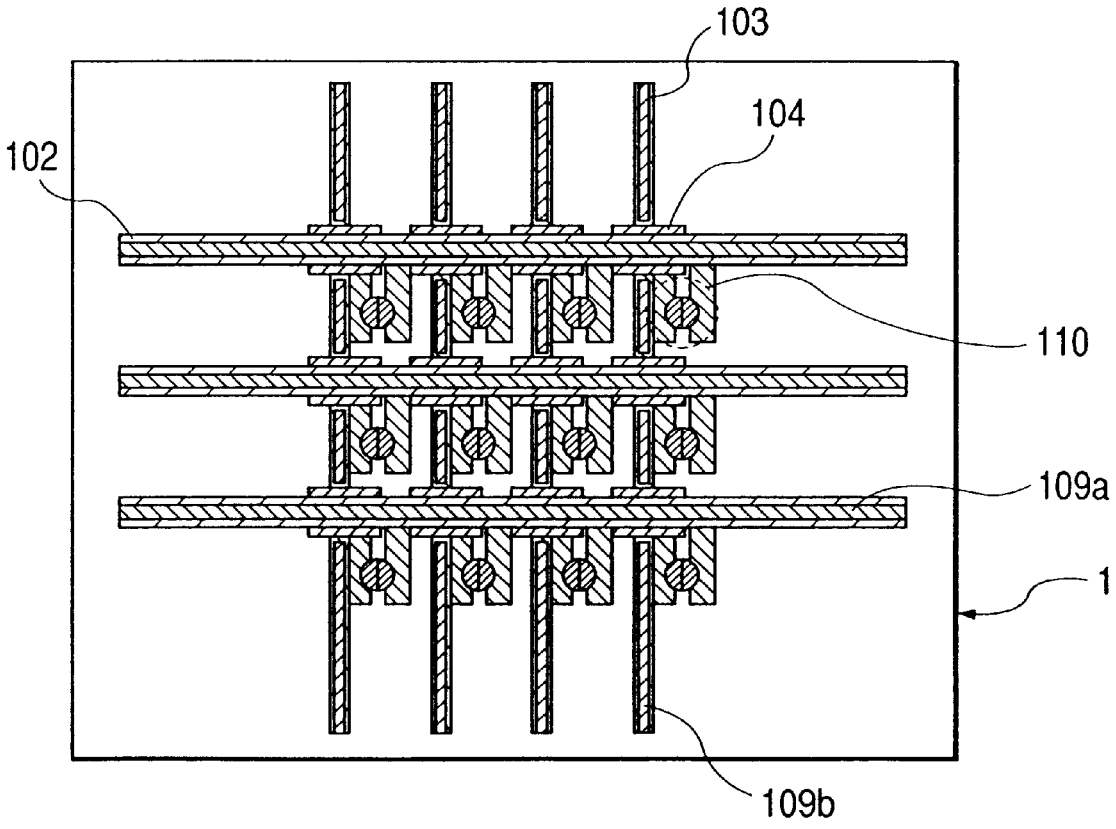

FIGS. 6A and 6B are schematic views showing a third embodiment of the image display apparatus of the present invention. An electron source substrate 1 is provided with an electron source, consisting of plural electron emitting elements 110, which are matrix wired with plural row wirings (upper wirings) 102 and plural column wirings (lower wirings) 103. The electron emitting element 110 is of the surface conduction type described in the first and second embodiments.

Referring to FIGS. 6A to 6C, a rear plate 2, a supporting frame 3, and a face plate 4 are mutually adhered with, for example, frit glass to constitute an external housing 5.

In the external housing 5, there are provided non-evaporating getters (NEG) 109*a*, 109*b*.

The face plate 4 is provided, on a transparent substrate 6 made of, for example, glass, with a fluorescent film 7 and a metal back 8, and can be the same as that in the first embodiment.

Figure 7:
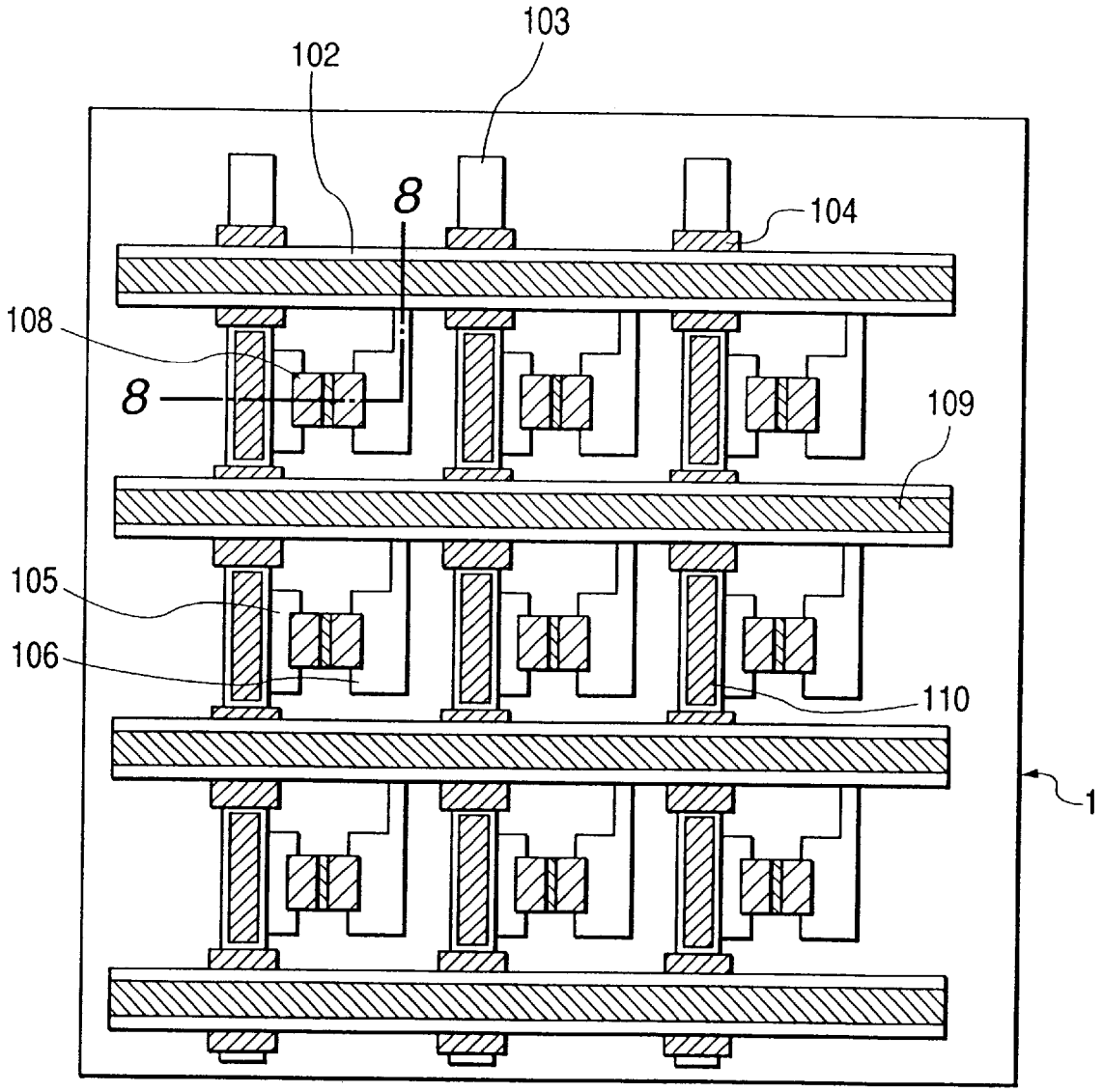
FIG. 7 is a schematic view showing another example of the electron source formed by arranging the surface conduction type electron emitting elements of the present invention in a simple matrix.
Figure 8:
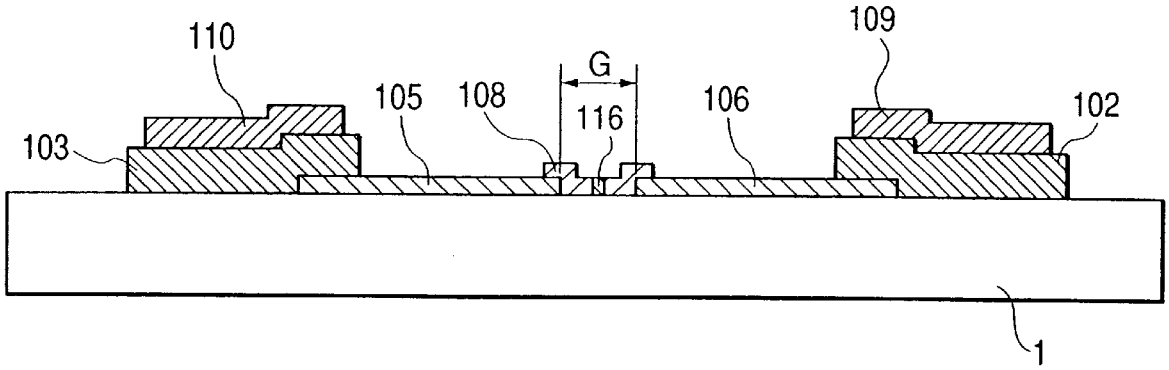
FIG. 8 is a cross-sectional view along a line 8—8 in FIG. 7.

FIGS. 7 and 8 are schematic views showing a part of the electron source substrate 1 of the present embodiment, which is comprised by the surface conduction electron emitting elements arranged two-dimensionally and connected by the matrix wirings. FIG. 7 is a plan view, while FIG. 8 is a cross-sectional view along a line 8—8, in FIG. 7.

An insulating substrate 1 such as the one made of glass, row wirings (upper wirings) 102, and column wirings (lower wirings) 103 are shown. The row wirings 102 and the column wirings 103 are respectively connected to the electrodes 106, 105 of each surface conduction electron emitting element.

At the crossing point of the column wiring 103 and the row wiring 102, an insulation layer 104 is formed on the column wiring 103 and the row wiring 102 is formed thereon.

The row wirings 102 and the column wirings 103 can be formed by the printing method such as offset printing or screen printing. The element electrodes 105, 106 and the conductive films 108 can be formed by the combination of the photolithographic process and the vacuum evaporation, by plating, printing or by dissolving a metal in a solvent and then depositing and firing the obtained solution.

The non-evaporating getters (NEG) 109*a*, 109*b* are formed on the wirings on the electron source substrate 1. In the present embodiment, the non-evaporating getters are formed on both or either of the row wirings 102 and the column wirings 103. In such a case, the getters are preferably formed on the scanning wirings in the simple matrix drive. This is because, in the simple matrix drive, a larger current capacity is desired in the scanning wirings rather than in the signal wirings, so that the scanning wirings are formed with a larger width to increase the area of the non-evaporating getters. The non-evaporating getters are preferably provided in a uniform distribution over the entire image display area.

Also, in the present embodiment, as in the foregoing first and second embodiments, the second getter is provided outside the image display area in order to attain the effects explained in the foregoing first and second embodiments.

The above-mentioned non-evaporating getters to be formed on the wirings can be composed of materials similar to those in the foregoing first embodiment, using a similar method of preparation.

In the present embodiment, the wiring is formed by the printing method as described above, and therefore has a surface irregularity larger than that of the evaporated or sputtered film. Consequently the non-evaporating getter formed thereon has a larger surface area, thus increasing the absorption rate and the total absorption amount. Such surface irregularity also improves the adhesion of the non-evaporating getter, thus preventing the dropping of the non-evaporating getter to the vicinity of the electron emitting element, constituting a cause of discharge while the electron emitting element is driven.

Consequently, a wiring with a relatively large surface irregularity is preferred. Also effective is a process of intentionally forming the irregularity by, for example, sand blasting after the wiring is formed by printing. Also, with respect to the manufacture, the printing method is less expensive in comparison with the photolithographic process in combination with the vacuum evaporation, and can be more easily adaptable to a large-sized substrate.

The rear plate 2 supporting the substrate 1, the supporting frame 3 and the face plate 4 are mutually adhered by attaching frit glass on the jointing portions and heating the members to a temperature of 400° C. to 450° C. In practice, in order to eliminate a component contained as the binder in the frit glass, a sintering step at a low temperature (called pre-firing) is executed in an oxygen-containing atmosphere. In this step, it is desirable to lower the oxygen concentration and the temperature as far as possible. The actual conditions are dependent on the frit type but preferably, the temperature does not exceed 250° C. Thereafter, heating is conducted at 400° C. to 450° C. in an inert gas such as Ar, thereby joining the members by fusion (sealing step).

Subsequently, the interior of the external housing 5 is evacuated (vacuum formation step), and necessary processes such as the activation of the electron source on the substrate 1 (electron source activation step) are performed. Then, the evacuation and thermal degassing of the interior of the external housing 5 (backing step) are executed to secure a sufficient vacuum in the interior of the external housing 50. An unrepresented evacuation tube, provided on the external housing, is sealed off with a burner (sealing step). Then, an activation step for the getters is performed, preferably by heating the non-evaporating getters 109*a*, 109*b* at 250° C. to 450° C. The non-evaporating getters 109*a*, 109*b* may be activated at least once after the sealing step, which may be achieved in the above-mentioned backing step.

Figure 9:
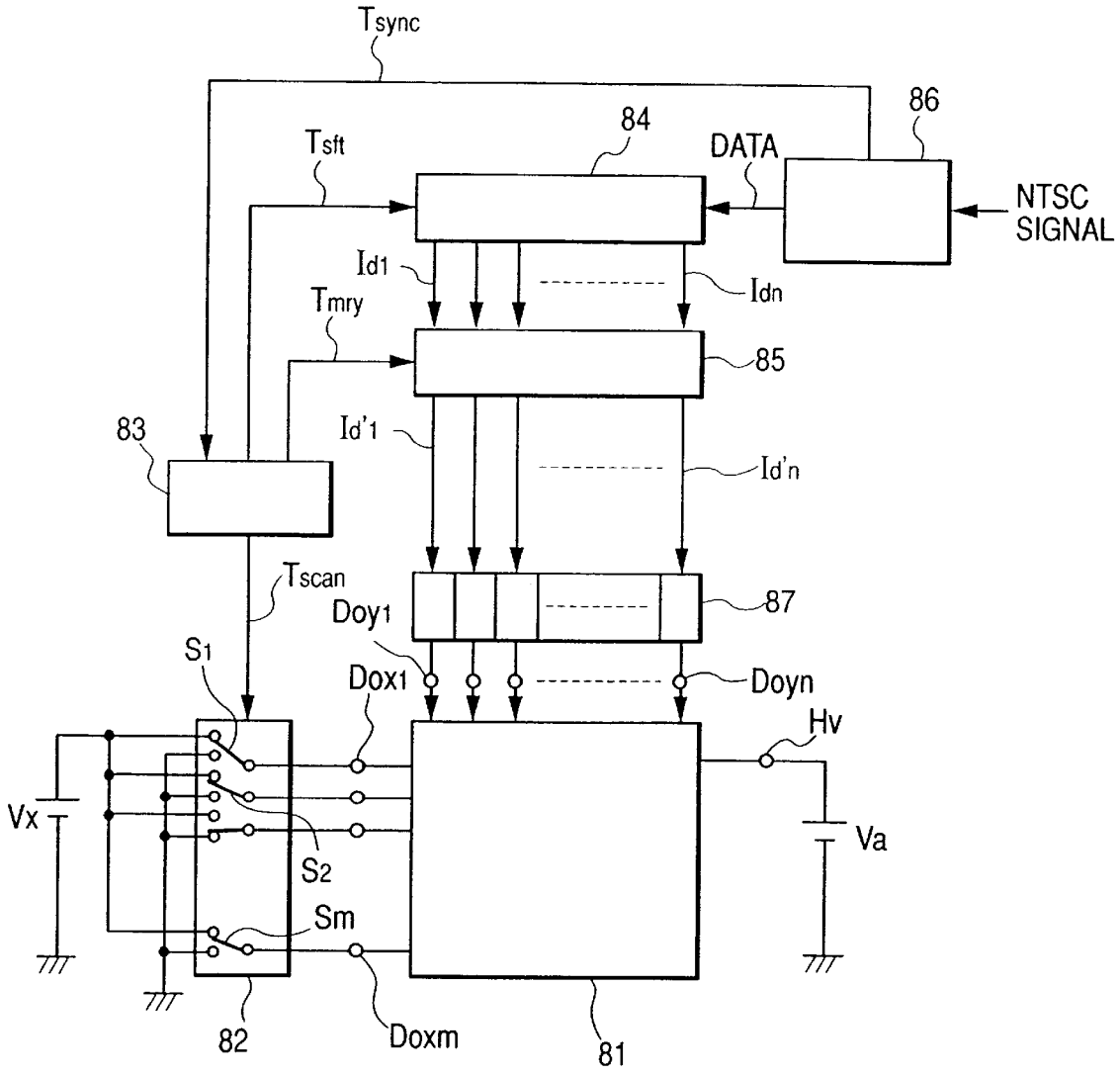
FIG. 9 is a block diagram showing an example of the drawing circuit for executing a display on the image display apparatus of the present invention, according to a television signal of the NTSC standard.

In the following, there will be explained, with reference to FIG. 9, an example of the configuration of the driving circuit for television display based on the NTSC television signal, utilizing the above-described image display apparatus. In FIG. 9, there are shown an image display apparatus 81, a scanning circuit 82, a control circuit 83, a shift register 84, a line memory 85, a synchronization signal separation circuit 86, a modulation signal generator 87, and DC voltage sources Vx, Va.

The image display apparatus 81 is connected with external circuits through terminals Dox1 to Doxm, Doy1 to Doyn and a high voltage terminal Hv.

The terminals Dox1 to Doxm receive a scanning signal for driving the electron source provided in the image display apparatus 81, namely the surface conduction electron emitting elements connected in a matrix of m row and n columns, in succession by a row (consisting of n elements).

The terminals Doy1 to Doyn receive modulation signals for controlling the output electron beams of the surface conduction electron emitting elements of a row selected by the above-mentioned scanning signal.

The high voltage terminal Hv receives, from a DC high voltage source Va, a DC voltage of, for example, 10 kV as the accelerating voltage for providing the electron beam, emitted from the surface conduction electron emitting element, with a sufficient energy for exciting the fluorescent member.

The scanning circuit 82 is provided therein with m switching elements (schematically represented by S1 to Sm), each of which selects the output voltage of a DC voltage source Vx or 0 V (ground level) and which are electrically connected respectively with the terminals Dox1 to Doxm of the image display apparatus 81. The switching elements S1 to Sm function based on control signals Tscan released from the control circuit 83 and can be composed by the combination of switching elements such as FET's.

The DC voltage source Vx in the present embodiment is designed to output such a constant voltage, that the driving voltage applied to an element not in the scanning operation becomes lower than the electron emitting threshold voltage.

The control circuit 83 functions to match the operations of various units in order to execute a suitable display based on the externally entered image signal. It generates control signals Tscan, Tsft and Tmry based on a synchronization signal Tsync supplied from the sync signal separation circuit 86.

The sync signal separation circuit 86 serves to separate a synchronization signal component and a luminance signal component from the externally entered NTSC television signal and can be composed of, for example, general frequency separation (filter) circuits. The synchronization signal separated by the sync signal separation circuit 86 is composed of a vertical synchronization signal and a horizontal synchronization signal, but is illustrated as the Tsync signal for the purpose of brevity. The luminance signal component separated from the television signal is represented as a signal DATA for the purpose of simplicity. The DATA signal is entered into the shift register 84.

The shift register 84 is used for executing serial/parallel conversion on the time-sequentially entered serial DATA signal for each line of the image, and functions according to the control signal Tsft supplied from the control circuit 83. Thus, the control signal Tsft can be regarded as the shift clock signal for the shift register 84. The serial/parallel converted data of a line of the image (corresponding to the driving data for the n electron emitting elements) are outputted as parallel signals Id1 to Idn from the shift register 84.

The line memory 85 serves to store the data of a line of the image for a necessary time and suitably stores the signals Id1 to Idn according to the control signal Tmry supplied from the control circuit 83. The stored content is outputted as Id'1 to Id'n and supplied to the modulation signal generator 87.

The modulation signal generator 87 is a signal source for appropriately modulating the electron emitting elements respectively corresponding to the image data Id'1 to Id'n, and applies such image data to the surface conduction electron emitting elements in the image display apparatus 81 through the terminals Doy1–Doyn.

The electron emitting element in which the present invention is applicable has the following basic characteristics with respect to the emission current Ie. For the electron emission, there exists a distinct threshold voltage Vth, and the electron emission occurs only when a voltage at least equal to such threshold voltage Vth is applied. For the voltage equal to or larger than the electron emitting threshold voltage, the emission current also varies according to the variation of the voltage applied to the element. Based on these characteristics, when a pulse-shaped voltage is supplied to the element, the electron emission does not occur by the application of a voltage lower than the threshold value, but the electron beam is emitted by the application of a voltage at least equal to the threshold value. In such operation, the intensity of the output electron beam can be controlled by varying the wave height Vm of the pulse. It is also possible to control the total charge of the output electron beam by varying the duration Pw of the pulse.

Consequently, for modulating the electron emitting element according to the input signal, there can be adopted a voltage modulation method and a pulse width modulation method. In the voltage modulation method, the modulation signal generator 87 may be composed of a circuit of voltage modulation system capable of generating a voltage pulse of a constant length and modulating the wave height of the voltage pulse according to the input data.

In the pulse width modulation method, the modulation signal generator 87 may be composed of a circuit of pulse width modulation system capable of generating a voltage pulse of a constant wave height and modulating the duration of the voltage pulse according to the input data.

The shift register 84 and the line memory 85 can be of a digital signal type or an analog signal type, since they are only required to execute the serial/parallel conversion of the image signal and the storage thereof at a desired speed.

In the digital signal type, the output signal DATA of the sync signal separation circuit 86 need to be digitized, but this can be achieved by providing an A/D converter at the output of the sync signal separation circuit 86. In this regard, the circuit employed in the modulation signal generator 87 somewhat varies according to whether the output of the line memory 85 is a digital signal or an analog signal. More specifically, when the voltage modulation system employs the digital signal, the modulation signal generator 87 is composed of, for example, a D/A conversion circuit, and eventually, an amplifying circuit. When the pulse width modulation system is used, the modulation signal generator 87 is composed of, for example, a high-speed oscillator, a counter for counting the number of waves outputted from the oscillator, and a comparator for comparing the output of the counter and that of the memory. If necessary, there may be added a voltage amplifier for amplifying the pulse width modulated signal from the comparator to the driving voltage for the electron emitting element.

When the voltage modulation system employs the analog signal, the modulation signal generator 87 can be composed of, for example, an amplifier utilizing an operational amplifier or the like, and eventually, a level shifting circuit. In the case of the pulse width modulation system, there can be employed a voltage-controlled oscillator (VCO), eventually with an amplifier for executing voltage amplification to the driving voltage of the surface conduction electron emitting element.

In the image display apparatus of the present invention of any of the above-described configurations, electron emission is induced by the application of voltage to the electron emitting elements through the terminals Dox1 to Doxm, Doy1 to Doyn. The electron beams are accelerated by applying a high voltage through the high voltage terminal Hv to the metal back 8 or a transparent electrode (not shown). The accelerated electrons collide with the fluorescent film 7 to cause light emission, thereby displaying the image.

The above-described configuration of the image display apparatus is an example of the image display apparatus in which the present invention is applicable, and is subject to various modifications based on the technical concept of the present invention. The input signal of the NTSC system has been explained, but such an input signal is not restrictive and there may be employed other input signals such as PAL or SECAM, or a TV signal utilizing a larger number of scanning lines (for example, high definition TV such as a MUSE system).

The image display apparatus of the present invention can be utilized as the display apparatus for television broadcasts, television conference systems or computers, as well as the image display apparatus in a photo printer composed with, for example, a photosensitive drum.

In the following, the present invention will be further clarified by preferred embodiments. However, the present invention is not limited by such embodiments, and is subject to replacement of the components or changes in the design thereof within an extent that the objects of the present invention can be attained.

Embodiment 1

The image display apparatus of the present embodiment is constructed similarly to the apparatus schematically illustrated in FIGS. 1A to 1C, and the non-evaporating getters (NEG) 9 are positioned on the substantially entire surface of the row wirings (upper wirings) 102 within the image display area.

The image display apparatus of the present embodiment is provided, on the substrate 1, with an electron source consisting of plural surface conduction electron emitting elements wired in a simple matrix structure (100 rows×100 columns).

Figure 10:
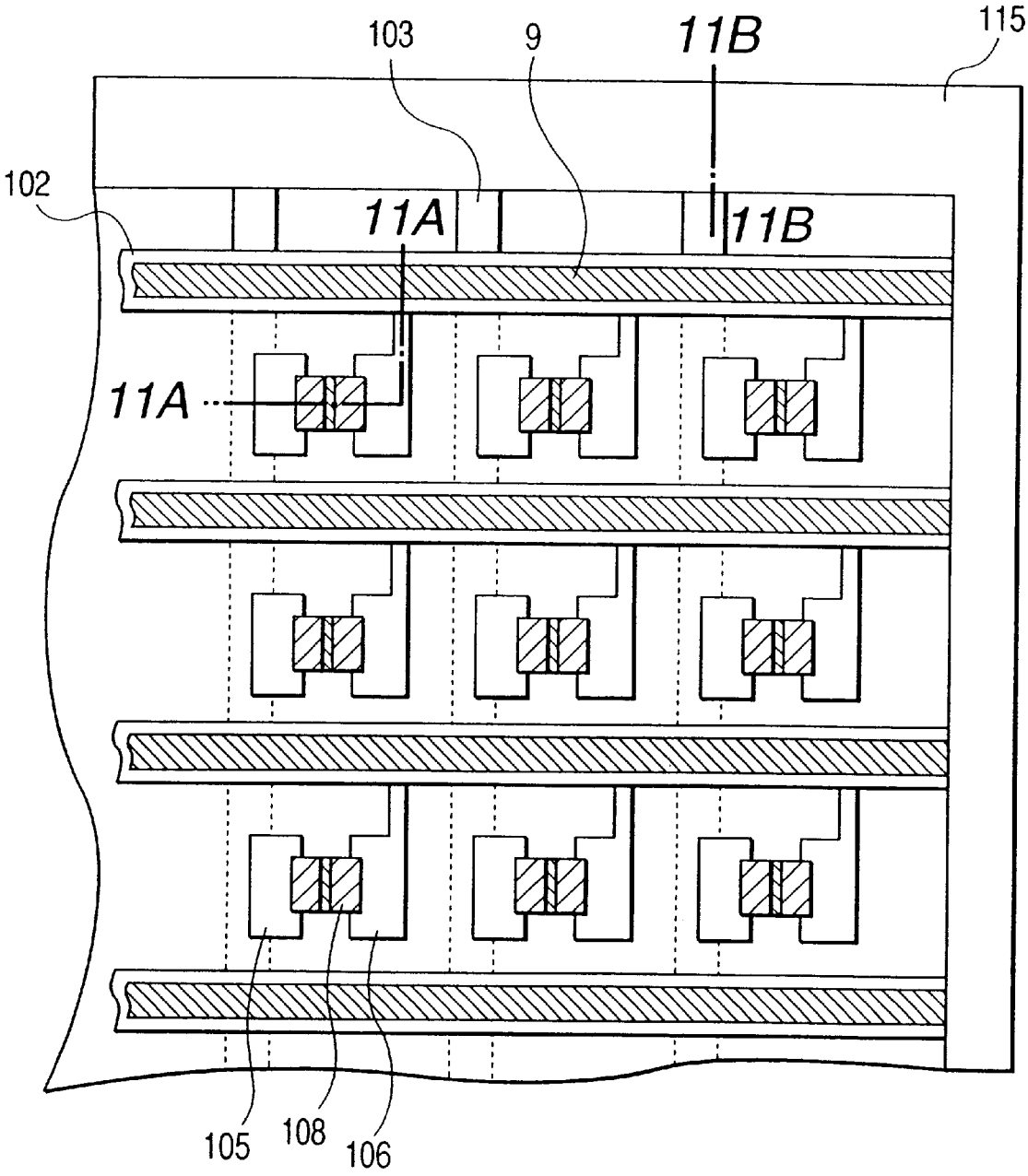
FIG. 10 is a plan view showing an example of the electron source of simple matrix arrangement formed according to the present invention.
Figure 11A:
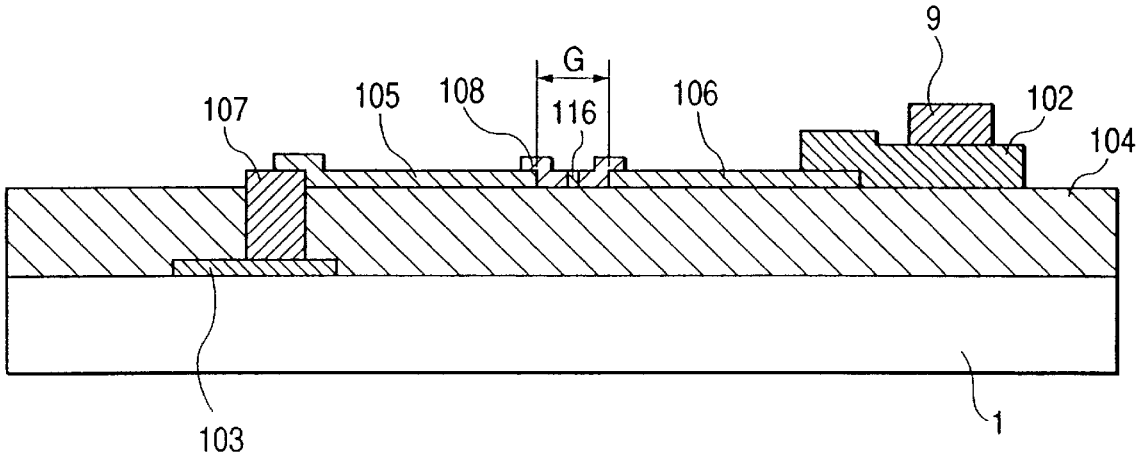
FIGS. 11A and 11B are cross-sectional views respectively along lines 11A—11A and 11B—11B in FIG. 10.
Figure 11B:
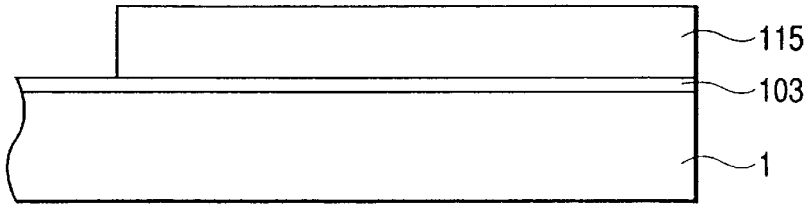

FIG. 10 is a partial plan view of the electron source substrate 1, while FIGS. 11A and 11B are cross-sectional views respectively along lines 11A—11A and 11B—11B in FIG. 10. The same components are represented by the same numbers in FIGS. 10, 11A and 11B. There are shown an electron source substrate 1, row wirings (upper wirings) 102, column wirings (lower wirings) 103, conductive films 108 including the electron emitting portions, element electrodes 105, 106, an interlayer insulation film 104, contact holes 107 for an electrical connection between the element electrodes 105 and the lower wirings 103, and an insulation layer 115 formed on the lower wirings 103.

In the following, there will be explained, with reference to FIGS. 12A to 12H, 12X and 12K, a method for producing the image display apparatus of the present invention.

Step a

Figure 12A:
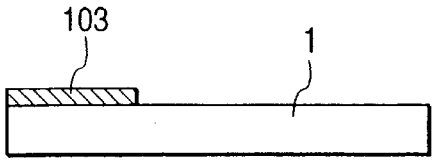
FIGS. 12A, 12B, 12C, 12D, 12E, 12F, 12G and 12H, 12X and 12K show the process for forming an electron source substrate having a simple matrix arrangement of the surface conduction electron emitting elements of the present invention.

The glass substrate 1 was sufficiently cleaned with a washing agent, deionized water and organic solvent. On the glass substrate 1, a silicon oxide film of a thickness of 0.5 $\mu$m was formed by sputtering. Then, on the substrate 1, photoresist (AZ1370/Hoechst Co.) was spin coated with a spinner, then baked, exposed to the image of a photomask and developed to form a resist pattern of the lower wirings 103. Then, Cr of a thickness of 5 nm and Au of a thickness of 600 nm were deposited in succession by vacuum evaporation, and the unnecessary portion of the Au/Cr deposition film was removed by lift off to form the lower wirings 103 of the desired form (FIG. 12A).

Step b

Figure 12B:
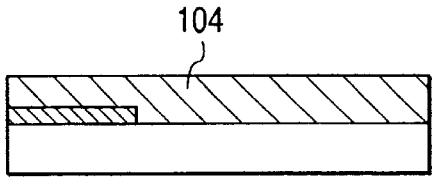

Then, the interlayer insulation film 104, consisting of a silicon oxide film of a thickness of 1.0 $\mu$m, was deposited by RF sputtering (FIG. 12B).

Step c

Figure 12C:
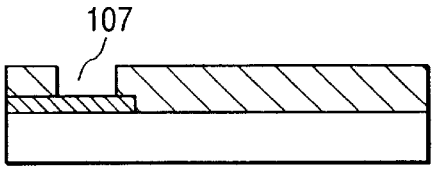

A photoresist pattern for forming the contact hole 107 was formed on the silicon oxide film deposited in the step b, and was used as a mask for etching the interlayer insulation film 104 to form the contact hole 107 (FIG. 12C). The etching was conducted by RIE (reactive ion etching) utilizing $CF_4$ and $H_2$ gas.

Step d

Figure 12D:
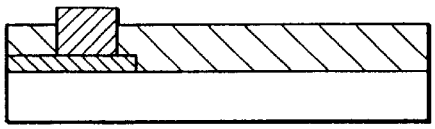

A photoresist pattern was formed in the area excluding the contact hole 107, and Ti of a thickness of 5 nm and Au of a thickness of 500 nm were deposited in succession by vacuum evaporation. The contact hole 107 was filled in by eliminating the unnecessary portion by lift-off (FIG. 12D).

Step e

Figure 12E:
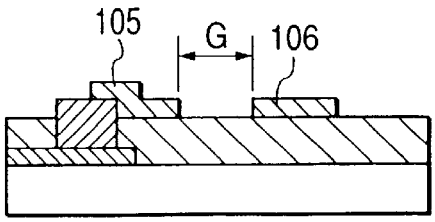

A pattern of the element electrodes 105, 106 was formed with photoresist (RD-2000N-41/Hitachi Chemical Co.), and Ti of a thickness of 5 nm and Ni of a thickness of 100 nm were deposited in succession by vacuum evaporation. The photoresist pattern was dissolved with organic solvent to lift off the Ni/Ti deposition film to obtain the element electrodes 105, 106 with a gap G therebetween of 3 $\mu$m and a width of the electrode of 300 $\mu$m (FIG. 12E).

Step f

Figure 12F:
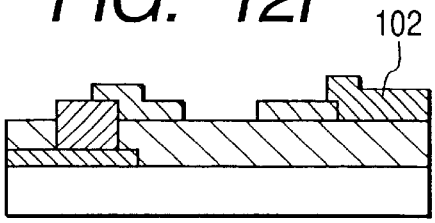

A photoresist pattern of the upper wirings 102 was formed on the element electrodes 105, 106, and Ti of a thickness of 5 nm and Au of a thickness of 500 nm were deposited in succession by vacuum evaporation. The unnecessary portions were eliminated by lift-off to form the upper wirings 102 of the desired form (FIG. 12F).

Step g

Figure 12G:
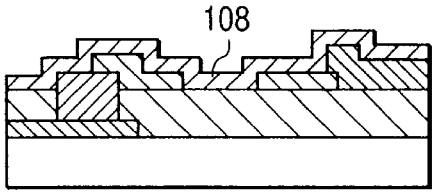

A Cr film of a thickness of 100 nm (not shown) was deposited by vacuum evaporation and patterned. Then, an amine complex solution (ccp4230/Okuno Pharmaceutical Co.) was spin coated thereon and was heat treated for 10 minutes at 300° C. The conductive film 108, principally consisting of fine Pd powder for forming the electron emitting portions, had a film thickness of 8.5 nm and a sheet resistance of $3.9\times10^4$ Ω/□ (FIG. 12G).

Step h

Figure 12H:
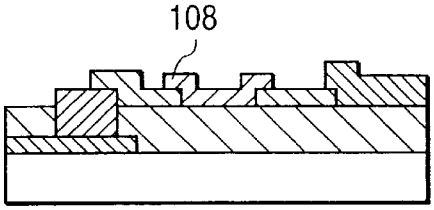

The Cr film and the conductive film 108 for forming the electron emitting portions, after sintering, were wet etched with an acid etchant to form the conductive films 108 of the desired pattern (FIG. 12H).

Through the foregoing steps, there were obtained, on the substrate 1, the conductive films 108 for forming the plural electron emitting portions and the plural upper wirings 102 and the plural lower wirings 103 connecting such conductive films 108 in the simple matrix.

Step x

Figure 12X:
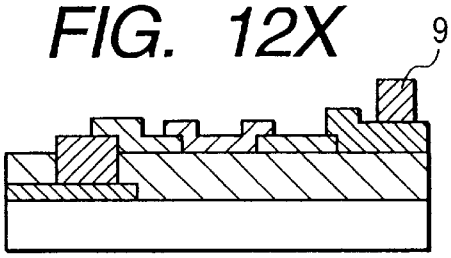

Then, the non-evaporating getter layer 9 consisting of a Zr—V—Fe alloy was formed by sputtering on each upper wiring 102, utilizing a metal mask. The thickness of the getter layer 9 was adjusted to 2 μm. The sputtering target employed had a composition of Zr 70%, V 25% and Fe 5% (in weight ratio) (FIG. 12X).

Step i

Then, the fact plate 4 shown in FIGS. 1A to 1C was prepared in the following manner.

The glass substrate 6 was sufficiently cleaned with a washing agent, deionized water and organic solvent. On the glass substrate 6, ITO of a thickness of 0.1 μm was formed by sputtering to obtain a transparent electrode (not shown). Then, the fluorescent film 7 was coated by the printing method and its surface was smoothed (usually called "filming") to obtain the fluorescent member portion. The fluorescent film 7 had a configuration shown in FIG. 7A, in which the striped fluorescent members (R, G, B) and the black conductive material (black stripe) were alternately arranged. Then, on the fluorescent film 7, the metal back 8 consisting of an Al film was formed with a thickness of 0.1 μm by sputtering.

Step j

Then, the external housing 5 shown in FIGS. 1A to 1C was formed in the following manner.

The substrate 1, prepared in the foregoing steps, was fixed on the rear plate 2, and the supporting frame 3 and the face plate 4 were combined therewith. The lower wirings 103 and the upper wirings 102 of the substrate 1 were respectively connected to the row selecting terminals 10 and the signal input terminals 11.

Then, the substrate 1 and the face plate 4 were precisely adjusted in position and were sealed to form the external housing 5. The sealing was executed by applying frit glass on the jointing portions and heating for 30 minutes at 450° C. in Ar gas. The substrate 1 and the rear plate 2 were fixed in a similar manner. In positioning the rear plate 2 and the face plate 4, the wire-shaped evaporating getter (container) 14, principally composed of Ba, was simultaneously arranged on four sides of the image display area, so as to surround the non-evaporating getters 9 on the upper wirings 102 in the image display area.

Figure 13:
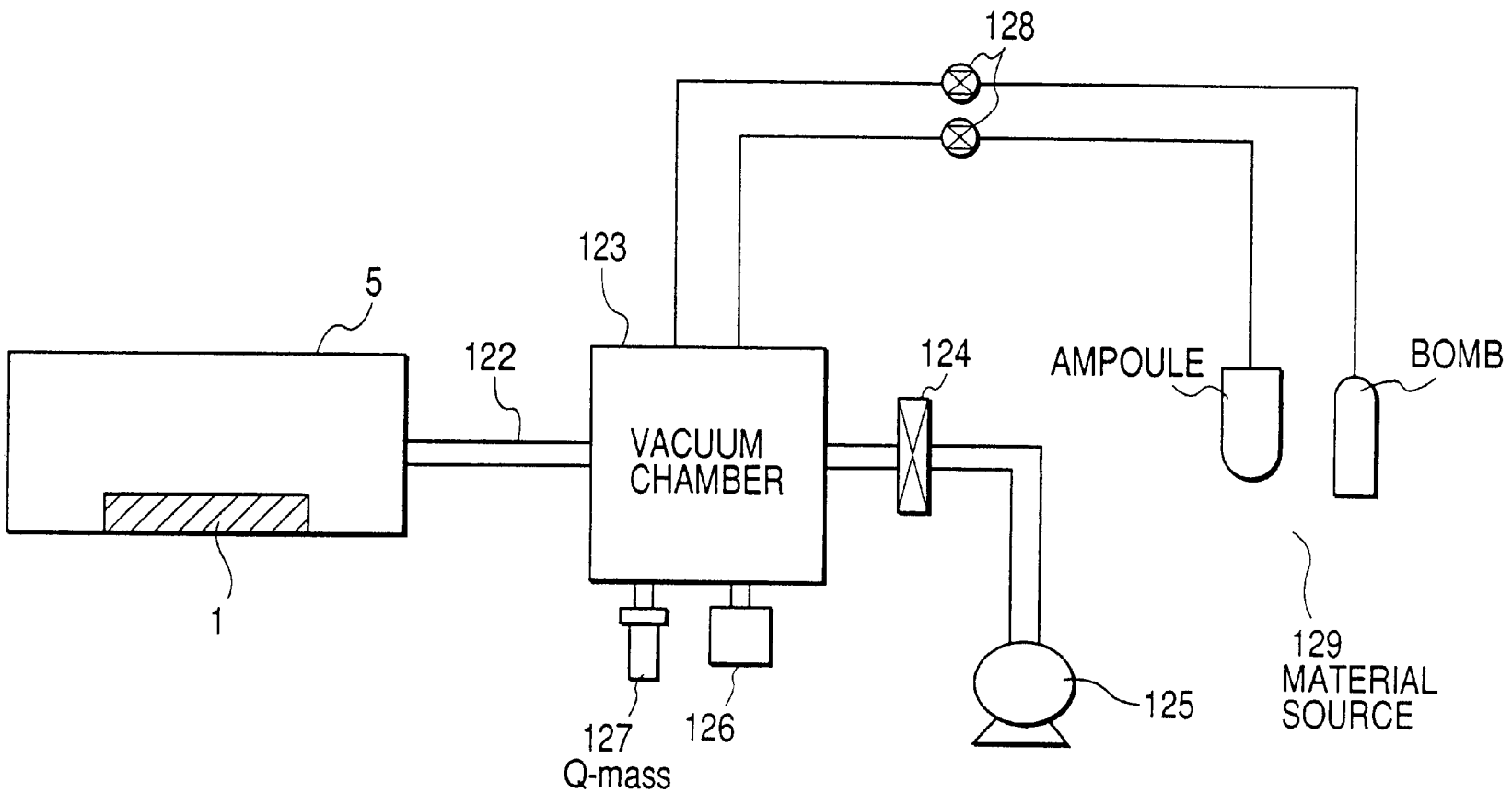
FIG. 13 is a schematic view showing a vacuum apparatus for executing a forming step and an activation step in the manufacturing process for the image display apparatus of the present invention.

The subsequent steps were executed with a vacuum apparatus shown in FIG. 13.

The external housing 5, prepared in the above-described manner, was connected to a vacuum chamber 123 through an evacuating tube 122 as shown in FIG. 13. The vacuum chamber 123 is connected to a vacuum apparatus 125 with a gate valve 124. The vacuum chamber 123 is provided with a pressure gauge 126 and a quadrapole mass spectrometer (Q-pass) 127 monitoring the internal pressure and the partial pressures of the remaining gasses. Since the internal pressure and the partial pressures in the external housing 5 are difficult to measure directly, these pressures are measured in the vacuum chamber 123 and regarded as those in the external housing 5.

The vacuum apparatus 125 is an ultra high vacuum apparatus consisting of a sorption pump and an ion pump. The vacuum chamber 123 is connected to plural gas introducing apparatus for introducing materials stored in material sources 129. The material to be introduced is contained in an ampule or a bomb according to the kind of the material and the amount of introduction can be controlled by a gas introduction amount control device 128, which is composed of, for example, a needle valve or a mass flow controller, according to the kind and flow rate of the material and the required precision of control. In the present embodiment, the material source 129 was benzonitrile contained in a glass ampule, and the gas introduction amount control means 128 was composed of a slow leak valve.

In the following, there will be explained step executed with the above-described vacuum apparatus.

Step k

First, the interior of the external housing 5 was evacuated to a pressure of $1\times10^{-3}$ Pa or lower, and the following forming process was executed for forming a gap 116 in each of the aforementioned plural conductive films 108 arranged on the substrate 1.

Figure 12K:
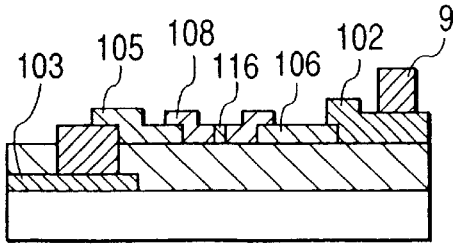
Figure 14:
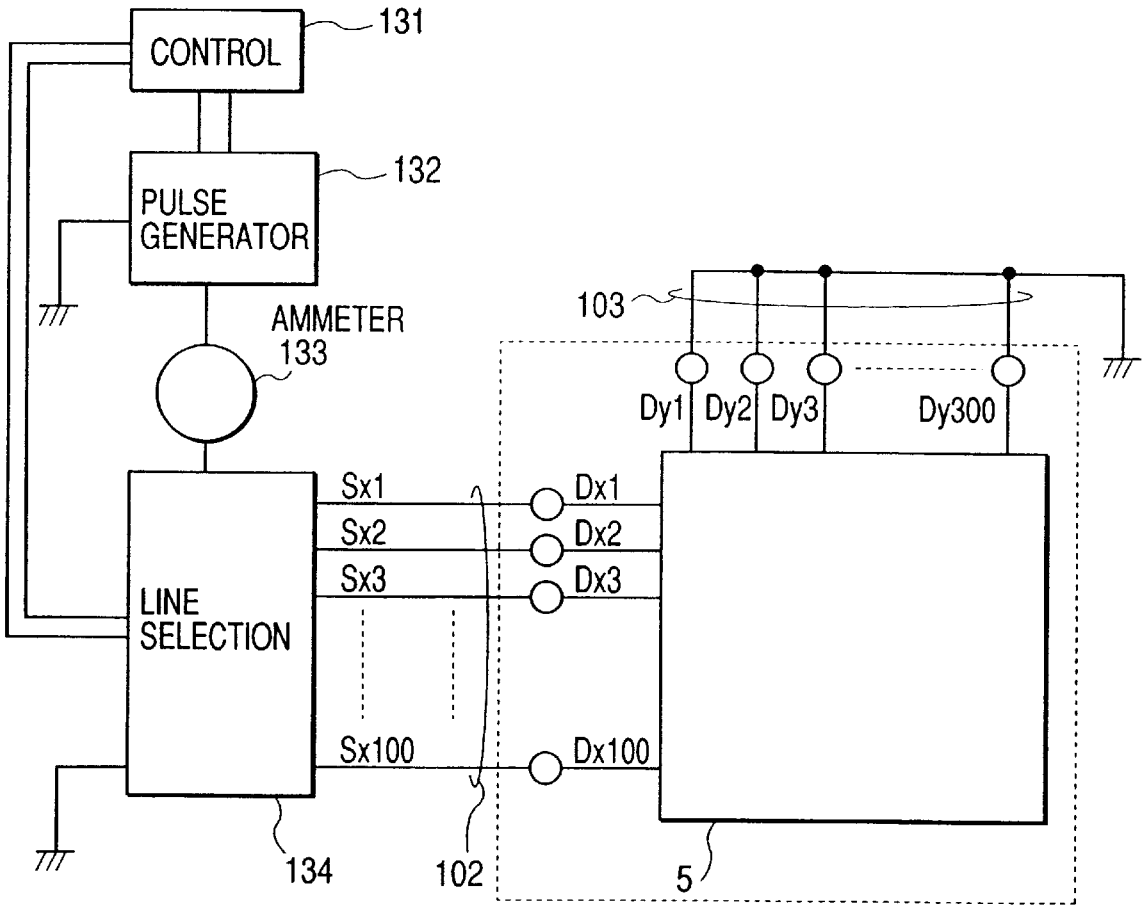
FIG. 14 is a schematic view showing a wiring method for the forming step and the activation step in the manufacturing process for the image display apparatus of the present invention.
Figure 15A:
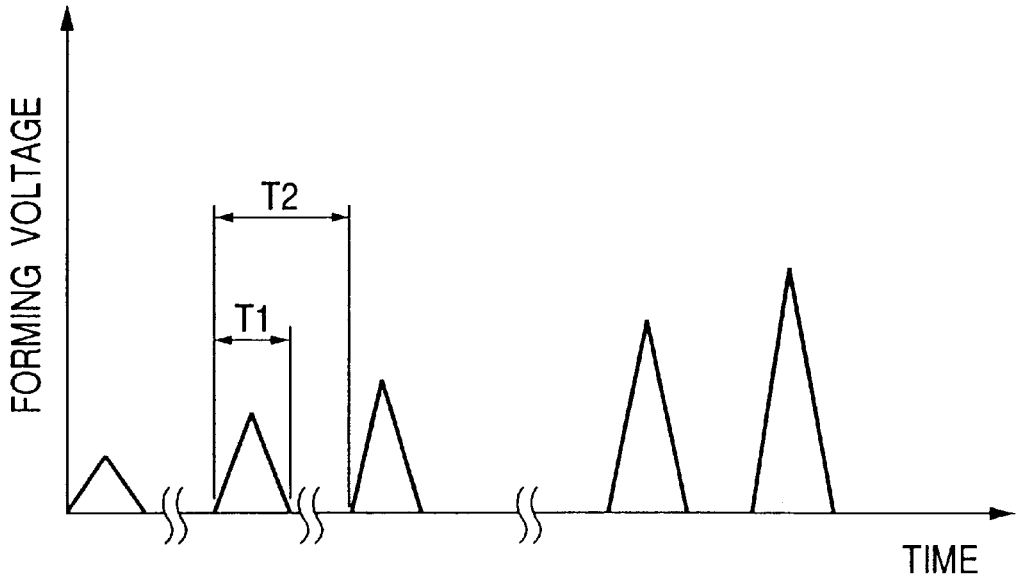
FIGS. 15A and 15B are charts showing a voltage wave form for the forming step and the activation step in the manufacturing process for the image display apparatus of the present invention.

As shown in FIG. 14, the row wirings 103 were commonly connected to the ground. A control device 131 controlled a pulse generator 132 and a line selector 134 provided with an ammeter 133. A pulse voltage was applied to one of the row wirings 102 selected by the line selector 134. The forming process was executed for each row including 300 elements. The applied pulse signal was a triangular pulse signal as shown in FIG. 15A, with a gradual increase of the wave height and with a pulse width T1=1 msec and a pulse interval T2=10 msec. Between the triangular pulses, there was inserted a rectangular pulse of a wave height of 0.1 V and the current was measured to determine the resistance of each row. The forming process for a row was terminated when the resistance exceeded 3.3 kΩ (1 MΩ per element) and was shifted to a next row. The process was repeated for all the rows to execute the forming on all the conductive films (conductive films 108 for forming the electron emitting portions), thereby forming a gap 116 in each conductive film 108 (FIG. 12K).

Step l

Figure 15B:
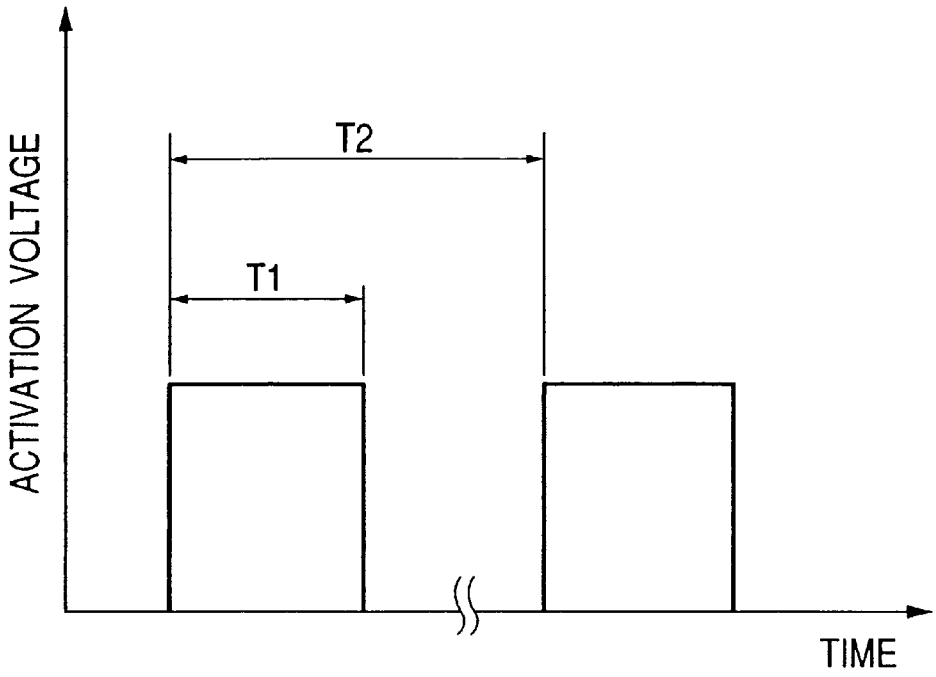

Then, benzonitrile was introduced into the vacuum chamber 123 shown in FIG. 13 with a pressure of $1.3\times10^{-3}$ Pa, and a pulse signal was applied to the substrate 1 with the measurement of the current If to activate all the conductive films having the gaps 116. The pulse signal generated by the pulse generator (FIG. 14) was a rectangular pulse signal shown in FIG. 15B, with a wave height of 14 V, a pulse width T1=100 μsec and a pulse interval of 167 μsec. The selected line was shifted in succession from Dx1 to Dx100 by the line selector 134 for every 167 μsec, whereby each row received the rectangular wave of T1=100 μsec and T2=16.7 msec, with successive shifts in the phase between the rows.

The ammeter 133 was used in a mode of detecting the average current when the rectangular pulse was turned on (with a voltage of 14 V), and the activation was terminated when the measured current reached 600 mA (2 mA per element). Such activation process formed a carbon film in the gap 106 in each of the conductive films 108.

Step m

The external housing 5 and the vacuum chamber 123 were maintained at 300° C. for 10 hours by an unrepresented heating apparatus, under the continued evacuation of the interior of the external housing 5. This process removed benzonitrile and decomposed products thereof, which were, presumably, absorbed on the internal walls of the external housing 5 and the vacuum chamber 123. The removal was confirmed by the observation with the Q-mass 127. This step of heating and evacuating the external housing 5 results not only in removing the gas from the interior thereof but also in the activation of the non-evaporating getter 9.

Step n

The evacuating tube was sealed off by heating with a burner after the pressure reached $1.3\times10^{-5}$ Pa or lower. Subsequently, the evaporating getters 15*a*, which are supported by the four containers 14*a* positioned outside the image display area to surround the non-evaporating getters 9 on the upper wirings 102 in the image display area, are subjected to resistance heating to form a flush getter film 15*b* on the insulating member 115, in such a manner, so as to be electrically insulated from the electron source 1 and the metal back 8.

The image display apparatus of the present embodiment having the non-evaporating first getters in the image display area and the evaporating second getters outside the image display area and around the first getters was prepared in this fashion.

Second Embodiment

Figure 16:
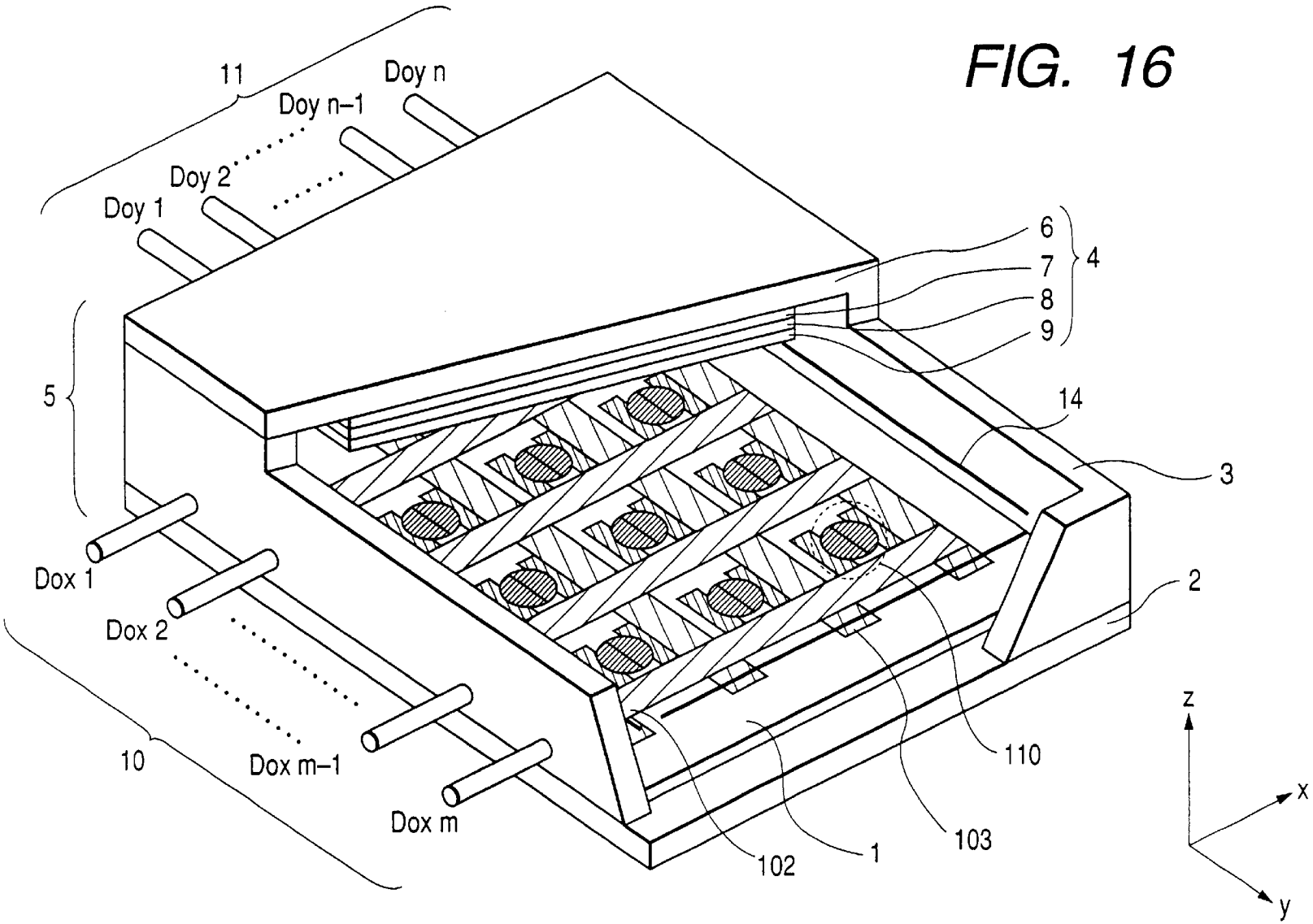
FIG. 16 is a schematic view showing an image display apparatus of the second embodiment.

FIG. 16 shows the image display apparatus of this embodiment.

In the present embodiment, step x of the foregoing first embodiment was omitted, and the following step y was executed after steps a to i were executed in the same manner as in the first embodiment.

Step y

The non-evaporating getter layer 9 consisting of a Ti—Al alloy was formed by sputtering on the entire surface of the metal back 8 of the face plate 4. The Ti—Al alloy getter layer 9 had a thickness of 50 nm, and the sputtering target used had a composition of Ti 85% and Al 15% (ratio by weight).

Thereafter, steps j to n were executed in the same manner as in the first embodiment to obtain the image display apparatus of the present embodiment, having the non-evaporating first getters in the image display area and the evaporating getters outside the image display area and around the first getters.

Third Embodiment

Figure 17A:
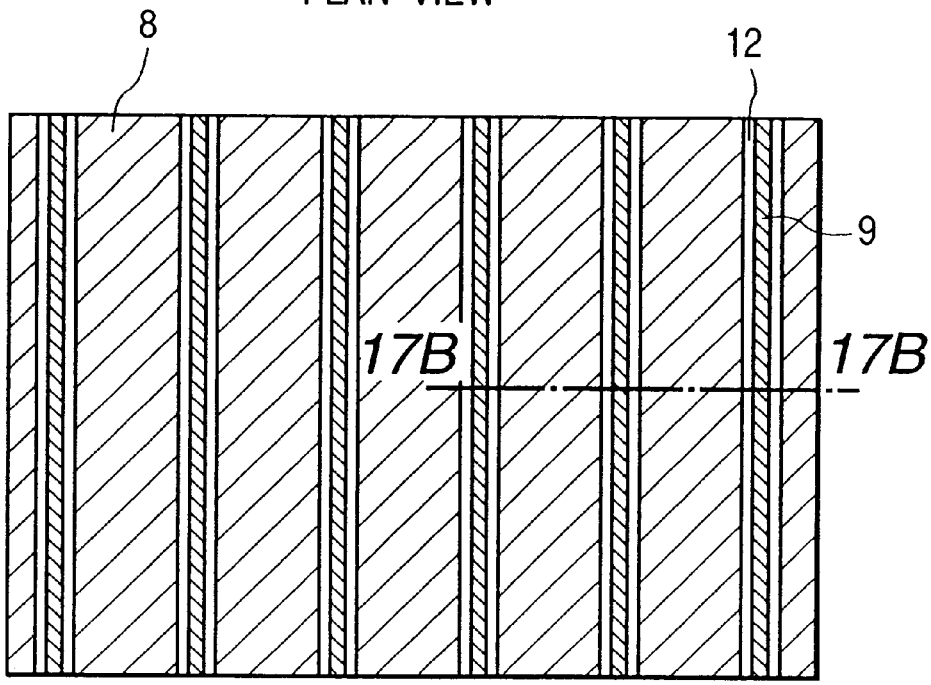
FIGS. 17A and 17B are schematic views showing the configuration of a face plate of an image display apparatus of the third embodiment.
Figure 17B:
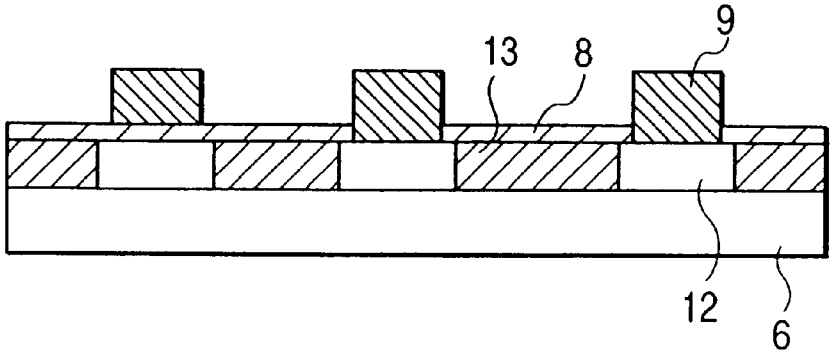

FIGS. 17A and 17B show the configuration of the face plate of the image display apparatus of the present embodiment, and are respectively a plan view and a cross-sectional view along a line 17B—17B in FIG. 17A.

In the present embodiment, step x of the foregoing first embodiment was omitted, and the following step z was executed after steps a to i were executed in the same manner as in the first embodiment.

Step z

The non-evaporating getter layer 9 consisting of a Ti—Al alloy was formed by sputtering on the black layer 12 of the face plate 4. The Ti—Al alloy getter layer 9 had a thickness of 1 $\mu$m, and the sputtering target used had a composition of Ti 85% and Al 15% (ratio by weight).

Thereafter, steps j to n were executed in the same manner as in the first embodiment to obtain the image display apparatus of the present embodiment, having the non-evaporating first getters in the image display area and the evaporating second getters outside the image display area and around the first getters.

Fourth Embodiment

Figure 18A:
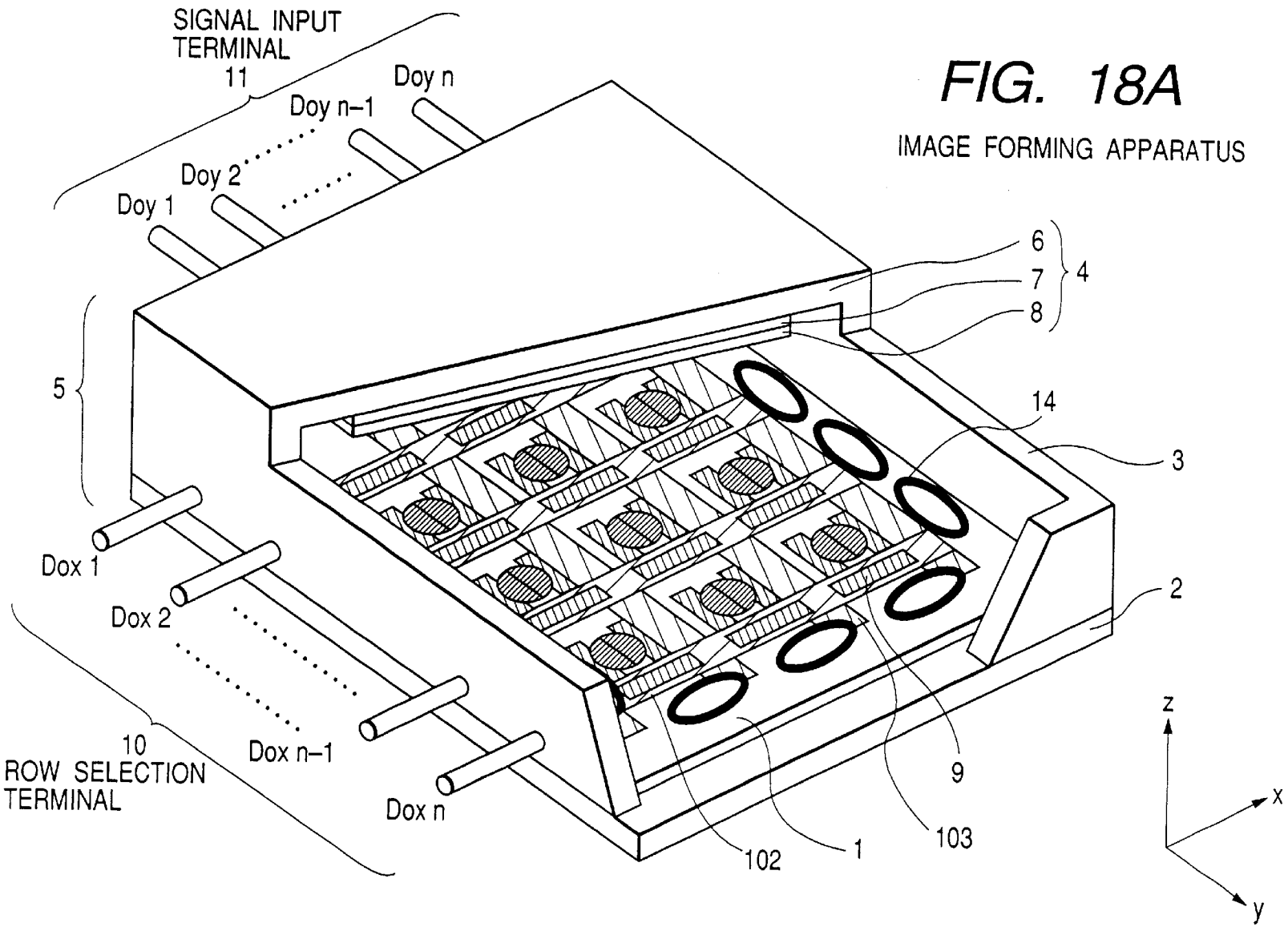
FIGS. 18A and 18B are schematic views showing an image display apparatus of the fourth embodiment.
Figure 18B:
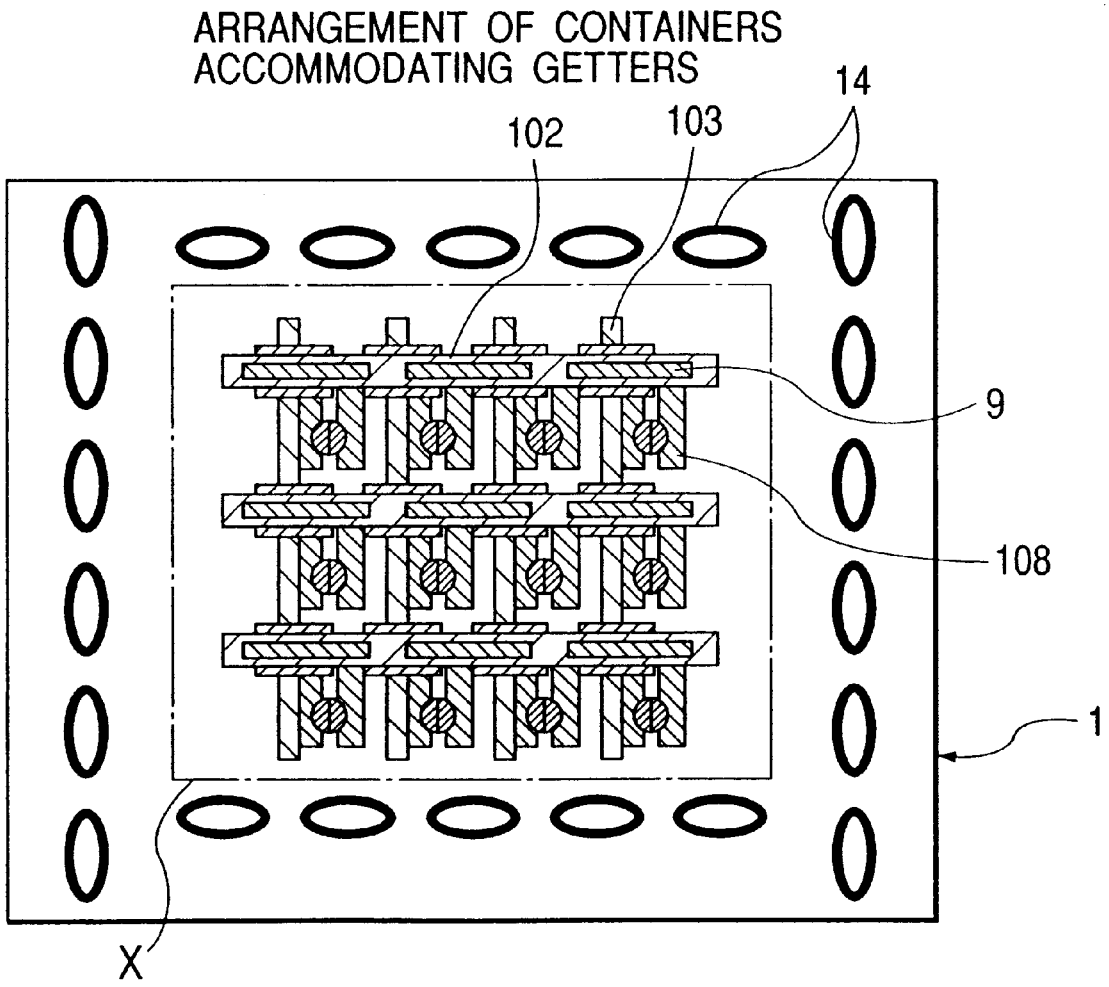

FIGS. 18A and 18B show the image display apparatus of the present embodiment.

The present embodiment was executed in the same manner as the foregoing first embodiment, except that the container 14 for the evaporating getter in step j of the first embodiment was of an annular type as shown in FIGS. 18A and 18B, and that getter flushing in step n of the first embodiment was executed by high frequency heating, to obtain the image display apparatus of the present embodiment, having the non-evaporating first getters in the image display area and the line-shaped evaporating second getters outside the image display area and around the four sides of the first getters.

Fifth Embodiment

Figure 19A:
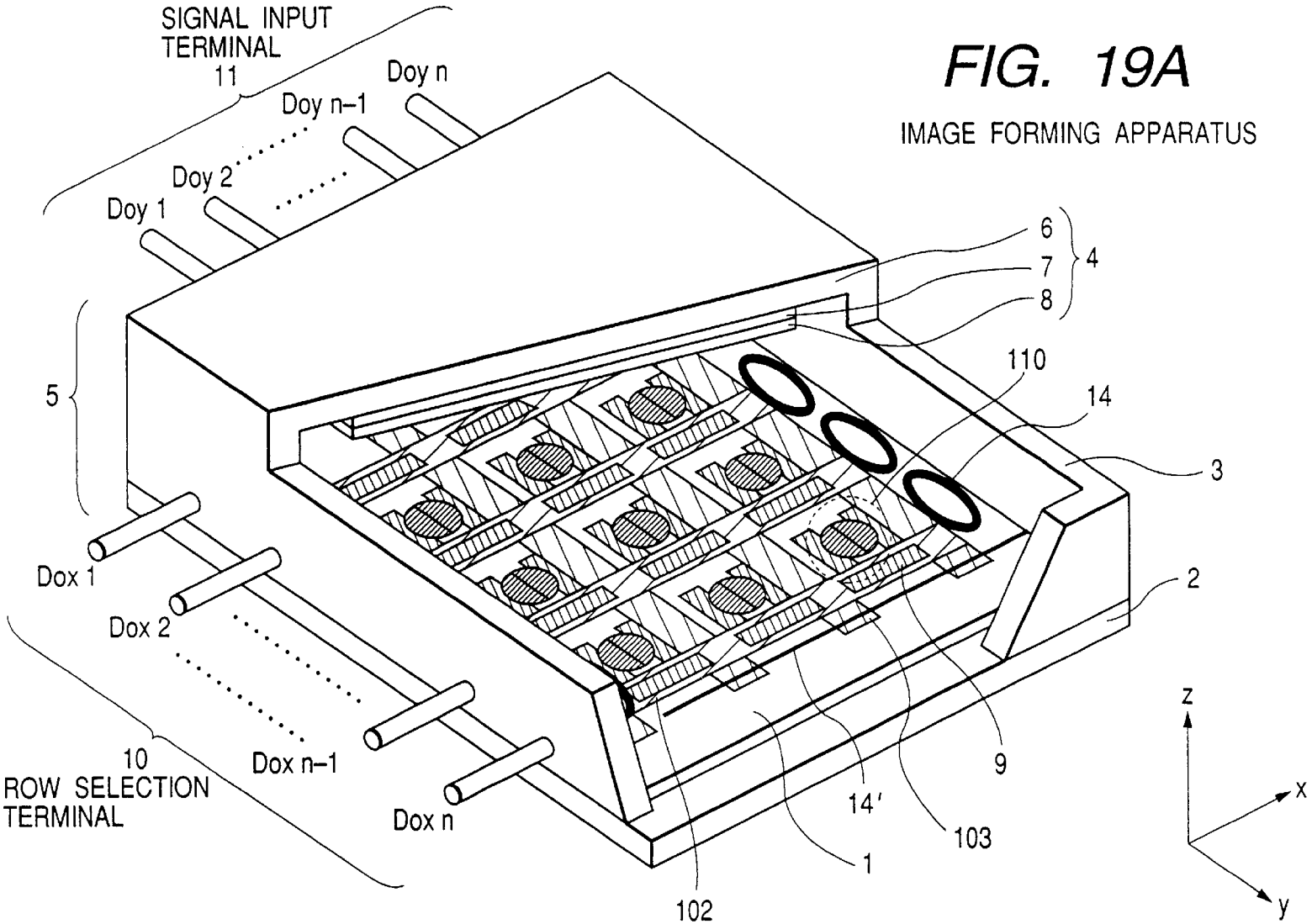
FIGS. 19A and 19B are schematic views showing an image display apparatus of the fifth embodiment.
Figure 19B:
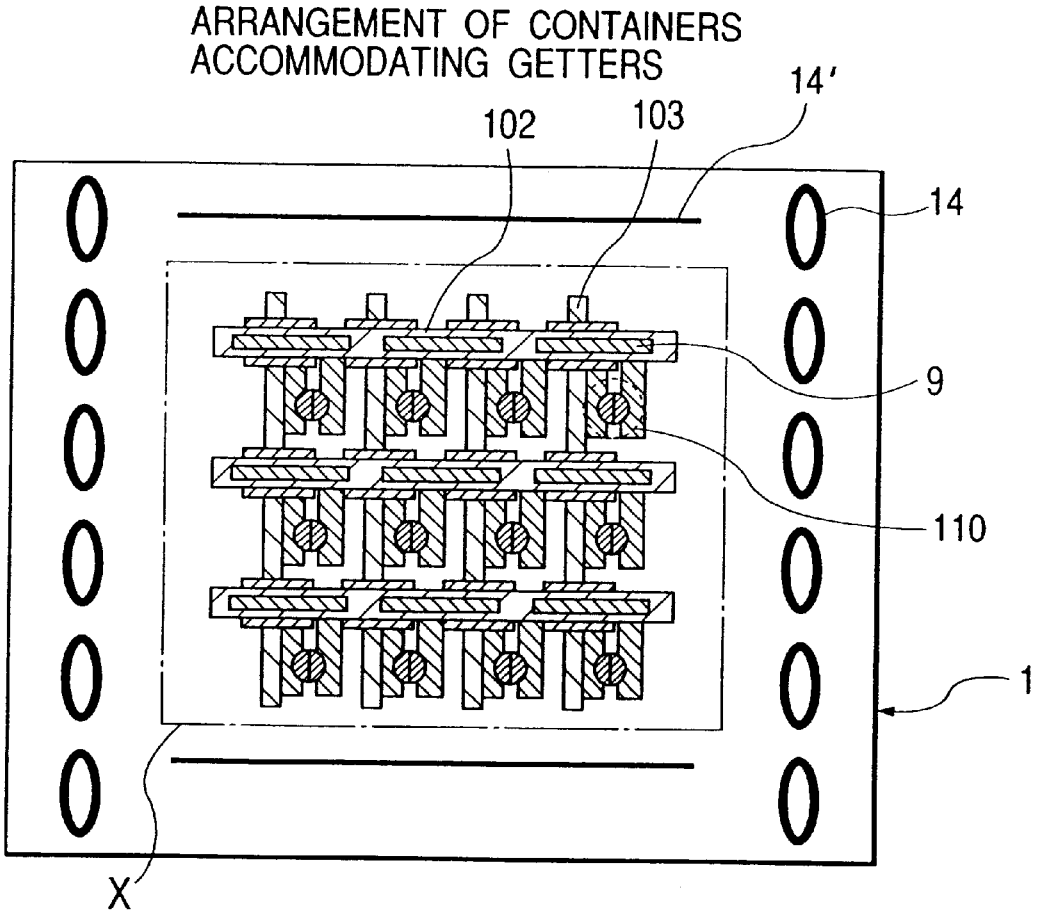

FIGS. 19A and 19B show the image display apparatus of the present embodiment.

The present embodiment was executed in the same manner as the foregoing fourth embodiment, except that, among the hollow containers 14 of the four sides, the mutually opposed two sides were composed of wire-shaped non-evaporating getters 14' consisting of ST122 (supplied by Saesu Co.) and that the activation of the getters was performed for 2 hours at 450° C. after the flushing of the annular evaporating getters 14, to obtain the image display apparatus of the present embodiment, having the non-evaporating first getters in the image display area and the line-shaped evaporating and non-evaporating second getters outside the image display area and around the first getters.

Reference Example

In this reference example, an image display apparatus was prepared in the same manner as in the first embodiment, except that an evaporating getter was positioned on only one side outside the image display area.

Figure 20A:
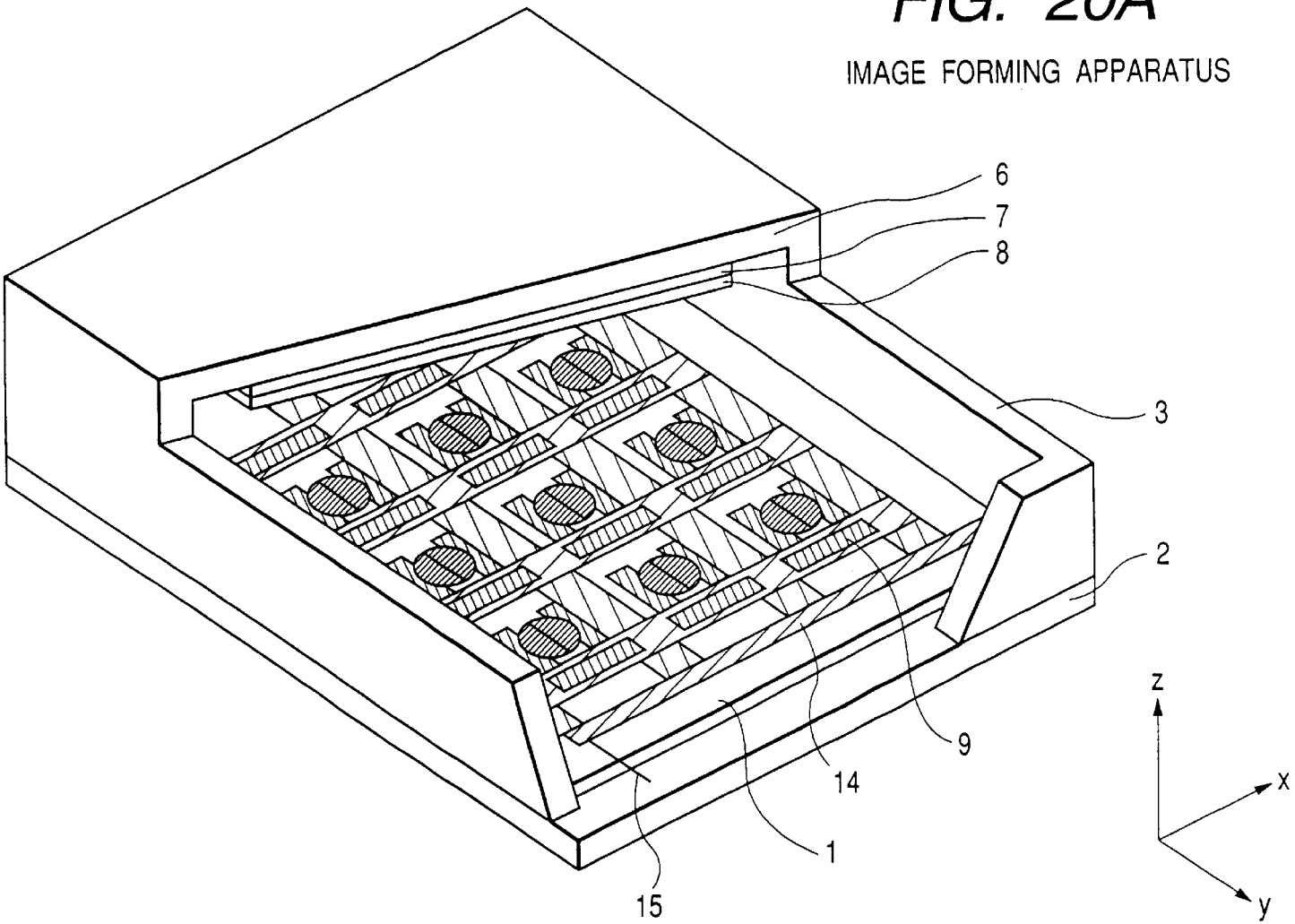
FIGS. 20A and 20B are schematic views showing an image display apparatus of the reference example.
Figure 20B:
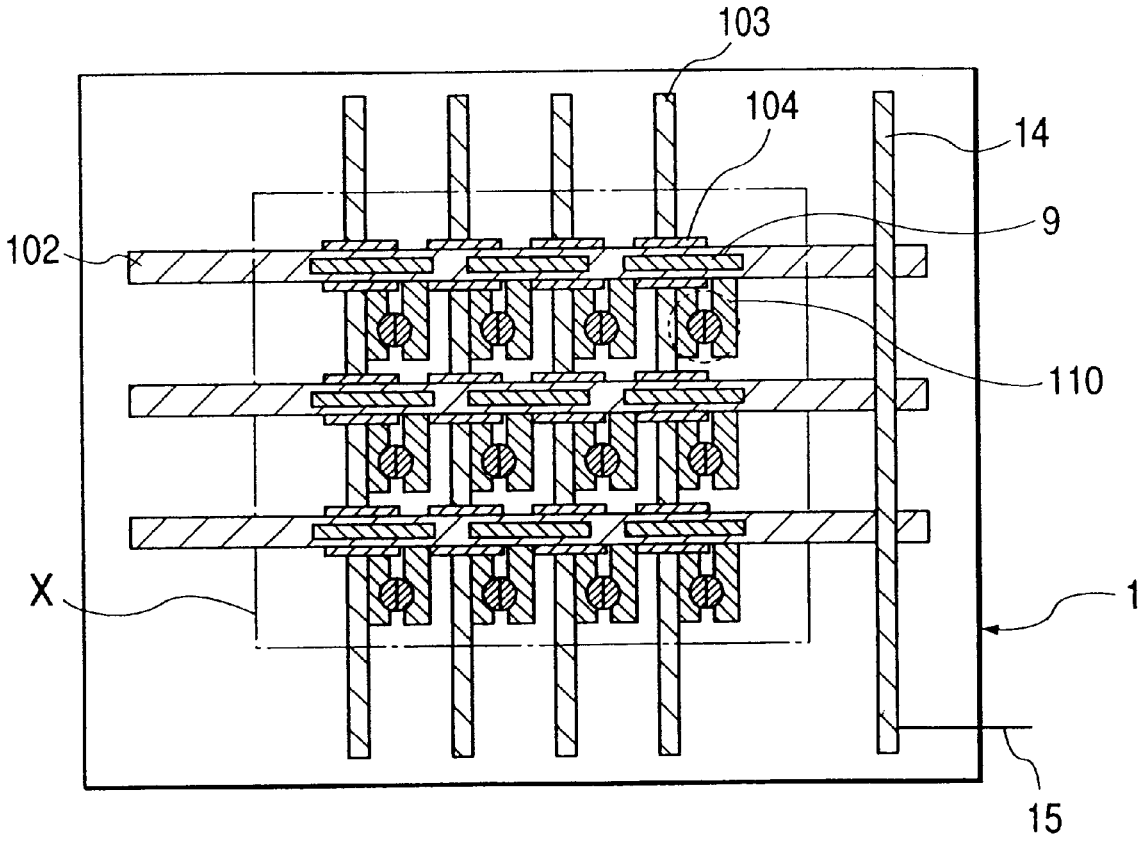

In this reference example, the evaporating getter 14 was provided on one side outside the image display area as shown in FIGS. 20A and 20B, and the getter film was formed by flushing the evaporating getter 14 with a heating wire 15 after sealing.

Each of the image display apparatuses of the foregoing embodiments first to fifth and the reference example was subjected to simple matrix drive to effect continuous light emission over the entire surface and the luminance variation in time was measured.

As a result, though there was a difference in the initial luminance, the image display apparatus of the first to fifth embodiments showed little decrease of the luminance and little fluctuation in the luminance among the pixels even after a prolonged drive, in comparison with the apparatus of the reference example.

Sixth Embodiment

The image display apparatus of this embodiment is similar in configuration to that shown in FIGS. 5A to 5C, wherein the non-evaporating getters 9 are provided on substantially the entire surface of the row wirings (upper wirings) 102 in the image display area and the non-evaporating getters 14 are provided on the insulation layer 115 covering the column wirings (lower wirings) 103 outside the image display area on the electron source substrate 1.

The image display apparatus of the present embodiment is provided, on the substrate 1, with an electron source consisting of plural surface conduction electron emitting elements wired in a simple matrix structure (100 rows×100 columns).

Figure 21:
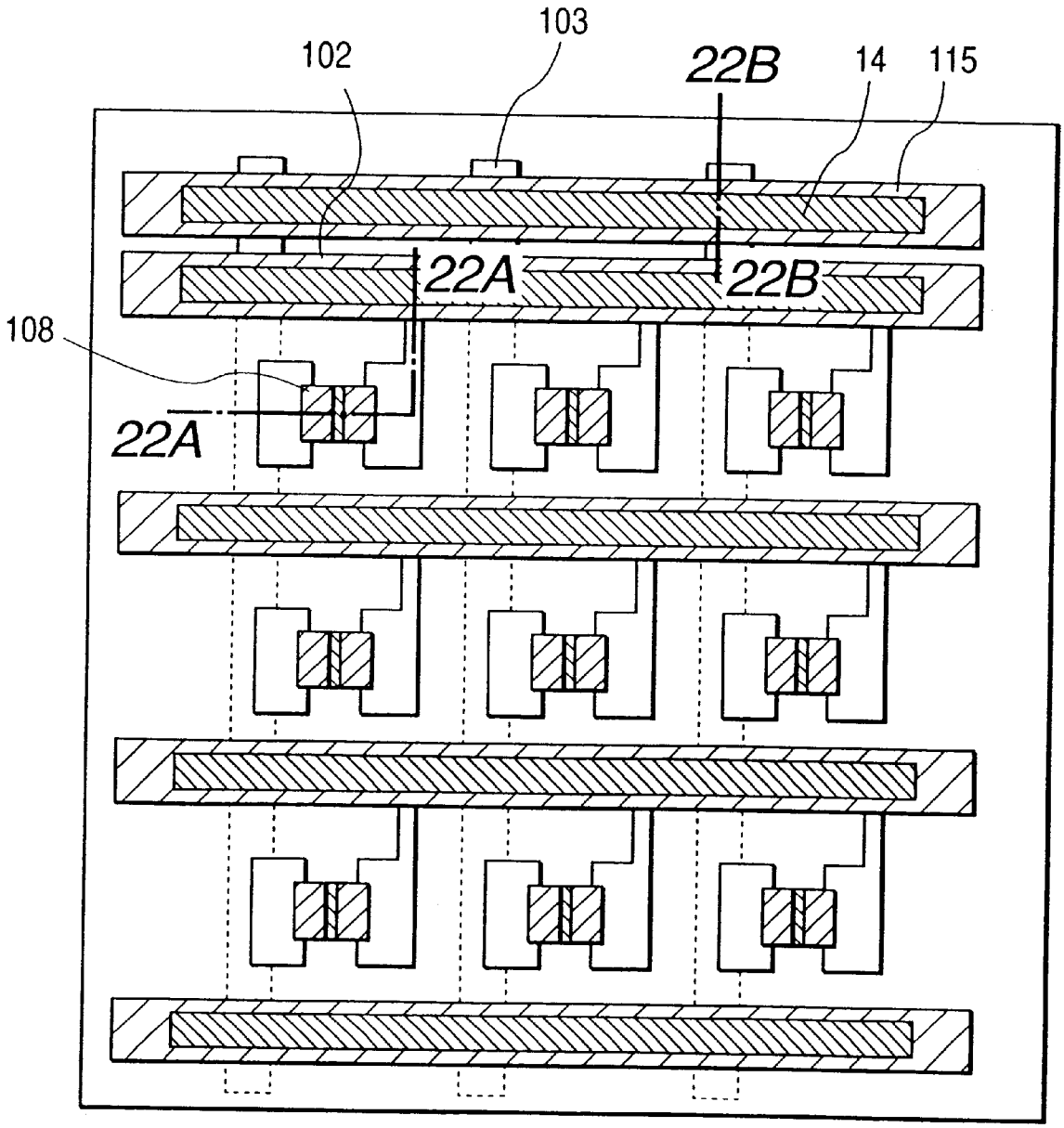
FIG. 21 is a schematic plan view of an electron source of a simple matrix arrangement in the sixth embodiment.
Figure 22A:
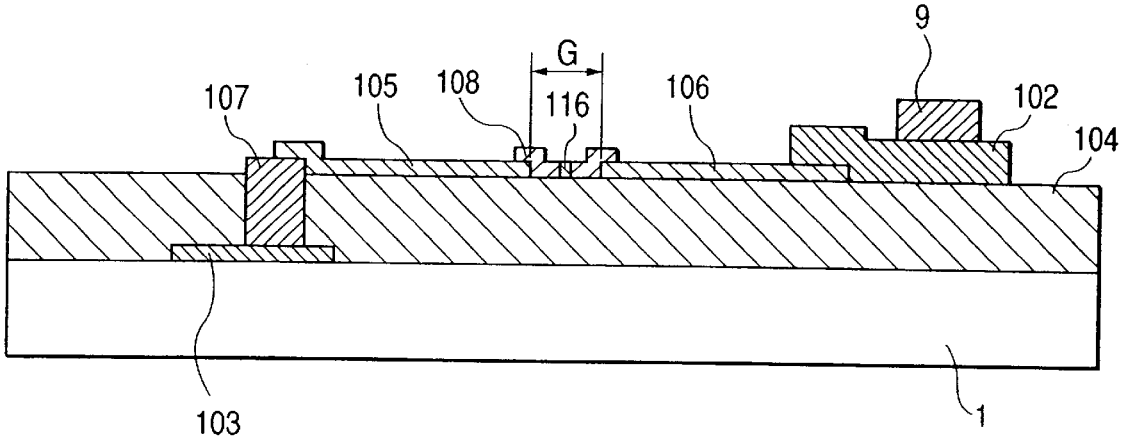
FIGS. 22A and 22B are cross-sectional views respectively along lines 22A—22A and 22B—22B in FIG. 21.
Figure 22B:
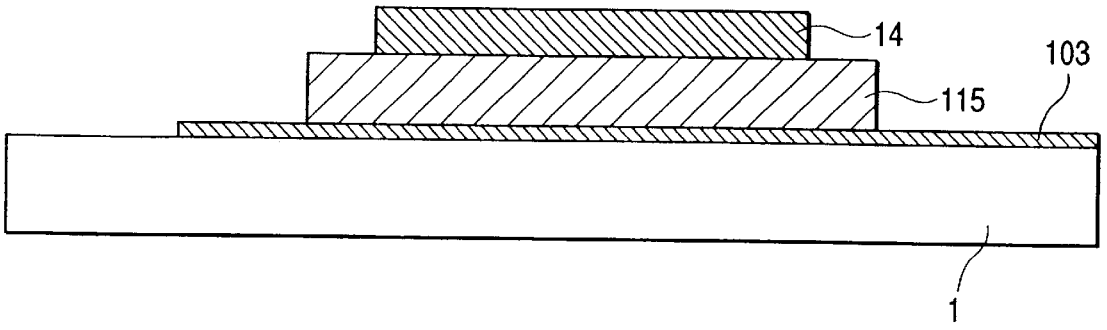

FIG. 21 is a partial plan view of the electron source substrate 1, while FIGS. 22A and 22B are cross-sectional views along lines 22A—22A and 22B—22B in FIG. 21, respectively. The same components are represented by the same numbers in FIGS. 21, 22A and 22B. There are shown an electron source substrate 1, row wirings (upper wirings) 102, column wirings (lower wirings) 103, conductive films 108 including the electron emitting portions, element electrodes 105, 106, an interlayer insulation film 104, contact holes 107 for electrical connection between the element electrodes 105 and the lower wirings 103, and an insulation layer 115 formed on the lower wirings 103.

In the following, there will be explained, with reference to FIG. 12, a method for producing the image display apparatus of the present embodiment.

Step a

The glass substrate 1 was sufficiently cleaned with a washing agent, deionized water and organic solvent. On the glass substrate 1, a silicon oxide film of a thickness of 0.5 μm was formed by sputtering. Then, on the substrate 1, photoresist (AZ1370/Hoechst Co.) was spin coated with a spinner and then baked, exposed to the image of a photomask and developed to form a resist pattern of the lower wirings 103. Then, Cr of a thickness of 5 nm and Au of a thickness of 600 nm were deposited in succession by vacuum evaporation, and the unnecessary portion of the Au/Cr deposition film was removed by lift-off to form the lower wirings 103 of the desired form (FIG. 12A).

Step b

Then, the interlayer insulation film 104, consisting of a silicon oxide film of a thickness of 1.0 μm, was deposited by RF sputtering (FIG. 12B). At the same time, the insulation film 115 was deposited on the lower wirings 103 outside the image display area.

Step c

A photoresist pattern for forming the contact hole 107 was formed on the silicon oxide film deposited in the step b, and was used as a mask for etching the interlayer insulation film 104 to form the contact hole 107 (FIG. 12C). The etching was conducted by RIE (reactive ion etching) utilizing $CF_4$ and $H_2$ gas.

Step d

A photoresist pattern was formed in the area excluding the contact hole 107, and Ti of a thickness of 5 nm and Au of a thickness of 500 nm were deposited in succession by vacuum evaporation. The contact hole 107 was filled in by eliminating the unnecessary portion by lift-off (FIG. 12D).

Step e

A pattern of the element electrodes 105, 106 was formed with photoresist (RD-2000N-41/Hitachi Chemical Co.), and Ti of a thickness of 5 nm and Ni of a thickness of 100 nm were deposited in succession by vacuum evaporation. The photoresist pattern was dissolved with organic solvent to lift off the Ni/Ti deposition film to obtain the element electrodes 105, 106 with a gap G therebetween of 3 μm and a width of the electrode of 300 μm (FIG. 12E).

Step f

A photoresist pattern of the upper wirings 102 was formed on the element electrodes 105, 106, and Ti of a thickness of 5 nm and Au of a thickness of 500 nm were deposited in succession by vacuum evaporation. The unnecessary portions were eliminated by lift-off to form the upper wirings 102 of the desired form (FIG. 12F).

Step g

A Cr film of a thickness of 100 nm (not shown) was deposited by vacuum evaporation and patterned. Then, an amine complex solution (ccp4230/Okuno Pharmaceutical Co.) was spin coated thereon and was heat treated for 10 minutes at 300° C. The conductive film 108, principally consisting of fine Pd powder for forming the electron emitting portions, had a film thickness of 8.5 nm and a sheet resistance of 3.9×104 Ω/□ (FIG. 12G).

Step h

The Cr film and the conductive film 108 for forming the electron emitting portions, after sintering, were wet etched with an acid etchant to form the conductive films 108 of the desired pattern (FIG. 12H).

Through the foregoing steps, there were obtained, on the substrate 1, the conductive films 108 for forming the plural electron emitting portions and the plural upper wirings 102 and the plural lower wirings 103 connecting such conductive films 108 in the simple matrix.

Step x

Then, the non-evaporating getter layers 9, 14 consisting of a Zr—V—Fe alloy were formed by sputtering on each upper wiring 102 and on each lower wiring 103 outside the image display area, utilizing a metal mask. The thickness of the getter layers 9, 14 was adjusted to 2 μm. The sputtering target employed had a composition of Zr 70%, V 25% and Fe 5% (in weight ratio) (FIG. 12X).

Step i

Then, the face plate 4 shown in FIGS. 5A to 5C was prepared in the same manner as in the step i of the aforementioned first embodiment.

Step j

Then, the external housing 5 shown in FIGS. 5A to 5C was formed in the following manner.

The substrate 1, prepared in the foregoing steps, was fixed on the rear plate 2, and the supporting frame 3 and the face plate 4 were combined therewith. The lower wirings 103 and the upper wirings 102 of the substrate 1 were respectively connected to the row selecting terminals 10 and the signal input terminals 11. Then, the substrate 1 and the face plate 4 were precisely adjusted in position and were sealed to form the external housing 5. The sealing was executed by applying frit glass on the jointing portions and heating for 30 minutes at 450° C. in Ar gas.

The substrate 1 and the rear plate 2 were fixed in a similar manner.

The subsequent steps were executed with a vacuum apparatus shown in FIG. 13.

Step k

At first, the interior of the external housing 5 was evacuated to a pressure of $1\times10^{-3}$ Pa or lower, and the following forming process was executed for forming a gap 116 in each of the aforementioned plural conductive films 108 arranged on the substrate 1.

As shown in FIG. 14, the row wirings 103 were commonly connected to the ground. A control device 131 controlled a pulse generator 132 and a line selector 134 provided with an ammeter 133. A pulse voltage was applied to one of the row wirings 102 selected by the line selector 134. The forming process was executed for each row including 300 elements. The applied pulse signal was a triangular pulse signal as shown in FIG. 15A, with a gradual increase of the wave height, and with a pulse width T1=1 msec and a pulse interval T2=10 msec. Between the triangular pulses, there was inserted a rectangular pulse of a wave height of 0.1 V and the current was measured to determine the resistance of each row. The forming process for a row was terminated when the resistance exceeded 3.3 kΩ (1 MΩ per element) and was shifted to a next row. The process was repeated for all the rows to execute the forming on all the conductive films (conductive films 108 for forming the electron emitting portions), thereby forming a gap 116 in each conductive film 108 (FIG. 12K).

Step l

Then, benzonitrile was introduced into the vacuum chamber 123 shown in FIG. 13 with a pressure of $1.3\times10^{-3}$ Pa, and a pulse signal was applied to the substrate 1 with the measurement of the current If to activate all the conductive films having the gaps 116. The pulse signal generated by the pulse generator (FIG. 14) was a rectangular pulse signal shown in FIG. 15B, with a wave height of 14 V, a pulse width T1=100 psec and a pulse interval of 167 μsec. The selected line was shifted in succession from Dx1 to Dx100 by the line selector 134 for every 167 μsec, whereby each row received the rectangular wave of T1=100 μsec and T2=16.7 msec, with successive phase shifts between the rows.

The ammeter 133 was used in a mode of detecting the average current when the rectangular pulse was turned on (with a voltage of 14 V), and the activation was terminated when the measured current reached 600 mA (2 mA per element). Such activation process formed a carbon film in the gap 106 in each of the conductive films 108.

Step m

The external housing 5 and the vacuum chamber 123 were maintained at 300° C. for 10 hours by an unrepresented heating apparatus, under the continued evacuation of the interior of the external housing 5. This process removed benzonitrile and decomposed products thereof, which were, presumably, absorbed on the internal walls of the external housing 5 and the vacuum chamber 123. The removal was confirmed by the observation with the Q-mass 127. Heating and evacuation of the external housing 5 not only removes the gas from the external housing 5, but also activates the non-evaporating getters 9, 14.

Step n

The evacuating tube was sealed off by heating with a burner, after the pressure reached $1.3\times10^{-3}$ Pa or lower.

In this fashion, the image display apparatus of the present embodiment, having the non-evaporating first getters in the image display area and also the non-evaporating second getters outside the image display area and on the sides of the area of the first getters, was prepared.

Seventh Embodiment

Figure 23A:
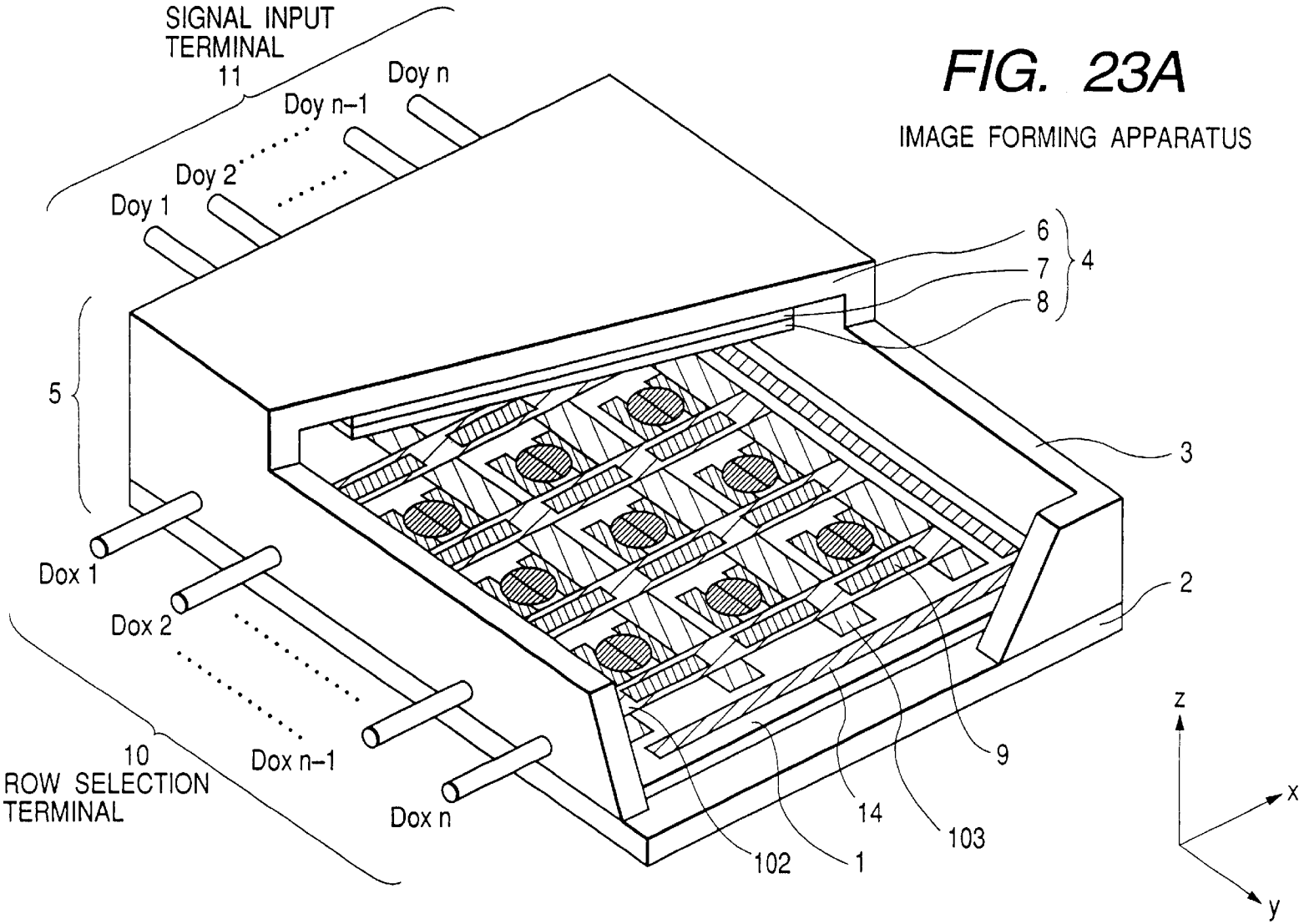
FIGS. 23A, 23B and 23C are schematic views showing an image display apparatus of the seventh embodiment.
Figure 23B:
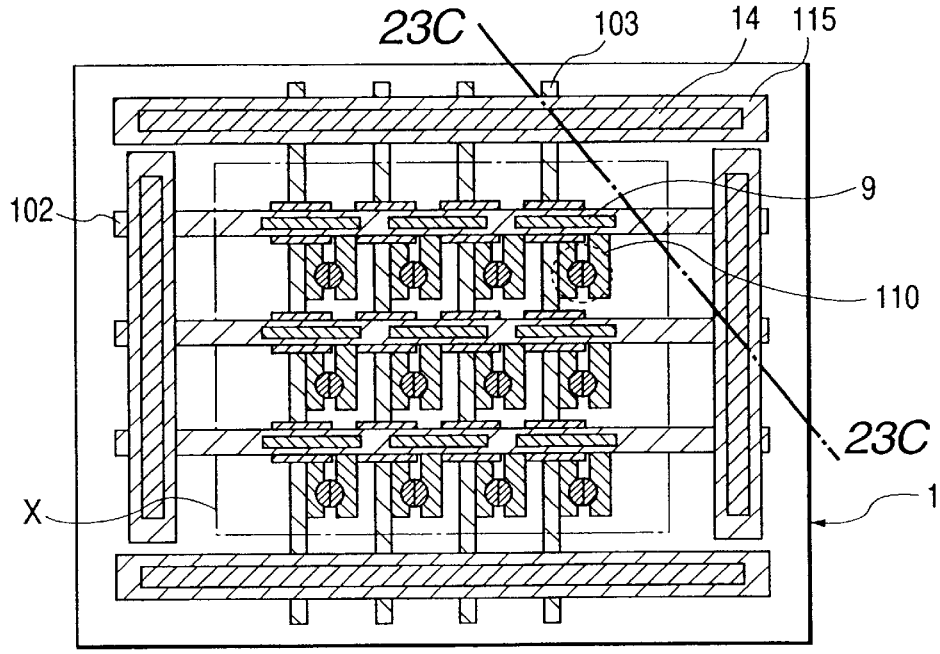
Figure 23C:
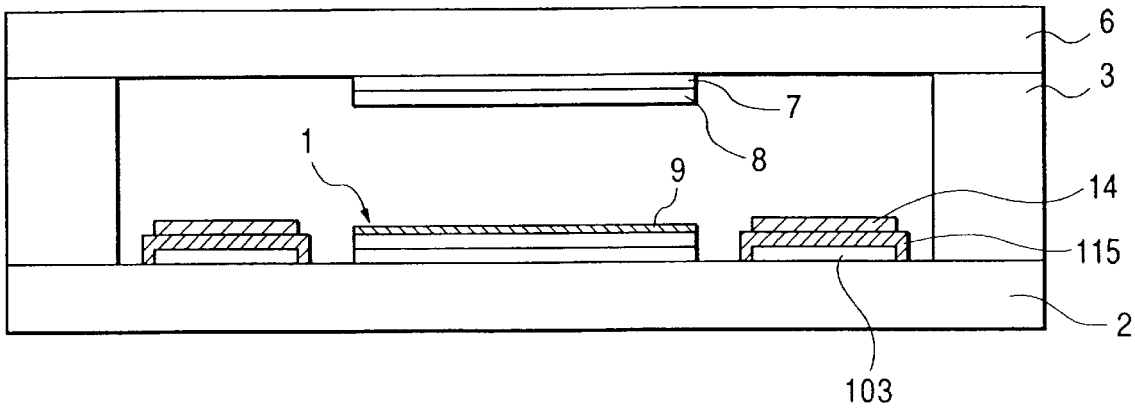

FIGS. 23A to 23C show the image display apparatus of this embodiment.

In the present embodiment, the following step f-2 was executed between the steps f and g in the foregoing sixth embodiment.

Step f-2

The insulation film 115, consisting of a silicon oxide film of a thickness of 1.0 μm, was deposited by RF sputtering also on the upper wirings 102 outside the image display area.

Also, in step x of the foregoing sixth embodiment, in forming the getters on the upper wirings 102 in the image display area and the lower wirings 103 outside the image display area, the getter layers 9, 14 consisting of a Ar—V—Fe alloy were formed by also sputtering on the insulation film 115 of the upper wirings 102 outside the image display area. The thickness of the getter layers 9, 14 was adjusted to 2 μm. The sputtering target used had a composition of Zr 70%, V 25 % and Fe 5% (ratio by weight).

Steps other than those mentioned above were executed in the same manner as in the foregoing sixth embodiment to obtain the image display apparatus of the present embodiment, having the non-evaporating first getters in the image display area and the non-evaporating getters also outside the image display area and around the first getters.

Eighth Embodiment

Figure 24A:
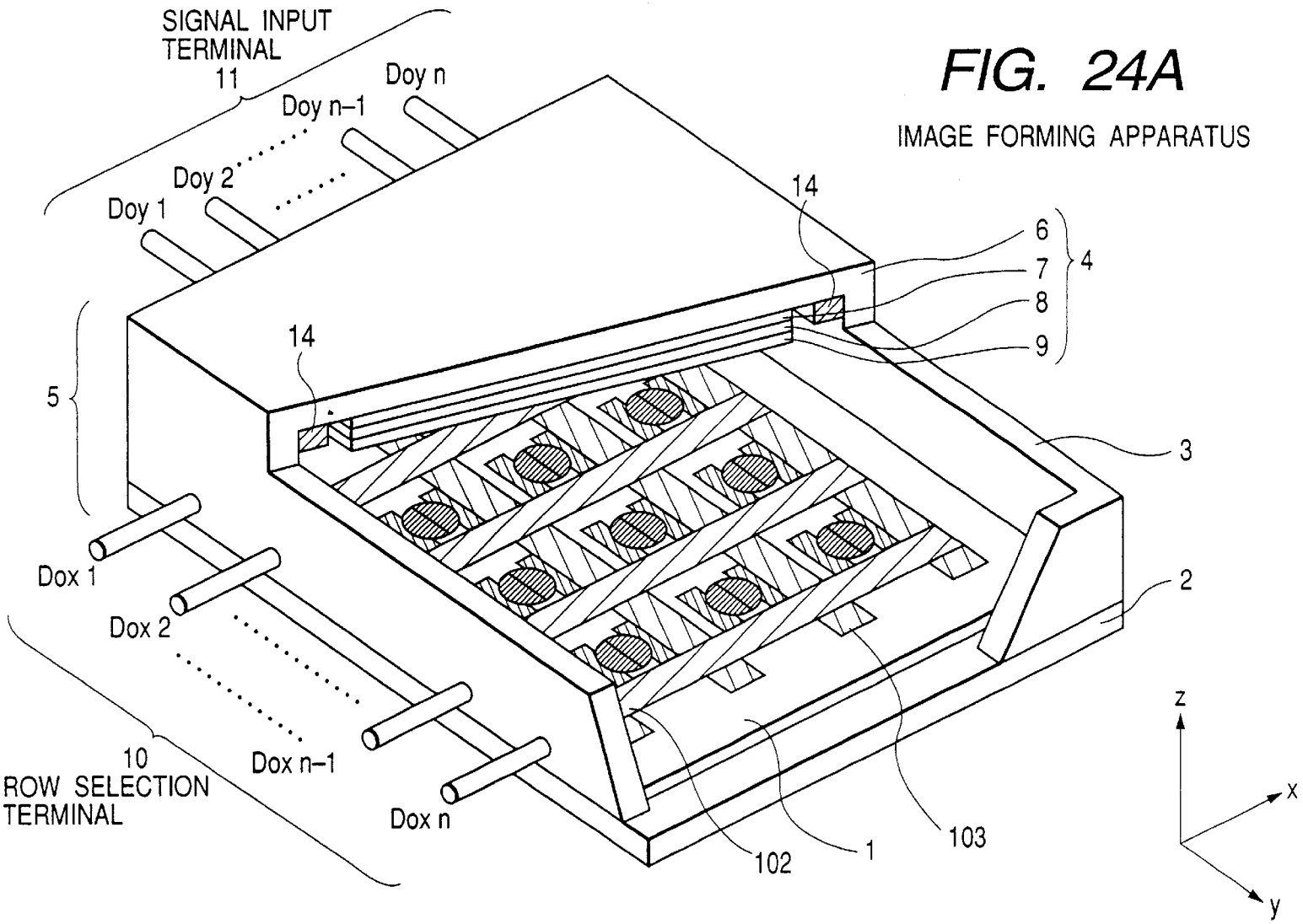
FIGS. 24A, 24B and 24C are schematic views showing an image display apparatus of the eighth embodiment.
Figure 24B:
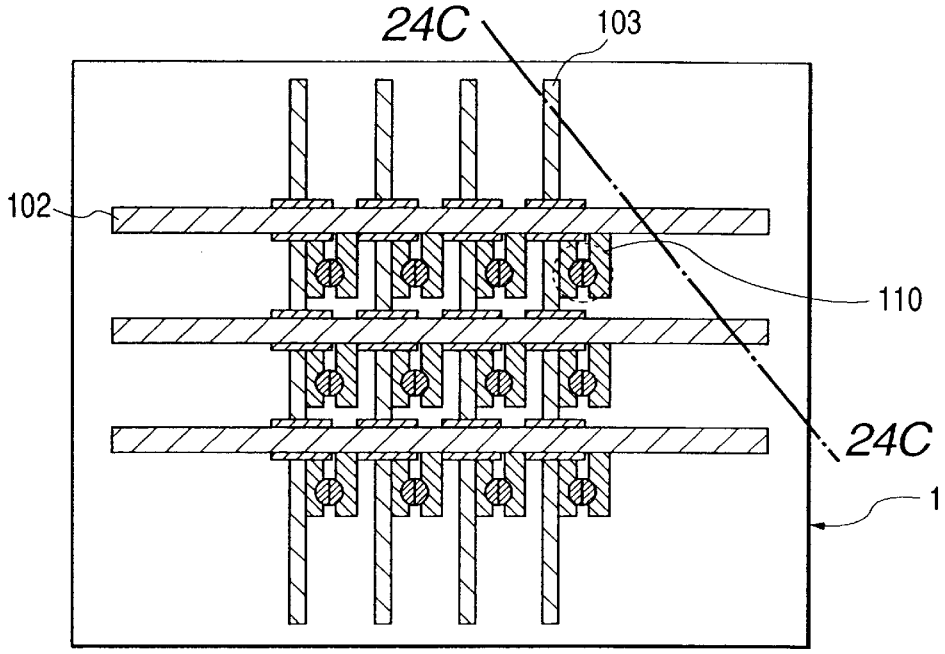
Figure 24C:
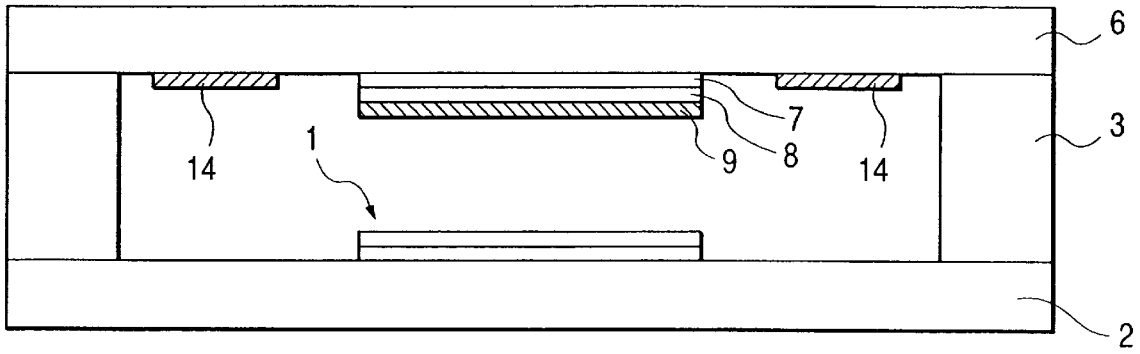

FIGS. 24A to 24C show the image display apparatus of the present embodiment.

In the present embodiment, step x of the foregoing sixth embodiment was omitted, and the following step y was executed after steps a to i were executed in the same manner as in the sixth embodiment.

Step y

The getter layer 9 was formed on the entire surface of the metal back 8 of the face plate 4, and the getter layer 14 was formed on four sides surrounding the image display area on the glass substrate 6 of the face plate 4, excluding a high voltage extracting portion (not shown), so as to be insulated from the metal back 8. More specifically, the getter layers 9, 14 consisting of a Ti—Al alloy were formed by sputtering with a thickness of 50 nm. The sputtering target used had a composition of Ti 85 and Al 15% (ratio by weight).

Thereafter, steps j to n were executed in the same manner as in the sixth embodiment to obtain the image display apparatus of the present embodiment, having the non-evaporating first getters in the image display area and the non-evaporating getters outside the image display area and around the first getters.

Ninth Embodiment

Figure 25A:
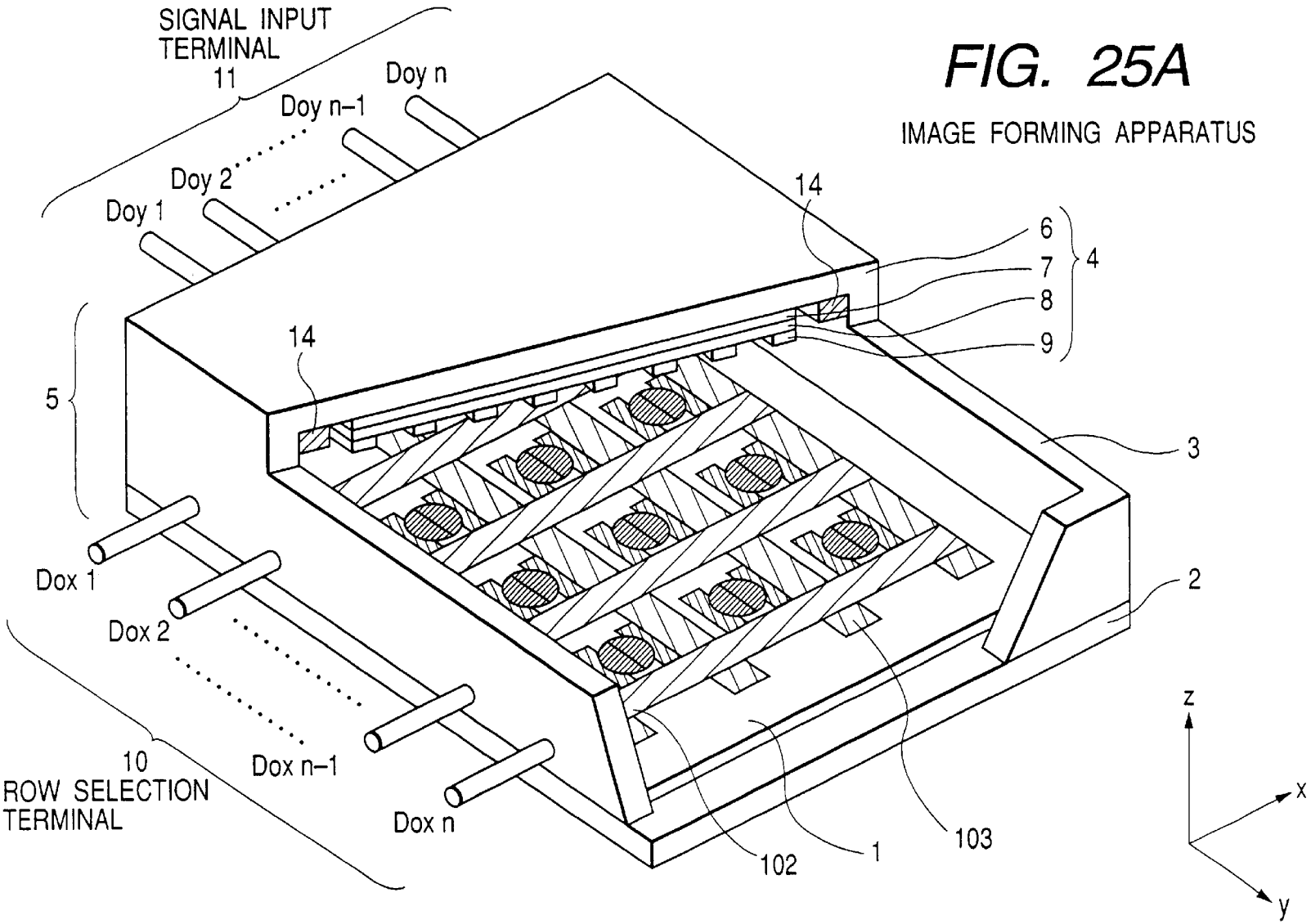
FIGS. 25A, 25B and 25C are schematic views showing an image display apparatus of the ninth embodiment.
Figure 25B:
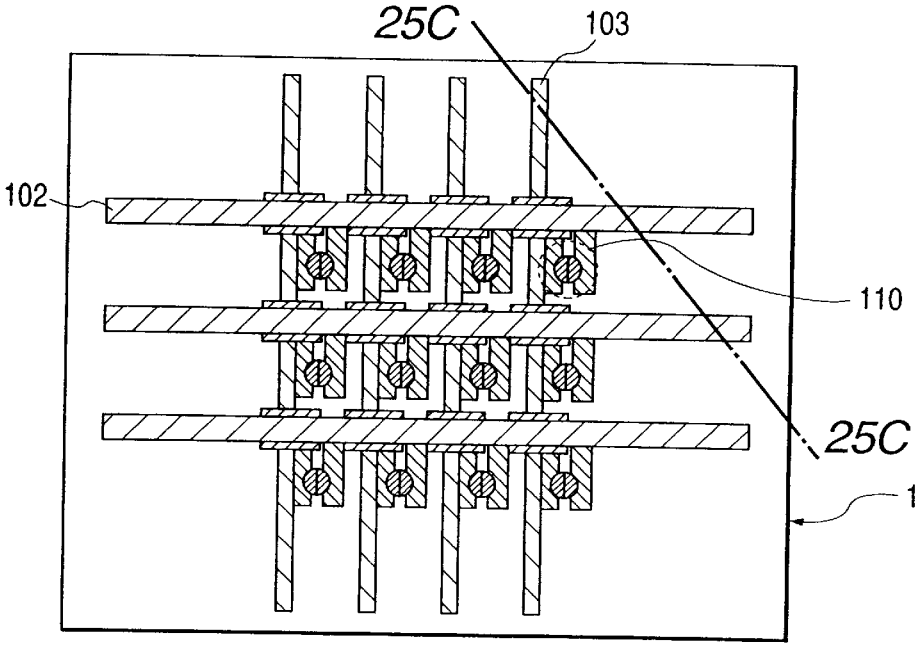
Figure 25C:
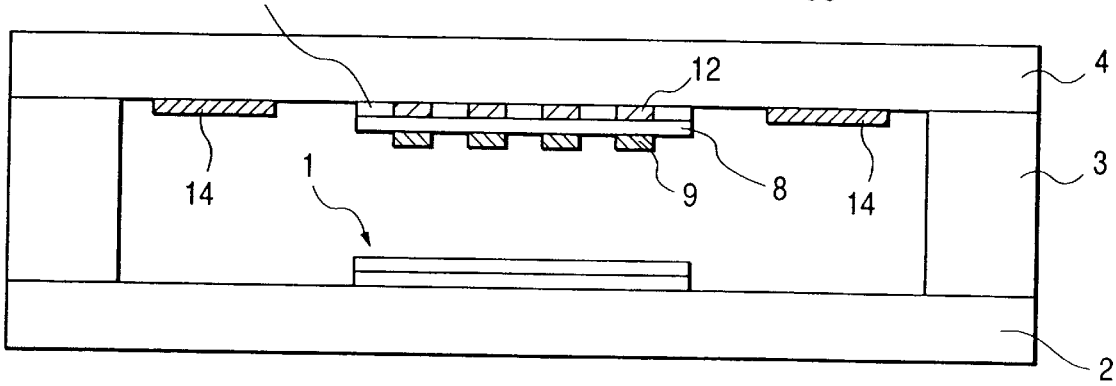

FIGS. 25A to 25C show the image display apparatus of the present embodiment.

In the present embodiment, step x of the foregoing sixth embodiment was omitted, and the following step z was executed after steps a to i in the same manner as in the foregoing sixth embodiment.

Step z

The getter layer 9 was formed on the black stripes 12 of the face plate 4, and the getter layer 14 was formed on the four sides surrounding the image display area on the glass substrate 6 of the face plate 4, excluding the high voltage extracting portion, so as to be insulated from the metal back 8. More specifically, the getter layers 9, 14 consisting of a Ti—Al alloy were formed by sputtering with a thickness of 1 μm The sputtering target used had a composition of Ti 85% and Al 15% (ratio by weight).

Thereafter, steps j to n were executed in the same manner as in the sixth embodiment to obtain the image display apparatus of the present embodiment, having the non-evaporating first getters in the image display area and the non-evaporating second getters outside the image display area and around the first getters.

Tenth Embodiment

The present embodiment was executed in the same manner as the foregoing sixth embodiment, except that the non-evaporating getter layer 14 outside the image display area was formed with a thickness of 5 μm, which is thicker than the non-evaporating getter layer 9 in the image display area, to obtain the image display apparatus having the non-evaporating first getters in the image display area and the non-evaporating getters outside the image display area and on the sides surrounding the first getters.

Eleventh Embodiment

Figure 26A:
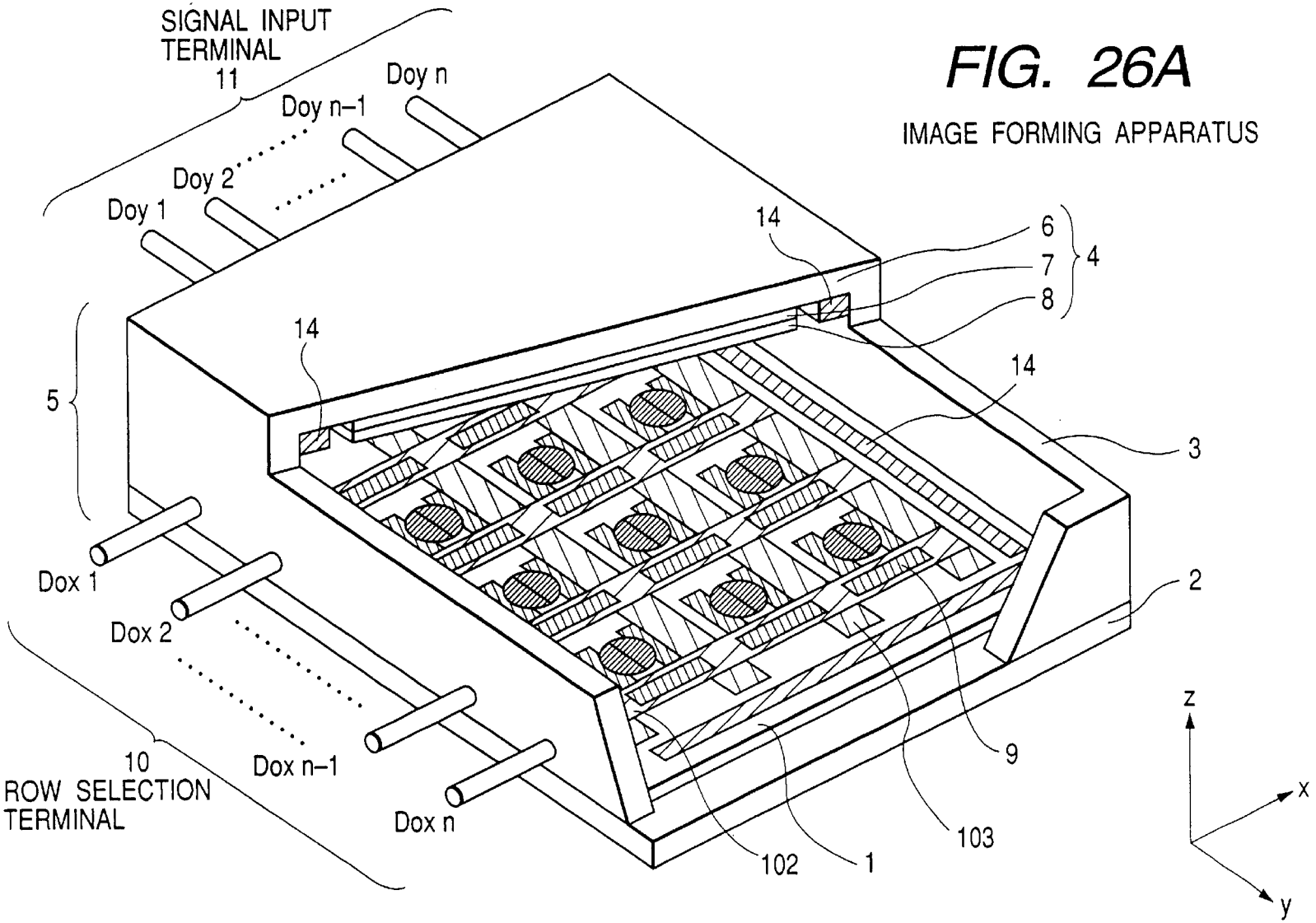
FIGS. 26A, 26B and 26C are schematic views showing an image display apparatus of the eleventh embodiment.
Figure 26B:
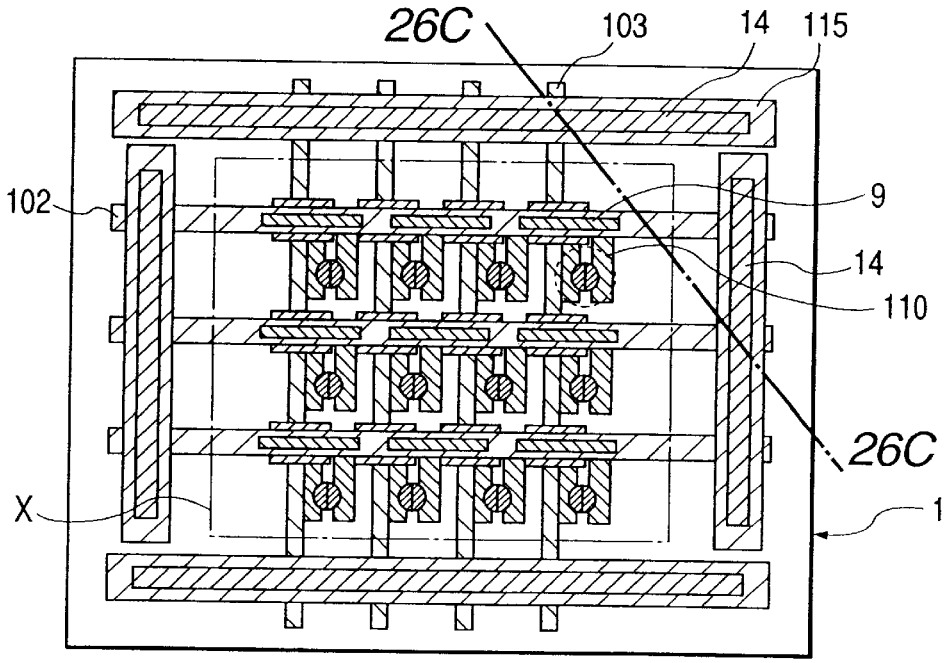
Figure 26C:
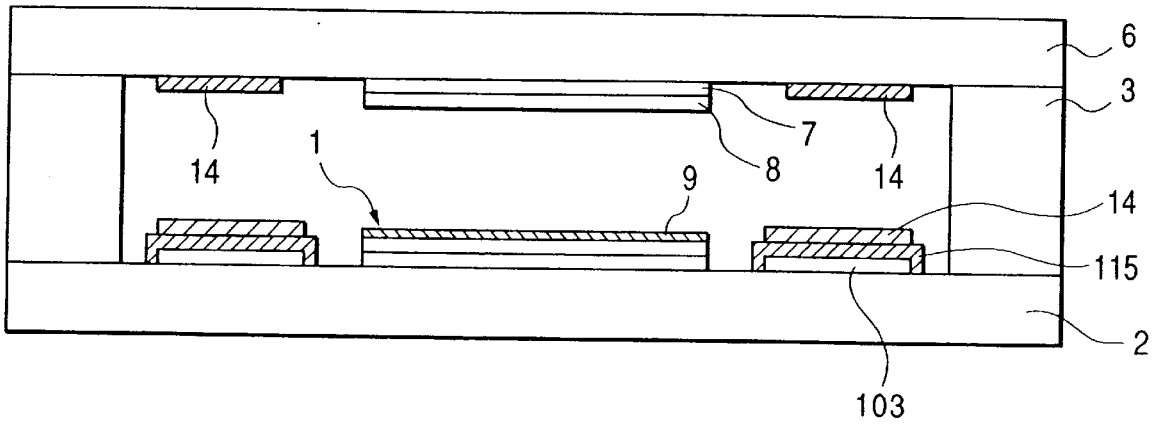

FIGS. 26A to 26C show the image display apparatus of the present embodiment.

The present embodiment was executed in the same manner as the foregoing sixth embodiment, except that the non-evaporating getter layer 14 outside the image display area was formed both on the rear plate and the face plate, on the four sides surrounding the non-evaporating getters 9, and that the non-evaporating getters were activated by heating for 3 hours at 350° C. after the sealing step, to obtain the image display apparatus having the non-evaporating first getters in the image display area and the non-evaporating getters outside the image display area and around the first getters.

Twelfth Embodiment

The present embodiment was executed in the same manner as the foregoing sixth embodiment, except that the non-evaporating getters 14 outside the image display area were activated by laser light irradiation during the sealing step, to obtain the image display apparatus having the non-evaporating first getters in the image display area and also the non-evaporating getters outside the image display area and on both sides of the first getters.

The image display apparatus of the foregoing sixth to twelfth embodiments and the aforementioned reference example were evaluated and compared. The comparison was executed by conducting a simple matrix drive in each of the image display apparatus of the foregoing sixth to twelfth embodiments and the aforementioned reference example to effect continuous light emission over the entire surface and measuring the variation of luminance over time.

As a result, though there was a difference in the initial luminance, the image display apparatuses of the sixth to twelfth embodiments, like those of the first to fifth embodiments, showed little decrease in the luminance and little fluctuation in the luminance among the pixels even after a prolonged drive, in comparison with the apparatus of the reference example.

Thirteenth Embodiment

The image display apparatus of this embodiment is similar in configuration to that shown in FIGS. 6A and 6B, wherein the non-evaporating getters 9 are provided on the row wirings (upper wirings) 102 and the non-evaporating getters 14 formed by the printing method.

The image display apparatus of the present embodiment is provided, on the substrate 1, with an electron source consisting of plural surface conduction electron emitting elements wired in a simple matrix structure (100 rows×100 columns).

FIG. 7 is a partial plan view of the electron source substrate 1, while FIG. 8 is a cross-sectional view along a line 8—8 in FIG. 7. The same components are represented by the same numbers in FIGS. 7 and 8. There are shown an electron source substrate 1, row wirings (upper wirings or scanning wirings) 102, column wirings (lower wirings or signal wirings) 103, conductive films 108 including the electron emitting portions, element electrodes 105, 106, and an interlayer insulation film 104.

In the following, there will be explained, with reference to FIGS. 27A to 27F, a method for producing the image display apparatus of the present embodiment.

Step a

Figure 27A:
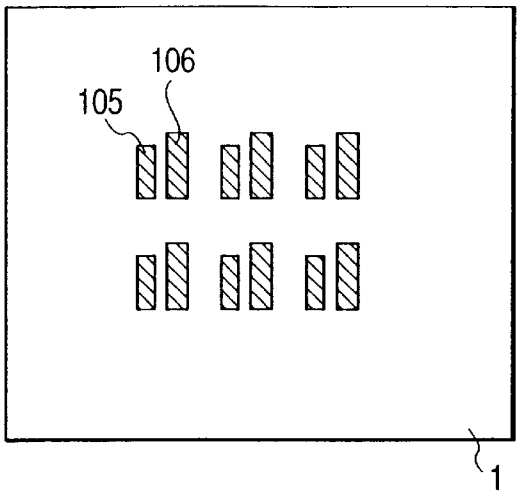
FIGS. 27A, 27B, 27C, 27D, 27E and 27F are views showing the process for producing an electron source substrate of the thirteenth embodiment in which the surface conduction electron emitting elements are arranged in a simple matrix.

The glass substrate 1 was sufficiently cleaned with a washing agent, deionized water and organic solvent. On the glass substrate 1, a silicon oxide film of a thickness of 0.5 μm was formed by sputtering. Then, on the substrate 1, a photoresist pattern (RD-2000N-41/Hitachi Chemical Co.) of the element electrodes 105, 106 was formed, and Ti of a thickness of 5 nm and Ni of a thickness of 100 nm were deposited in succession by vacuum evaporation. The photoresist pattern was dissolved with organic solvent to lift off the Ni/Ti deposition film to obtain the element electrodes 105, 106 with a gap G therebetween of 3 μm and a width of the electrode of 300 μm (FIG. 27A).

Step b

Figure 27D:
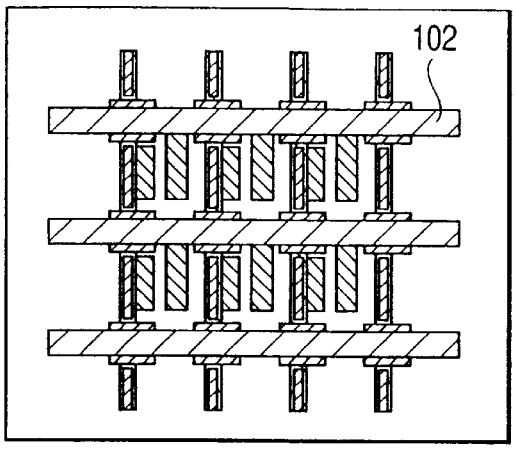
Figure 27B:
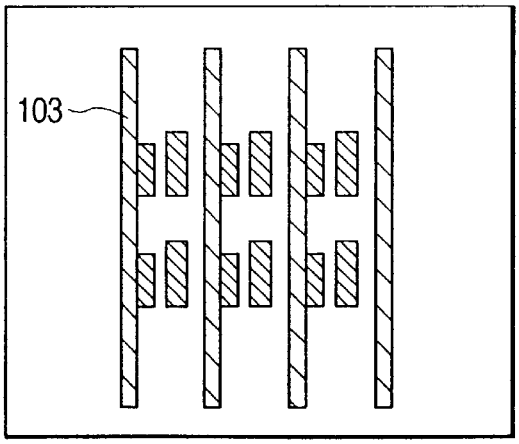

Then, the lower wirings 103 were formed by screen printing so as to be in contact with the element electrodes 105, and were heat treated at 400° C. to obtain the lower wirings 103 of the desired form (FIG. 27B).

Step c

Then, the interlayer insulation films 104 were screen printed in the crossing areas of the upper and lower wirings and were heat treated at 400° C. (FIG. 27C).

Step d

The upper wirings 102 were screen printed, so as to be in contact with the element electrodes 106, which are not in contact with the lower wirings 103, and were heated treated at 400° C. (FIG. 27D).

Step e

A Cr film (not shown) of a thickness of 100 nm was deposited by vacuum evaporation and patterned. Then, an amine complex solution (ccp4230/Okuno Pharmaceutical Co.) was spin coated thereon and was heat treated for 10 minutes at 300° C. The conductive films 108, principally consisting of fine Pd powder for forming the electron emitting portions, had a film thickness of 8.5 nm and a sheet resistance of $3.9\times10^4$ Ω/□.

Figure 27E:
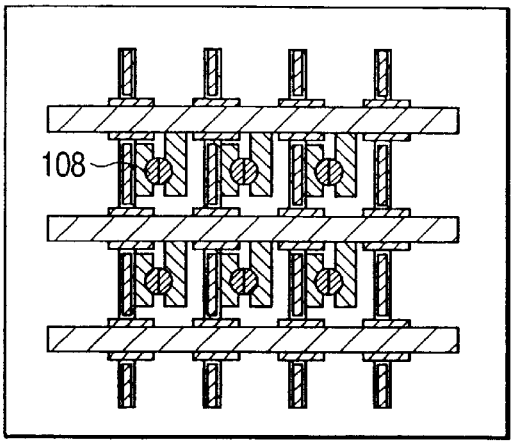
Figure 27C:
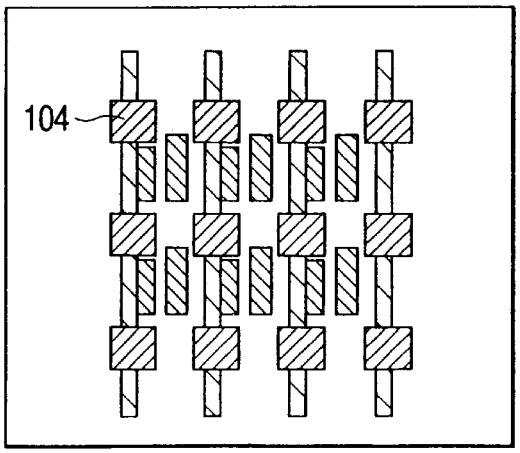

The Cr film and the conductive films 108 for forming the electron emitting portions, after sintering, were wet etched with an acid etchant to form the conductive films 108 of the desired pattern (FIG. 27E).

Through the foregoing steps, there were obtained, on the substrate 1, the conductive films 108 for forming the plural electron emitting portions and the plural upper wirings 102 and the plural lower wirings 103 connecting such conductive films 108 in the simple matrix.

Step f

Figure 27F:
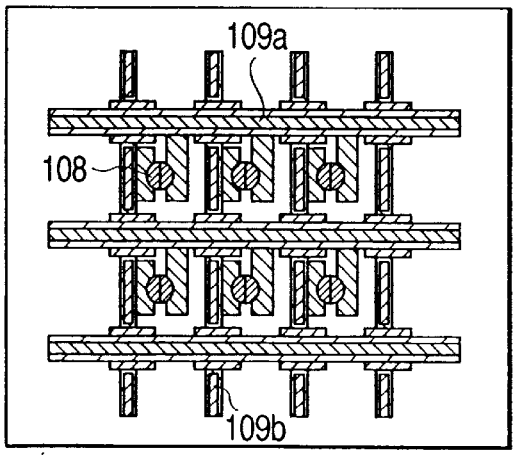

The photoresist (AZ1370/Hoechst Co.) was spin coated with a spinner and then baked, exposed to the image of a photomask and developed to form a resist pattern on the upper wirings 102 and on the lower wirings 103 not covered by the interlayer insulation film 104, and non-evaporating getter layers 109*a*, 109*b* consisting of a Zr—V—Fe alloy were formed by sputtering (FIG. 27F). The thickness of the getter layers 109*a*, 109*b* was adjusted to 2 μm. The sputtering target employed had a composition of Zr 70%, V 25% and Fe 5% (in weight ratio).

Step g

Then, the face plate 4 shown in FIGS. 6A to 6C was prepared in the same manner as in step i of the aforementioned first embodiment.

Step h

Then, the external housing 5 shown in FIGS. 6A to 6C was formed in the following manner.

The substrate 1, prepared in the foregoing steps, was fixed on the rear plate 2, and the supporting frame 3 and the face plate 4 were combined therewith. The lower wirings 103 and the upper wirings 102 of the substrate 1 were connected, respectively, to the row selecting terminals 10 and the signal input terminals 11. Then, the substrate 1 and the face plate 4 were precisely adjusted in position and were sealed to form the external housing 5. The sealing was executed by applying frit glass on the jointing portions and heating for 30 minutes at 450° C. in Ar gas. The substrate 1 and the rear plate 2 were fixed in a similar manner.

The subsequent steps were executed with a vacuum apparatus shown in FIG. 13.

Step i

At first, the interior of the external housing 5 was evacuated to a pressure of $1\times10^{-3}$ Pa or lower, and the following forming process was executed for forming a gap 116 in each of the aforementioned plural conductive films 108 arranged on the substrate 1.

As shown in FIG. 14, the row wirings 103 were commonly connected to the ground. A control device 131 controlled a pulse generator 132 and a line selector 134 provided with an ammeter 133. A pulse voltage was applied to one of the row wirings 102 selected by the line selector 134. The forming process was executed for each row including 300 elements. The applied pulse signal was a triangular pulse signal as shown in FIG. 15A, with a gradual increase of the wave height, and with a pulse width T1=1 msec and a pulse interval T2=10 msec. Between the triangular pulses, there was inserted a rectangular pulse of a wave height of 0.1 V and the current was measured to determine the resistance of each row. The forming process for a row was terminated when the resistance exceeded 3.3 kΩ (1 MΩ per element) and was shifted to a next row. The process was repeated for all the rows to execute the forming on all the conductive films (conductive films 108 for forming the electron emitting portions), thereby forming a gap 116 in each conductive film 108.

Step j

Then, benzonitrile was introduced into the vacuum chamber 123 shown in FIG. 13 with a pressure of $1.3\times10^{-3}$ Pa, and a pulse signal was applied to the substrate 1 with the measurement of the current If to activate all the conductive films having the gaps 116. The pulse signal generated by the pulse generator 132 (FIG. 14) was a rectangular pulse signal shown in FIG. 15B, with a wave height of 14 V, a pulse width T1=100 μsec and a pulse interval of 167 μsec. The selected line was shifted in succession from Dx1 to Dx100 by the line selector 134 for every 167 μsec, whereby each row received the rectangular wave of T1=100 μsec and T2=16.7 μsec, with successive shifts in the phase between the rows.

The ammeter 133 was used in a mode of detecting the average current when the rectangular pulse was turned on (with a voltage of 14 V), and the activation was terminated when the measured current reached 600 mA (2 mA per element). Such activation process formed a carbon film in the gap 106 in each of the conductive films 108.

Step k

The external housing 5 and the vacuum chamber 123 were maintained at 300° C. for 10 hours by an unrepresented heating apparatus, under the continued evacuation of the interior of the external housing 5. This process removed benzonitrile and decomposed products thereof, which, presumably, absorbed on the internal walls of the external housing 5 and the vacuum chamber 123. The removal was confirmed by the observation with the Q-mass 127. This step executes, by the heating and evacuation of the external housing 5, not only the gas removal from the interior thereof but also the activation of the aforementioned non-evaporating getters. The heating was executed for 10 hours at 300° C., but such conditions are not restrictive. Similar effects in removing benzonitrile and in activating the non-evaporating getters could be obtained not only by elevating the heating temperature but also by prolonging the heating time even at a lower temperature.

Step l

The evacuating tube was sealed off by heating with a burner after the pressure reached $1.3\times10^{-5}$ Pa or lower.

In this manner, there was prepared the image display apparatus of the present embodiment, having the non-evaporating getters on the printed wirings in the image display area.

The present embodiment employed the photolithographic process and film formation by sputtering, but such methods are not restrictive. Similar effects can also be obtained by patterning with a metal mask, or by a method of drawing the pattern of an adhesive material with a dispenser or by printing and adhering the powder of the non-evaporating getter material, or by the plating method.

Fourteenth Embodiment

Figure 28A:
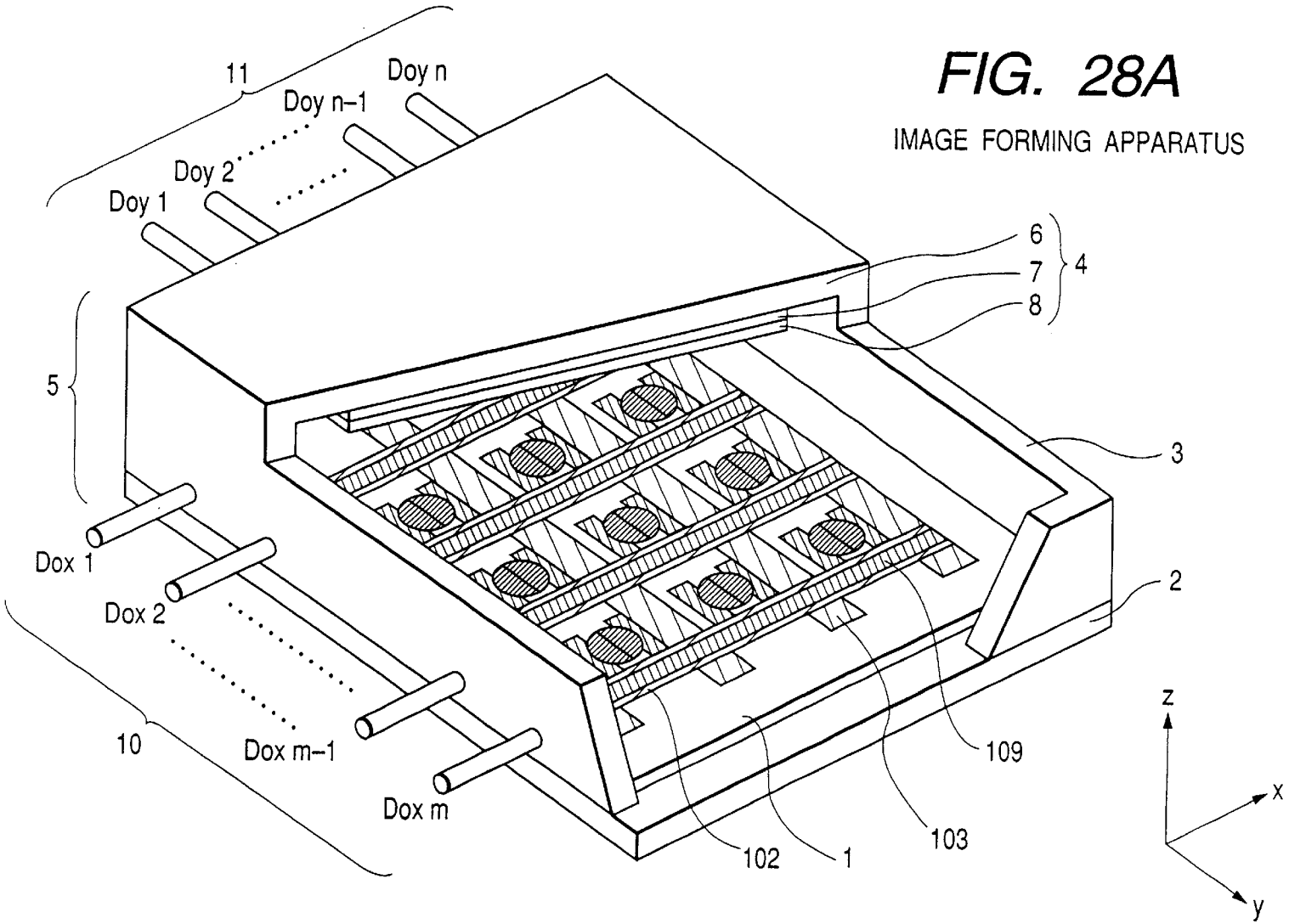
FIGS. 28A and 28B are schematic views showing an image display apparatus of the fourteenth embodiment.
Figure 28B:
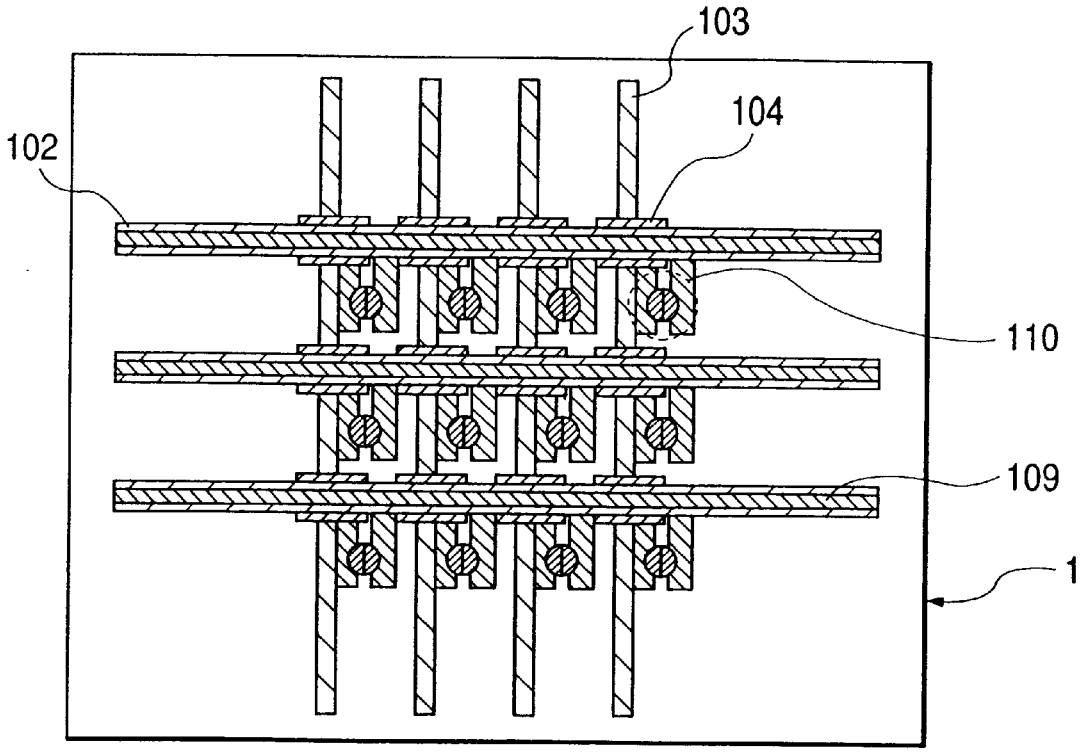

FIGS. 28A and 28B show the image display apparatus of this embodiment.

In the present embodiment, the following step f-2 was executed instead of step f of the foregoing thirteenth embodiment after steps a to e therein. It is different from the thirteenth embodiment in that the non-evaporating getters are formed only on the row wirings (upper wirings).

Step f-2

The photoresist (AZ1370/Hoechst Co.) was spin coated with a spinner and then baked, exposed to the image of a photomask and developed to form a resist pattern on the upper wirings 102, and a non-evaporating getter layer 109 consisting of a Zr—V—Fe alloy was formed by sputtering. The thickness of the getter layer 109 was adjusted to 2 μm. The sputtering target employed had a composition of Zr 70%, V 25% and Fe 5% (in weight ratio).

Thereafter, the steps g to l of the foregoing thirteenth embodiment were executed to obtain the image display apparatus of the present embodiment, having the non-evaporating getters on the printed wirings in the image display area.

Fifteenth Embodiment

Figure 29A:
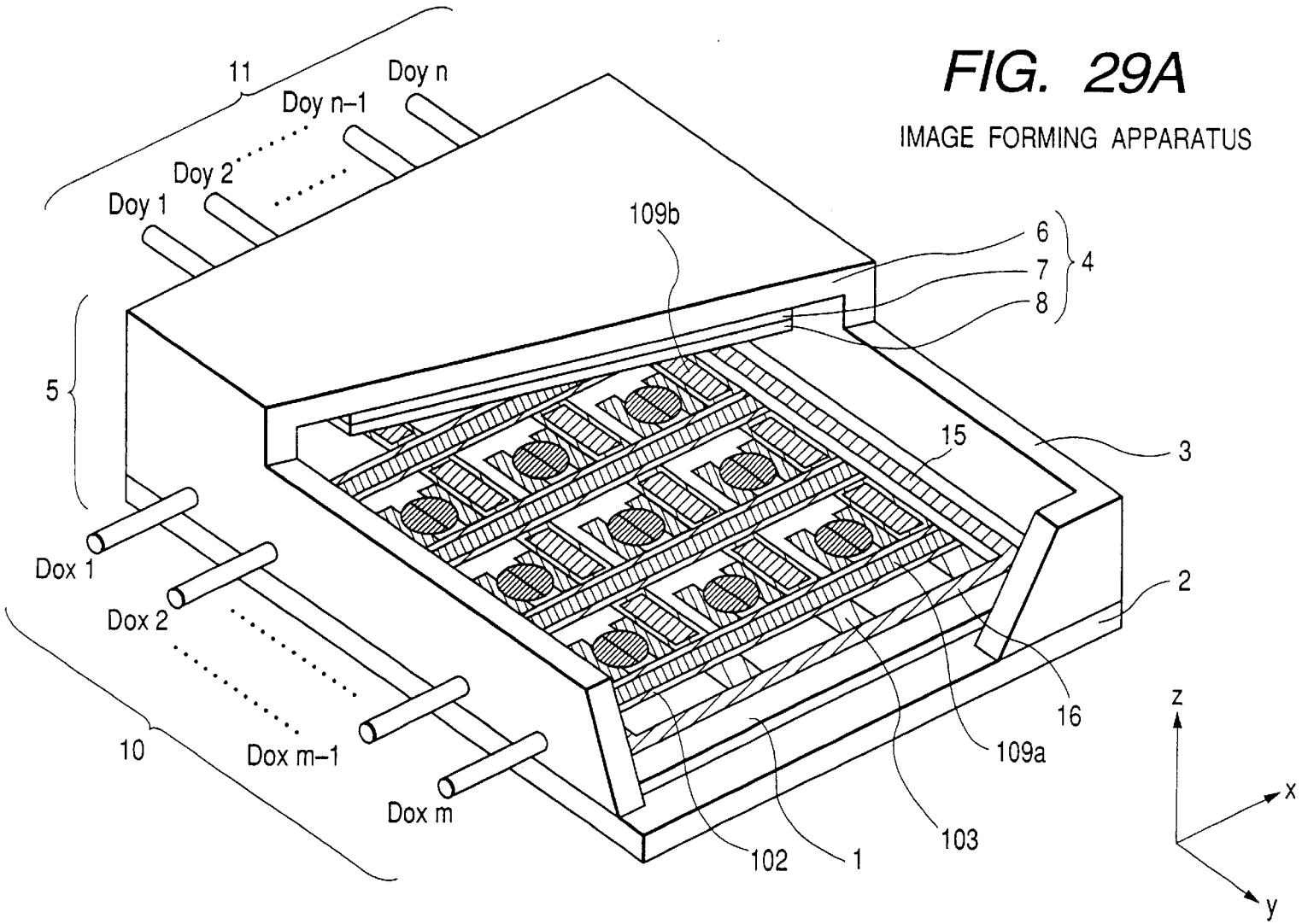
FIGS. 29A and 29B are schematic views showing an image display apparatus of the fifteenth embodiment.
Figure 29B:
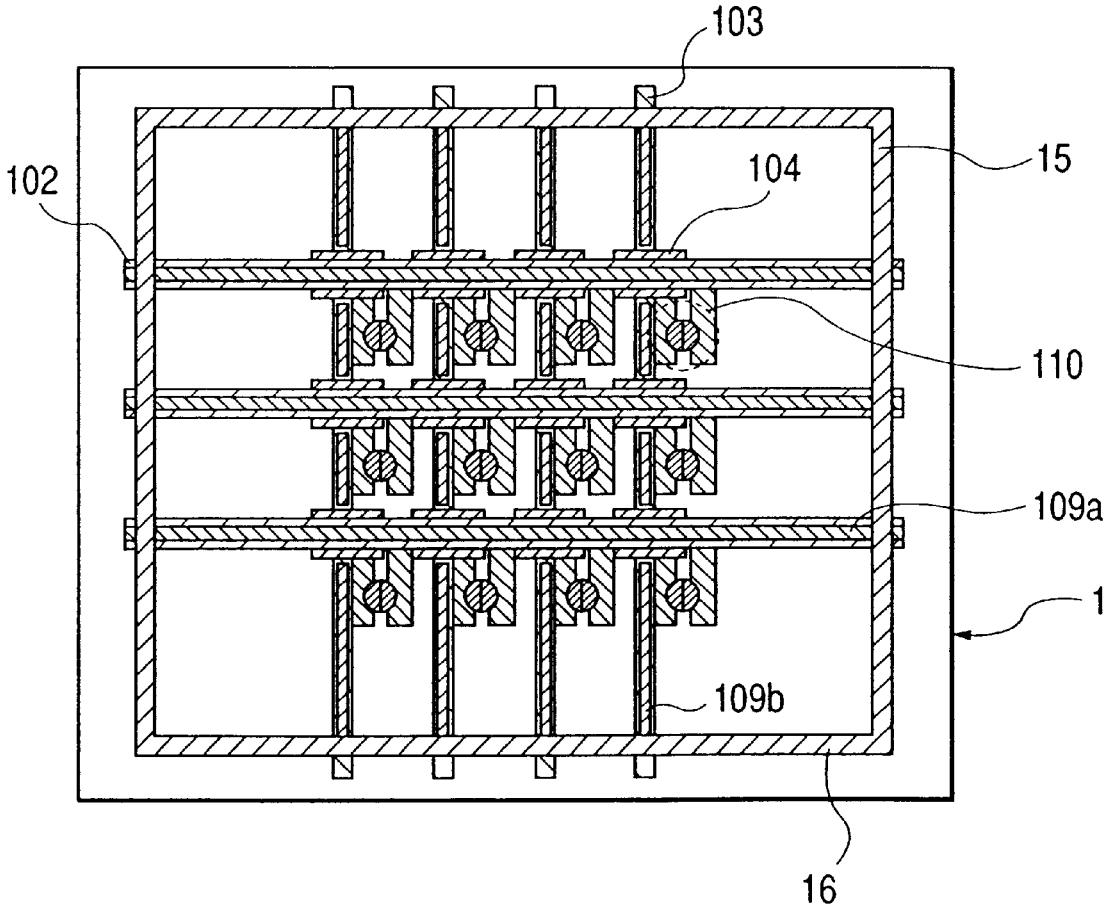

FIGS. 29A and 29B show the image display apparatus of this embodiment. The image display apparatus of this embodiment is the same as that of the thirteenth embodiment, except that the non-evaporating getters 15 are also formed around the image display area.

In the present embodiment, the following step c-3 was executed instead of step c of the foregoing thirteenth embodiment after steps a and b, and the following step f-3 was executed instead of step f of the thirteenth embodiment after steps d and e therein.

Step c-3

Interlayer insulation layers 104, 16 were screen printed at the crossing areas of the upper and lower wirings and around the image display area, and were sintered by heating at 400° C.

Step f-3

The photoresist (AZ1370/Hoechst Co.) was spin coated with a spinner and then baked, exposed to the image of a photomask and developed to form a predetermined pattern on the upper and lower wirings and on the insulation layer 16 around the image display area, and a film consisting of a Zr—V—Fe alloy was formed by sputtering. Thereafter the unnecessary portion were removed by lift-off to form the latter layers 109*a*, 109*b*, 15. The thickness of the getter layers 109*a*, 109*b*, 15 was adjusted to 2 μm. The sputtering target employed had a composition of Zr 70%, V 25% and Fe 5% (in weight ratio).

Thereafter, steps g to l of the foregoing thirteenth embodiment were executed to obtain the image display apparatus of the present embodiment, having the non-evaporating getters on the printed wirings in the image display area and outside the image display area on the insulation layer formed by printing around the image display area.

In the thirteenth, fourteenth and fifteenth embodiments, the element electrodes and the conductive films were formed by the photolithographic process or the vacuum film formation, but such methods are not restrictive. Similar effects can also be obtained by the printing method, the plating method or the drawing method with a dispenser.

In the fifteenth embodiment, the non-evaporating getters 15 were formed around the image display area, but such configuration is not restrictive and similar effects can be obtained by, for example, forming wire-shaped getters.

The image display apparatus of the foregoing thirteenth, fourteenth and fifteenth embodiments and the aforementioned reference example were compared. The comparison was executed by conducting a simple matrix drive in each of the image display apparatuses of the foregoing thirteenth to fifteenth embodiments and the aforementioned reference example to effect continuous light emission over the entire surface and measuring the variation of luminance over time.

As a result, though there was a difference in the initial luminance, in comparison with the apparatus of the reference example, the image display apparatus of the embodiment thirteenth showed extremely little decrease of the luminance and extremely little fluctuation in the luminance among the pixels even after a prolonged drive. Also, the image display apparatuses of the fourteenth and fifteenth embodiments showed little decrease of the luminance and little fluctuation in the luminance among the pixels, as in those of the first to twelfth embodiments.

As explained in the foregoing, the present invention provides an image display apparatus with little deterioration in the electron emitting characteristics of the electron source over time and a production method therefor.

Also, the present invention provides an image display apparatus with little change in the luminance over time and a production method therefor.

Furthermore, the present invention provides an image display apparatus with little generation of the luminance unevenness over time in the image display area and a producing method therefor.

What is claimed is:

1. A method for producing the image display apparatus provided with an external housing constituted by members including first and second substrates positioned with a gap therebetween, an electron source positioned on said first substrate in said external housing, a fluorescent film and an accelerating electrode provided on said second substrate, and a non-evaporating getter positioned on said first or second substrate the method comprising:

a sealing step of adhering plural members constituting said external housing, wherein an activation process for the getter is executed prior to said sealing step, until the completion thereof, and wherein said activation of said getter is executed by irradiating said getter with laser light.

2. The method for producing the image display apparatus according to claim 1, wherein the activation of said getter is executed again after said sealing step.

3. A method for producing the image display apparatus provided with an external housing constituted by members including first and second substrates positioned with a gap therebetween, an electron source positioned on said first substrate in said external housing, a fluorescent film and an accelerating electrode provided on said second substrate, and a getter, the method comprising:

a sealing step of adhering plural members constituting said external housing, wherein said getter comprises a first getter disposed within an image display area on said first or second substrate and a second getter disposed outside the image display area surrounding the first getter, and wherein an activation process for the second getter is executed prior to said sealing step, until the completion thereof.

4. The method for producing the image display apparatus according to claim 3, wherein said first getter is a non-evaporating getter.

5. The method for producing the image display apparatus according to claim 3, wherein said first getter is a non-evaporating getter and said second getter is an evaporating getter.

6. The method for producing the image display apparatus according to claim 3, wherein said first and second getters are non-evaporating getters.

7. The method for producing the image display apparatus according to claim 3, wherein said first getter is disposed on said accelerating electrode on said second substrate.

* * * * *